US011592196B2

(12) United States Patent
Sims, Jr. et al.

(10) Patent No.: US 11,592,196 B2
(45) Date of Patent: Feb. 28, 2023

(54) VENTILATION SYSTEM AND METHOD FOR KILLING AIRBORNE INFECTIOUS BACTERIA, VIRUSES AND OTHER PATHOGENS

(71) Applicants: Dewey McKinley Sims, Jr., Royal Oak, MI (US); Dewey McKinley Sims, III, Berkley, MI (US)

(72) Inventors: Dewey McKinley Sims, Jr., Royal Oak, MI (US); Dewey McKinley Sims, III, Berkley, MI (US)

(73) Assignee: MCKINLEY SIMS HOLDINGS LLC, Berkley, MI (US)

( * ) Notice: Subject to any disclaimer, the term of this patent is extended or adjusted under 35 U.S.C. 154(b) by 249 days.

(21) Appl. No.: 16/944,054

(22) Filed: Jul. 30, 2020

(65) Prior Publication Data

US 2022/0034526 A1 Feb. 3, 2022

(51) Int. Cl.
*F24F 3/16* (2021.01)
*F24F 11/00* (2018.01)
(Continued)

(52) U.S. Cl.
CPC ..... *F24F 3/16* (2013.01); *F24F 7/06* (2013.01); *F24F 9/00* (2013.01); *F24F 11/0001* (2013.01);
(Continued)

(58) Field of Classification Search
CPC ..... F24F 3/16; F24F 7/06; F24F 11/74; F24F 11/0001; F24F 9/00; F24F 8/22; F24F 2221/14
(Continued)

(56) References Cited

U.S. PATENT DOCUMENTS 4,422,824 A * 12/1983 Eisenhardt, Jr. ..... F04D 25/088 55/467
6,497,840 B1 * 12/2002 Palestro ..... A61L 9/20 422/4
(Continued)

OTHER PUBLICATIONS

Vidashield, Installation and Operating Instructions, Medical Illumination, Jun. 20, 2019 (Year: 2019).*
(Continued)

*Primary Examiner* — Avinash A Savani
*Assistant Examiner* — Dana K Tighe
(74) *Attorney, Agent, or Firm* — Mastrogiacomo PLLC; Patrick Mastrogiacomo, Jr.

(57) ABSTRACT

A ventilation system is provided, the ventilation system comprising at least one air flow generating device, the at least one air flow generating device having a calibrated speed to produce a downward air flow capable of forcing a cloud of infectious bacterial, viral or pathogen particles or droplets out of an ingestion zone of a mouth, a nose and eyes of an individual, at least one ultraviolet C light lamp positioned proximate at least one wall of an area in a pathway of an infected air flow, the infected air flow containing the cloud of infectious bacterial, viral or pathogen particles or droplets, an ultraviolet C radiation field created by the at least one ultraviolet C light lamp, the ultraviolet C radiation field extending throughout the area from the at least one wall near a ceiling of the area and the infected air flow containing the cloud of infectious bacterial, viral or pathogen particles or droplets passing through the ultraviolet C radiation field, wherein the at least one air flow generating device is positioned to enable an upward air flow return to the at least one air flow generating device to force the infected air flow and the cloud of infectious bacterial, viral or pathogen particles or droplets out of an area and through the ultraviolet C radiation field to eradicate the
(Continued)

infectious bacteria, virus and pathogens from the infected air flow, and wherein a fresh air flow free of infectious bacteria, viruses and pathogens is reintroduced back into the area by the downward air flow of the at least one air flow generating device.

23 Claims, 45 Drawing Sheets

(51) Int. Cl.

| | |
|---|---|
| ***F24F 7/06*** | (2006.01) |
| ***F24F 9/00*** | (2006.01) |
| ***F24F 11/74*** | (2018.01) |
| *F24F 8/22* | (2021.01) |

(52) U.S. Cl.
CPC ..... *F24F 11/74* (2018.01); *F24F 8/22* (2021.01); *F24F 2221/14* (2013.01)

(58) Field of Classification Search
USPC ..... 454/370
See application file for complete search history.

(56) References Cited

U.S. PATENT DOCUMENTS

| | | | | |
|---|---|---|---|---|
| 6,855,295 | B2 * | 2/2005 | Kulp | F24F 3/16 422/121 |
| 7,922,351 | B2 | 4/2011 | Welker | |
| 8,350,228 | B2 | 1/2013 | Welker | |
| 8,439,517 | B2 | 5/2013 | Welker | |
| 8,894,478 | B1 * | 11/2014 | Stillwagon | F24F 8/10 454/231 |
| 9,399,998 | B1 * | 7/2016 | Hardie | F04D 29/181 |
| 11,027,038 | B1 * | 6/2021 | Rhoades | A61L 9/22 |
| 2005/0058584 | A1 * | 3/2005 | Shyu | A61L 9/20 422/4 |
| 2005/0150386 | A1 * | 7/2005 | Cheng | B01D 46/521 96/226 |
| 2009/0004046 | A1 * | 1/2009 | McEllen | H05B 41/39 422/2 |
| 2022/0010988 | A1 * | 1/2022 | Cash | F24F 3/163 |

OTHER PUBLICATIONS

Product: VidaShield UV24; Website: https://vidashield.com; Company: Medical Illumination; Jul. 17, 2019.

* cited by examiner

VENTILATION SYSTEM AND METHOD FOR KILLING AIRBORNE INFECTIOUS BACTERIA, VIRUSES AND OTHER PATHOGENS

CROSS REFERENCE TO RELATED APPLICATIONS

Not Applicable

STATEMENT REGARDING FEDERALLY SPONSORED RESEARCH OR DEVELOPMENT

Not Applicable

INCORPORATION-BY-REFERENCE OF MATERIAL SUBMITTED ON COMPACT DISC

Not Applicable

BACKGROUND OF THE INVENTION

1. Field of the Invention

The present invention relates generally to a ventilation system and, more particularly, to a ventilation system that incorporates a systematic ventilation path and ultraviolet light that will kill airborne bacteria, viruses and pathogens that are harmful to humans and animals.

2. Background Art

Ventilation systems are used in commercial and residential buildings throughout the United States and the world to circulate air within a building as a means to control indoor air quality, heat and cool buildings and control humidity for human comfort. Ventilation systems help to ensure the air within a building is in constant motion to prevent air from collecting in one area of the building and becoming stale, developing an odor and possibly becoming harmful to humans and animals. Further, ventilation systems will help to clean the air by passing the air through filters to remove particles or pathogens, that may affect the respiratory systems of humans with allergies or cause other sicknesses, from the air prior to recirculating the air back into the building.

Ventilation systems may rely on a mechanical means to circulate the air within a building. That mechanical means may include a supply fan and an exhaust fan. The supply fan pulls air from one area of the building or even outside air into a building. The supply fan may also help to ensure that the air flow is passed through a series of filters to clean the air prior to the air being introduced to an area of the building. The exhaust fan may pull air from one area of a building and send the air to the outside atmosphere. The supply fans and exhaust fans cooperatively work together to maintain a comfortable air flow within a building to ensure comfort for humans and animals. The filters help to filter or clean many, but not all of the harmful particles and pathogens from the air prior to introducing the air into the living or working areas of the building.

While filters help to clean the air of harmful particles and pathogens, there are many harmful particles and pathogens that are too small for the filters to capture. Typical filters can capture particles and pathogens from the air ranging from greater than 10 micros to 0.3 microns in size. The filters that can capture the smallest particles and pathogens begin to limit air flow because the air must be forced through smaller and smaller openings in the filter. Thus, harmful particles and pathogens that are smaller than 0.3 microns, and even larger harmful particles and pathogens if a less efficient filter is used, continue to be recirculated within a building often times causing irritations to allergies or even sickness in humans and animals.

Furthermore, the blower in the HVAC system may not move the air contained in a building in a manner to sufficiently force particles and pathogens that are traveling in aerosols produced by an individual through breathing, talking, yelling, singing, coughing and/or sneezing out of the air intake path of other individuals. In fact, the set-up of present ventilation systems may aid the flow of particles and pathogens in aerosols produced by one individual into the air intake zone, the mouth, nose or eye area, of other individuals, thereby infecting the other individuals with what may be contained in the aerosol produced by the first individual.

The most recent threat to the respiratory systems of humans and animals has been the Severe Acute Respiratory Syndrome Coronavirus 2 (SARS-CoV-2) virus and subsequent Coronavirus Disease (COVID-19). One means of transmitting the SARS-CoV-2 virus is by exposing or passing infectious viral particles in aerosols or water droplets from one individual to other individuals within the same enclosed area. Examples or an enclosed area may be an indoor restaurant, a working manufacturing plant or a conference room in an office building. A single infected individual may transmit the infectious viral particles to other healthy individuals through breathing, talking, yelling, singing, coughing and/or sneezing within the enclosed area. The healthy individuals merely need to have their mouth, nose or eyes in the pathway of the cloud or aerosol of infectious viral particles contained in water droplets produced by the infected individual.

As stated above, the infectious viral particles may be released into the environment by a single infected individual through breathing, talking, yelling, singing, coughing and/or sneezing within the enclosed area. However, the different aspects of expelling the viral particles may be done so in drastically different amounts of the viral particles and at varying speeds of expulsion. A single sneeze releases about 30,000 droplets that may contain the infectious viral particles at about 200 miles per hour. A SARS-CoV-2 virus cloud created by the single sneeze may move about 20 inches in 0.3 seconds. After the initial virus cloud is created by the single sneeze, the cloud will move at the speed of the air flow in the room. If there is little to no air flow in the room, the virus cloud will grow in size and remain infectious for hours. Many droplets are small and may travel great distances, easily across and filling an enclosed room in a few minutes.

A single cough releases about 3,000 droplets that may contain the infectious viral particles at about 50 miles per hour. A SARS-CoV-2 virus cloud created by the single cough may move about 20 inches in 0.3 seconds. After the initial virus cloud is created by the single cough, the cloud will move at the speed of the air flow in the room (see FIGS. 1A-1F for an illustration on how the infectious cloud of viral particles may move across a room while expanding exposing several individuals to the SARS-CoV-2 virus). If there is little to no air flow in the room, the virus cloud will grow in size and remain infectious for hours. Many droplets are large and fall quickly to the ground under the force of gravity, but many do stay in the air and may travel across an enclosed room in a few minutes.

A single breath releases 50 to 5000 droplets that may contain the infectious viral particles, but they are expelled at a very low velocity and fall to the ground quickly under the force of gravity. Unlike sneezing and coughing which release a large amount of viral material due to the exhalation force of a sneeze or cough, breathing droplets will contain less of the viral material due to a lower exhalation force. Talking increases the release of droplets about ten-fold and singing even more. There is a large amount of infectious viral material that can be introduced into an enclosed area through normal human actions that can easily fill an enclosed area. Traditional building ventilation systems with typical filtering capability merely help to fill an enclosed area with the infectious viral particles faster and may increase the chances of other individuals contracting the infection and causing the exponential spread of the SARS-CoV-2 virus.

To date, means have been developed to interrupt the path of the aerosol of infectious viral particles. Many stores and places of business that deal with the public on a daily basis have installed a plexiglass barrier to prevent any infectious viral particles from passing from an infected person to the individual on the other side of the plexiglass barrier. The plexiglass barrier stops the path of the infectious viral particles from reaching the individual behind the barrier. As the infectious person stands in front of the plexiglass barrier for several minutes, the individual could be creating a large cloud of infectious viral particles though breathing, talking, yelling, singing, coughing and/or sneezing within the enclosed area. As the next person in line moves forward, they will move into the cloud of infectious viral particles and increase their chances of becoming infected. The cloud of viral particles may remain infectious for several hours. If there is little to no air flow to move the cloud, the cloud of infectious viral particles may remain to infect several individuals as they move through the cloud. Further, while the plexiglass barrier stands in the path of the infectious viral particles, the viral particles have been deposited onto the surface of the plexiglass barrier. The plexiglass barrier requires a thorough cleaning with cleaners and disinfectants to adequately kill the virus. Still further, there is nothing to prevent other individuals in line from the pathway of the viral particles or touching the plexiglass surface and then their own mouth, nose or eyes and contracting the infection.

Masks and shields are other means to slow the transmission of the infectious viral particles from person to person. Masks covering the mouth and nose area are an effective means to prevent transmission of the viral particles by mouth or nose, but the mask does not cover the eyes. Shields adequately cover the eyes, nose and mouth, but may not be practical for everyday use. Further, all individuals may not be wearing masks or shields and even if they are being worn, they may not be worn correctly or people may continue to touch their eyes, mouth or nose with hands and fingers that may be infected with the infectious viral particles while adjusting the mask or shield. There have been several reports that a community choir group sang for 2.5 hours in a hall roughly the size of a volley ball court. The participants avoided the usual personal contact (handshakes, hugs, etc.) and they brought their own music to avoid sharing. The participants also social distanced themselves during practice. A single asymptomatic carrier infected 45 of the 60 choir members and two dies. Some of the participants that were infected were approximately 50 feet from the infected person.

Many are practicing social distancing by maintaining a distance of six feet from one another and limiting the number of individuals in an enclosed room. But, as described above, a single infected person may fill a room or even infect a socially distanced person with infectious viral material with a single sneeze.

Others may be shutting down their ventilation systems to limit the flow of aerosols of infectious viral particles in an enclosed room and even opening windows to allow fresh outside air into an enclosed room to dilute the cloud of infectious viral material. However, as the weather changes and heating and air conditioning is required for the comfort of the individuals in the enclosed room, ventilation system will have to be reactivated and windows closed.

Many of the above actions are being put in place in an effort to open restaurants, business and schools. However, as stated above, there are many drawbacks to these efforts to protect individuals from coming into contact with SARS-CoV-2 virus. If one examines the individual protections being proposed for schools as an example, one will quickly determine that the protections have serious drawbacks. All students and faculty will be required to wear masks or face coverings of some type as well as maintain social distancing at the requisite distance. There are several issues with this proposal. First, wearing a mask may greatly interfere with communication between the teacher and students and between the students themselves. If the communication between teacher and students is impacted negatively, both teach and students will become frustrated to a point where learning will be impacted negatively. Even worse, a teacher may remove their mask to communicate better with the students. An unmasked infected teacher may become a super spreader of the disease. An infected teacher speaking loudly for several hours may fill a classroom with many clouds of infectious viral particles in little time. Students wearing masks will still be subject to the infectious viral material contained in the room. Infectious viral particles smaller than 5 microns will pass through any mask that is not N95 certified. Even if N95 masks are required by schools, the exterior surface of the mask or any type of face covering will be contaminated with infectious viral particles. Students may touch the exterior surface when removing the mask (at the end of the day, eating lunch, etc.) or adjusting the mask with their fingers and then touch their eyes, nose or mouth thereby subjecting themselves to potential infection. Further, the cost of replacing the mask every few days is expensive and still further, there may be a shortage of masks to provide to school children and others working in a public business. Prolonged mask usage may cause hypercapnia, a condition arising from too much carbon dioxide in the blood. Symptoms of hypercapnia include dizziness, drowsiness, fatigue, headaches, felling disorientated, flushing of the skin, shortness of breath, increased heart rate and increased blood pressure (N95 masks reduce oxygen intake by approximately 5% to 20%). If one were to wear a mask long enough, it may damage the lungs. For a patient in respiratory distress, wearing a mask for a prolonged period of time may be life threatening. Students wearing face shields may alleviate the breathing issues of wearing a mask, but many of the issues discussed above, will not be improved.

Students and teachers will practice social distancing. A typical desk in a classroom is approximately two feet from a neighboring desk. This allows for a classroom to house approximately 30-35 desks depending on the size of the classroom. Social distancing dictates that there must be at least six feet between individuals. With that requirement, the number of desks and, therefore, students will be reduced to approximately 8-9 in the classroom. The other 22-26 students will have to be relocated into at least three other classrooms thereby requiring more classrooms and teachers.

Another proposal to keep students and faculty safe from the transmission of the SARS-CoV-2 virus is to add transparent plastic or plexiglass barriers between teacher and students and between students. The plastic barriers may greatly interfere with communication between the teacher and students and between the students themselves. If the communication between teacher and students is impacted negatively, both teach and students will become frustrated to a point where learning will be impacted negatively. Further, it will be difficult to move around the classroom for the teacher and the students especially if they all had to exit the classroom quickly due to an emergency. The plastic barriers would be a costly solution and the space required to position the barriers between desks within the classroom would reduce the number of desks and students in the room. As discussed above the plastic barriers may become contaminated with infectious viral particles and would require daily cleaning to remove any particles. Students and teachers may still face the possibility of infection either by existing infectious clouds of viral particles that are in the room or the viral particles present on the plastic barriers.

Still another proposal is to transform a traditional classroom into a clean room much like that of a hospital operating room. A drop ceiling may be installed in each class room with the ceiling including a plurality of high-efficiency particulate absorbing (HEPA) filters to trap the SARS-CoV-2 virus particles. Clean air may be forced downward from the ceiling driving any infectious viral particles out of the ingestion zone of students' mouth, nose and eyes and downward to the floor. The air and infectious viral particles at the floor may be forced to the walls of the clean room and sent through the gap between the walls of the clean room and the classroom back to the drop ceiling and the HEPA filters to filter out the infectious viral particles and return clean air to the room. There are several drawbacks with this proposal. The size of the clean room would still limit the number of desks and therefore students in the room. Creating a clean room will be costly and HEPA filters must be changed on a regular basis which may also be quite expensive. Further, there is a risk that those changing the filters may become infected just by handling the filters and infectious viral particles. Lastly, a continual source of HEPA filters would have to be developed to accommodate all schools and business and it may take several years to outfit and construct clean rooms for all schools and businesses.

Therefore, a need exists for an inexpensive and practical ventilation system capable of driving particles and pathogens that are traveling in aerosols produced by an individual through breathing talking, yelling, singing, coughing and/or sneezing out of the air intake pathway of other individuals in the same enclosed area or building of the infected individual. A need also exists for eliminating and killing harmful viruses and pathogens from the air that passes though the ventilation and filter system of an enclosed room or building.

BRIEF SUMMARY OF THE INVENTION

A ventilation system is provided, the ventilation system comprising at least one air flow generating device, the at least one air flow generating device having a calibrated speed to produce a downward air flow capable of forcing a cloud of infectious bacterial, viral or pathogen particles or droplets out of an ingestion zone of a mouth, a nose and eyes of an individual, at least one ultraviolet C light lamp positioned proximate at least one wall of an area in a pathway of an infected air flow, the infected air flow containing the cloud of infectious bacterial, viral or pathogen particles or droplets, an ultraviolet C radiation field created by the at least one ultraviolet C light lamp, the ultraviolet C radiation field extending throughout the area from the at least one wall near a ceiling of the area and the infected air flow containing the cloud of infectious bacterial, viral or pathogen particles or droplets passing through the ultraviolet C radiation field, wherein the at least one air flow generating device is positioned to enable an upward air flow return to the at least one air flow generating device to force the infected air flow and the cloud of infectious bacterial, viral or pathogen particles or droplets out of an area and through the ultraviolet C radiation field to eradicate the infectious bacteria, virus and pathogens from the infected air flow, and wherein a fresh air flow free of infectious bacteria, viruses and pathogens is reintroduced back into the area by the downward air flow of the at least one air flow generating device.

BRIEF DESCRIPTION OF THE SEVERAL VIEWS OF THE DRAWINGS

The features and inventive aspects of the present invention will become more apparent from the following detailed description, claims, and drawings, of which the following is a brief description:

DETAILED DESCRIPTION OF THE INVENTION

Figure 1A:
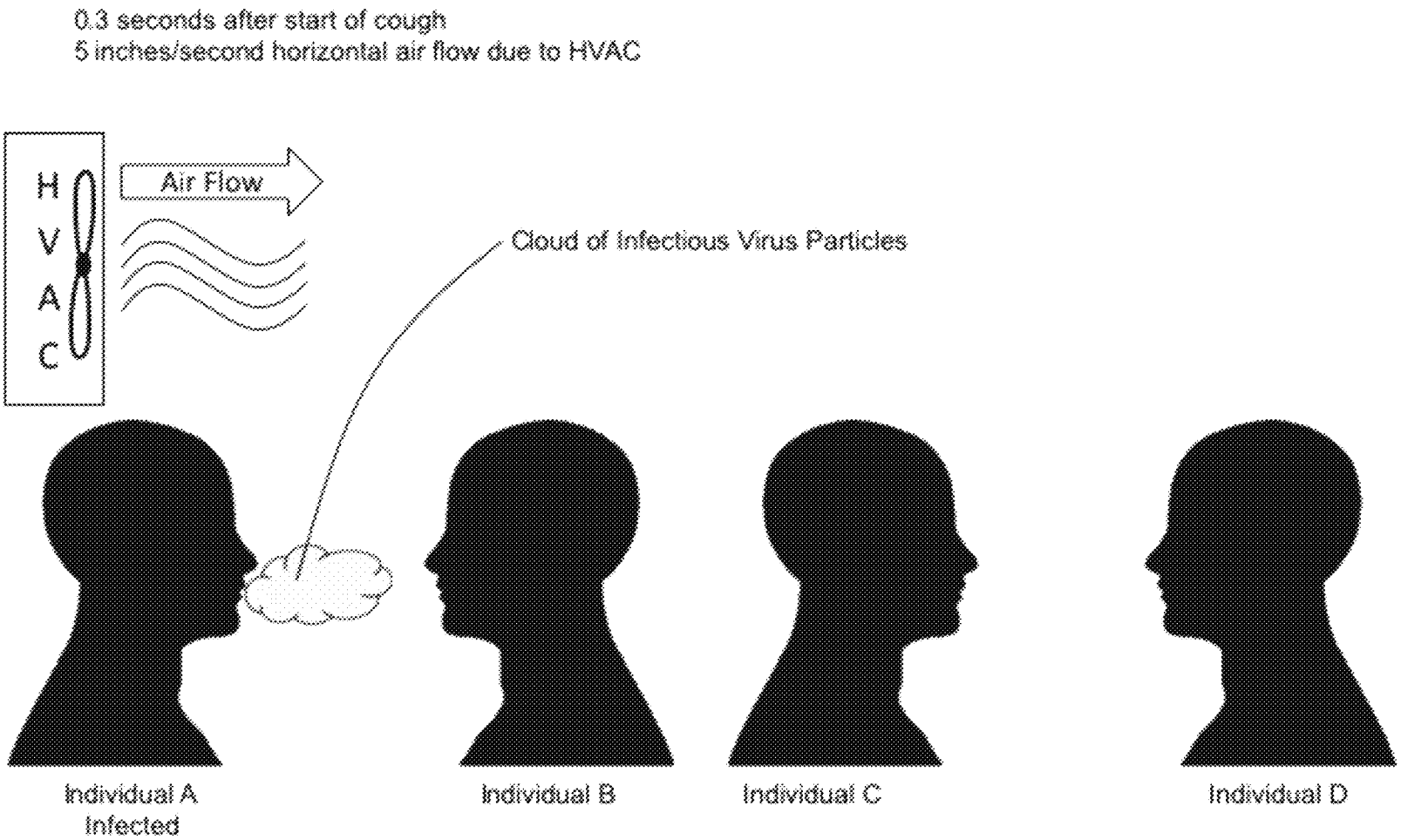
FIGS. 1A-1F are side views illustrating how a cloud of infectious viral particles may pass from an infected individual to expose subsequent individuals in a typical room under the operation of a typical heating, ventilation and air conditioning (HVAC) system with a horizontal air flow.
Figure 1B:
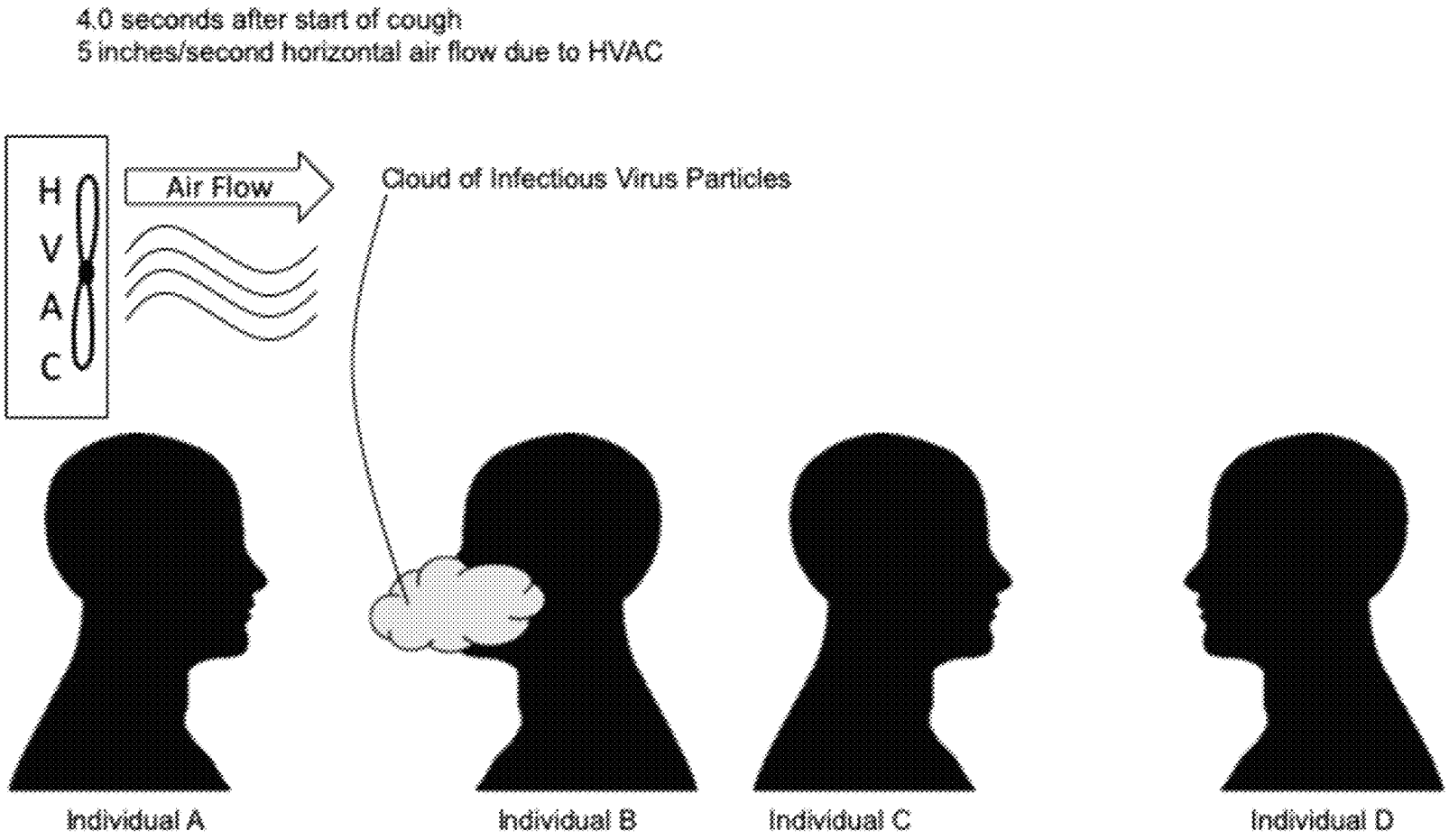
Figure 1C:
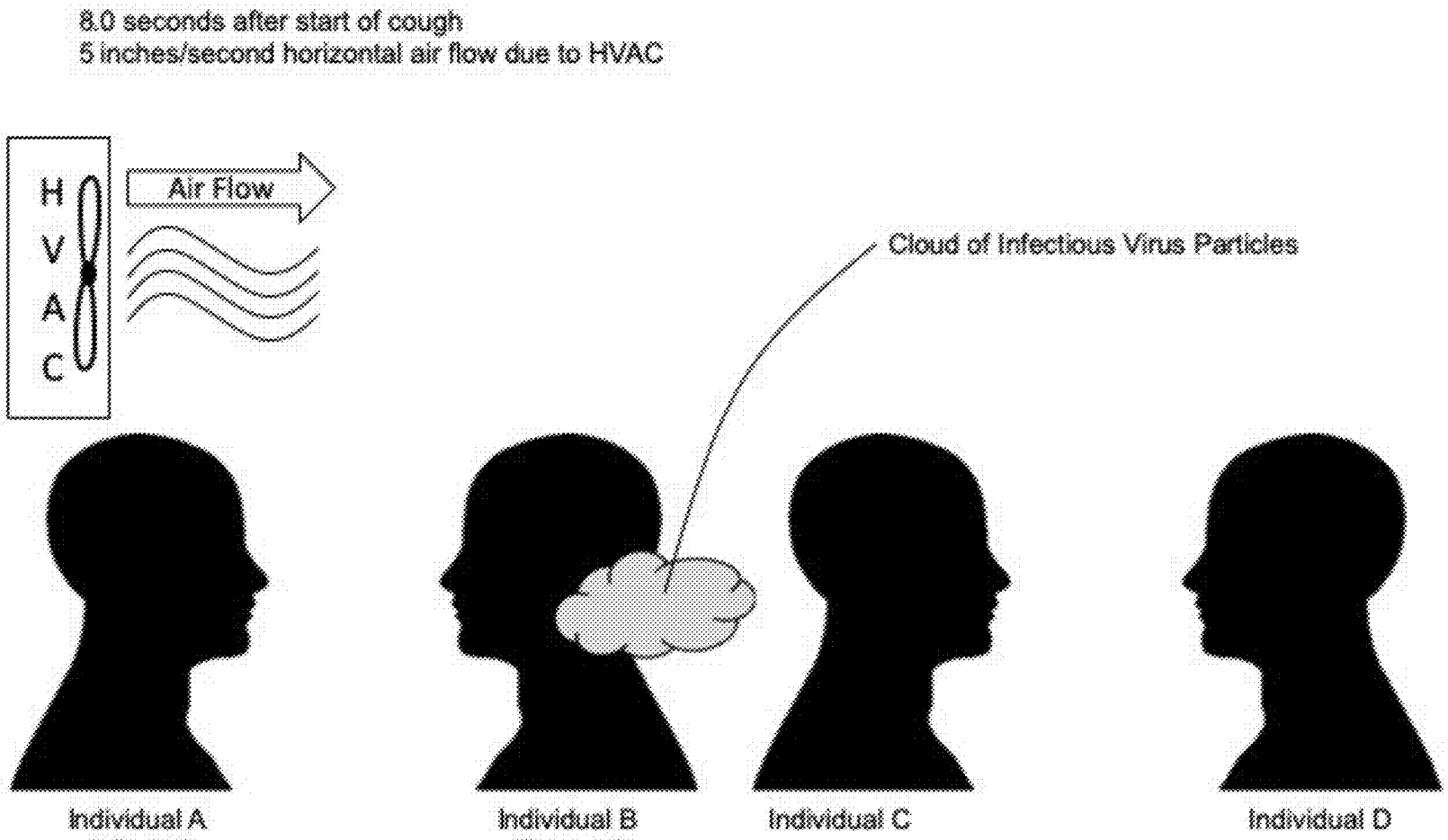
Figure 1D:
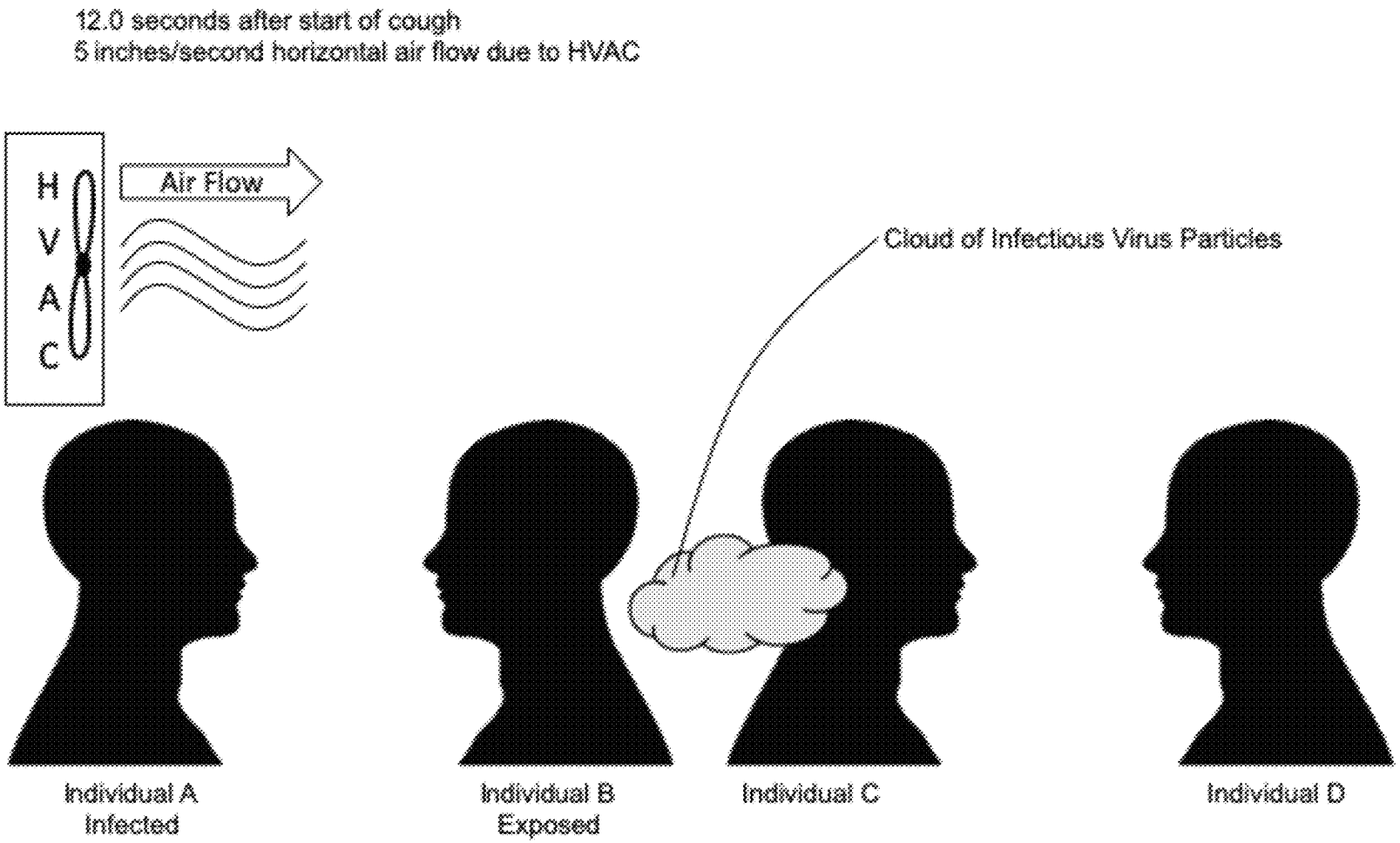
Figure 1E:
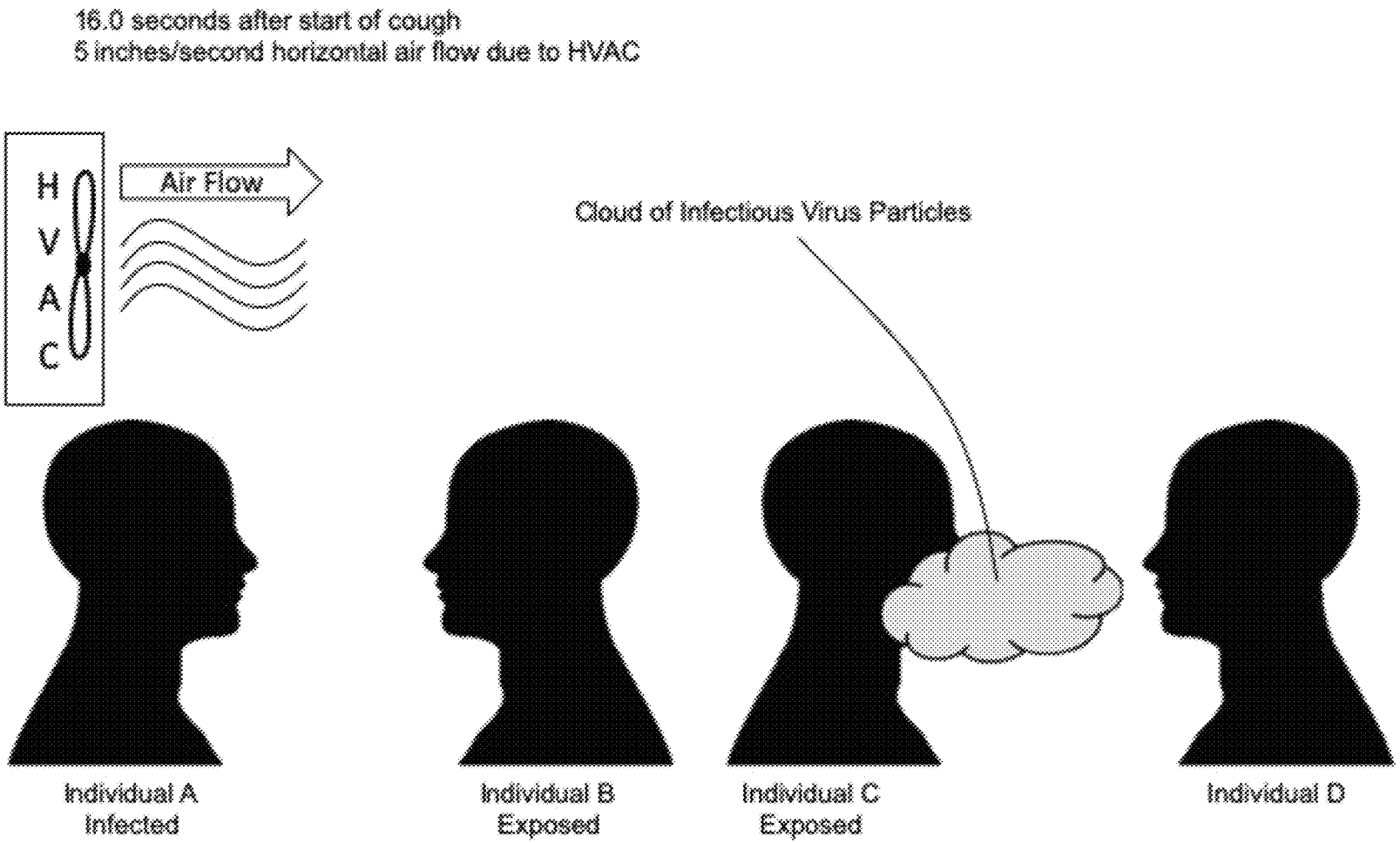
Figure 1F:
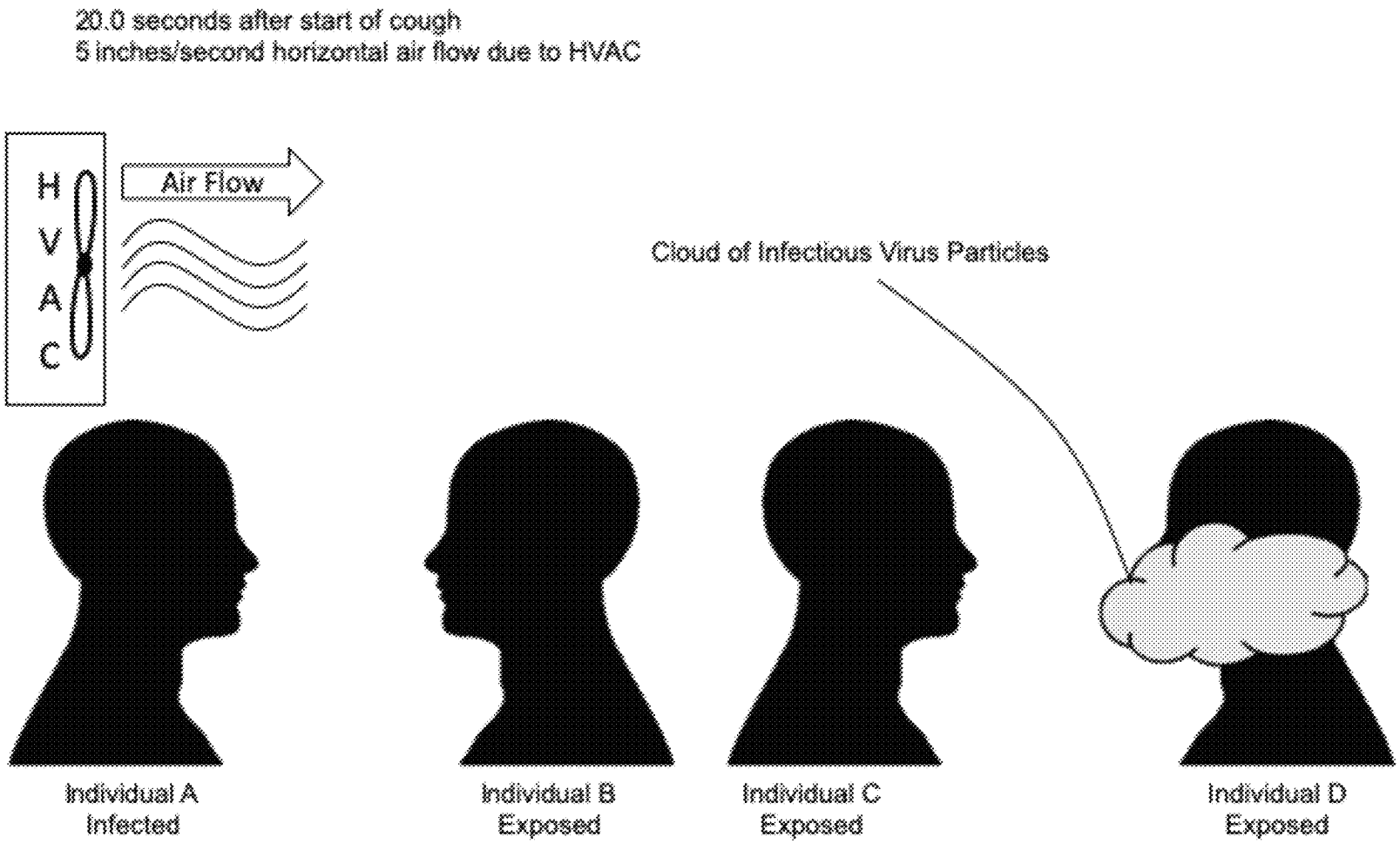

Referring now to the drawings, preferred illustrative embodiments of the present invention are shown in detail. Although the drawings represent embodiments of the present invention, the drawings are not necessarily to scale and certain features may be exaggerated to better illustrate and explain the present invention. Further, the embodiments set forth herein are not intended to be exhaustive or otherwise to limit or restrict the invention to the precise forms and configurations shown in the drawings and disclosed in the following detailed description.

The wearing of masks, other face coverings and shields as well as the use of plexiglass barriers and social distancing all work to limit the transmission of infections and viruses such as influenza and SARS-CoV-2, however, these tools will not kill and eliminate the infectious particles and pathogens. The present invention provides a ventilation system 10 that will force a cloud 12 of infectious viral material and pathogens, such as a cloud of infectious influenza or water droplets of SARS-CoV-2 particles, out of the ingestion zone of the mouth, nose or eye area of an individual (see FIGS. 17A-17E; 18A-18D and 19A-19F). Ventilation system 10 will force existing room air and cloud 12 downward to a floor 14 of a building and to walls 16 or intake zone (see intake zone at B on FIGS. 8 and 9). At walls 16 and intake zone B, ventilation system 12 will intake the room air and cloud 12 and force the room air and cloud 12 up walls 16 and intake zone B to a ceiling 18. During the intake process, room air and cloud 10 will pass through means to disinfect the air, thereby killing and eliminating cloud 12 of infectious viral material prior to the release of fresh air, free of any infectious viral material, back into the room.

According to an embodiment of the present invention, ventilation system 10 includes a plurality of air flow generating devices 20 positioned at or near ceiling 18 of an enclosed room or area of a facility or building as illustrated in FIGS. 2-9. It is important to note, however, the ventilation system 10 may also be used in an outdoor venue the may have a roof and ceiling to support ventilation system 10, such as a covered outdoor bar or restaurant, a pavilion, a baseball stadium dugout (may be an indoor or outdoor stadium) and the like. Air flow generating devices 20 may be positioned at or near ceiling 18 such that the air flow being produced by air flow generating devices 20 will be directed downward in a generally vertical direction to floor 14. Air flow generating devices 20 may include but are not limited to ceiling fans, fans within ducts, blowers and the like. Air flow generating devices 20 will impart a downward air velocity of 5 to 100 inches per second depending on the rotational speed of air flow generating devices 20. At this velocity of 5 to 100 inches per second, the air flow from air flow generating devices 20 will force cloud 12 downward to the floor before cloud 12 of infectious viral material has a chance to enter the ingestion zone of the mouth, nose and eyes of the individual.

Although an individual may have been exposed to cloud 12 of infectious viral particles, they still not may be infected with influenza or COVID-19. Along with exposure, an individual must also be exposed to the cloud of infectious viral material for a period of time prior to infection becoming present in the individual. Infection is equal to exposure to the infectious viral particles plus a period of exposure time. The amount of exposure time may depend on a number of factors as to whether a person will become infected with influenza, COVID-19 or a myriad of other infections of viruses. Those factors may include the number of infectious viral particles present in the cloud, the distance from the source of the cloud of infectious viral particles, the susceptibility to the infection of the individual and the amount of time the individual spends intaking the infectious viral particles. The present invention will limit the amount of time a particular individual is in contact with the cloud of infectious viral particles. Even if an individual comes into contact with a cloud of infectious viral material, the vertical air flow provided by air flow generating devices 20 will quickly force cloud 12 out of the ingestion zone of the mouth, nose and eyes of the individual, thereby limiting the exposure time to cloud 12 of infectious viral particles.

The Environmental Protection Agency (EPA) recommends a rate of 0.35 air changes per hour (ACH) (about one-third of the air in a typical home being replaced every hour or three hours for a full air change) for health indoor air quality. The average home does have a much higher rate of natural air infiltration than this. A ceiling fan, such as air flow generating device 20, produces an air exchange rate of approximately one air exchange every twenty seconds for air moving at a velocity of 30 inches per second traveling a total distance of 50 feet in a room size of 30 feet by 30 feet by 10 feet. A ceiling fan produces approximately 540 air exchanges for every one air exchange created by a typical heating, ventilation and air conditioning (HVAC) system.

Ventilation system 10 will also include a plurality of ultraviolet C light lamps 22 as the means to disinfect the air by killing and eliminating the infectious viral particles from the air in the room. Ultraviolet C light is most generally referred to as germicidal ultraviolet light capable of killing bacteria, viruses, germs mold and fungus. Ultraviolet C light is a form of electromagnetic radiation with a wavelength from 100 nanometers to 280 nanometers and is invisible to most humans. Ultraviolet C light targets DNA and RNA, the genetic material that makes up all living organisms, controlling growth, development, function and reproduction, of microbes. The electromagnetic radiation produced by ultraviolet C light can destroy the ability of microorganisms to reproduce by causing photo-chemical reactions in nucleic acids. Ultraviolet C light triggers the formation of specific thymine and cytosine dimmers in DNA and uracil dimmers in RNA, which cause inactivation of microbes by causing mutations and/or cell death and failure to reproduce. Products using ultraviolet C light lamps tout pathogen kill rates higher than a 99.9% rate. Ultraviolet C light helps stop the spread of numerous pathogens including, influenza 1, 2, 3, 4, 5, 7 and 9, the cold, the superbug, SARS-CoV-2 and others such as ADENO virus type III, bacteriophage 1, 3, 4, 5, 6 and 9, coxsackie and infectious hepatitis 1, 5, 7 and 8. For a ceiling fan producing approximately 540 air exchanges for every one air exchange created by a typical HVAC system, any pathogens in the air in the room will pass through ultraviolet C light radiation about 540 times meaning there is an extremely high probability the pathogens are dead by the time they are removed by the HVAC system. Further, the chance of spreading live pathogens from one room to another may be eliminated.

Ultraviolet C lamps 22 may be positioned at or near ceiling 18 as depicted in FIGS. 2-7. Radiation provided by ultraviolet lamps has the ability to kill any kind of bacteria or virus. The SARS-CoV-2 particles are approximately 0.1 microns in size making it highly susceptible to radiation provided by ultraviolet C lamp lighting. A considerable dose of ultraviolet C radiation is required to kill the SARS-CoV-2 virus as well as other bacteria and viruses. The principle of ultraviolet C light sterilization is related to the intensity of the ultraviolet C lamp used. The more powerful the ultraviolet C lamp, the more likely the ultraviolet C radiation will kill and eliminate reproduction of the bacteria and virus. The longer the bacteria and virus is exposed to the ultraviolet C lamp and, therefore, the radiation from the lamp, the better chance of killing the bacteria and virus. The germs that make up the bacteria and virus need time and distance to absorb the radiation from the ultraviolet C light. Longer ultraviolet C lamp and slower moving air next to the ultraviolet C lamps will accomplish this task. A typical ultraviolet C lamp may provide 110 microwatts of power. In a ventilation system flowing 2400 cubic feet per minute, the germ kill rate is approximately 70% to 80%.

Figure 2:
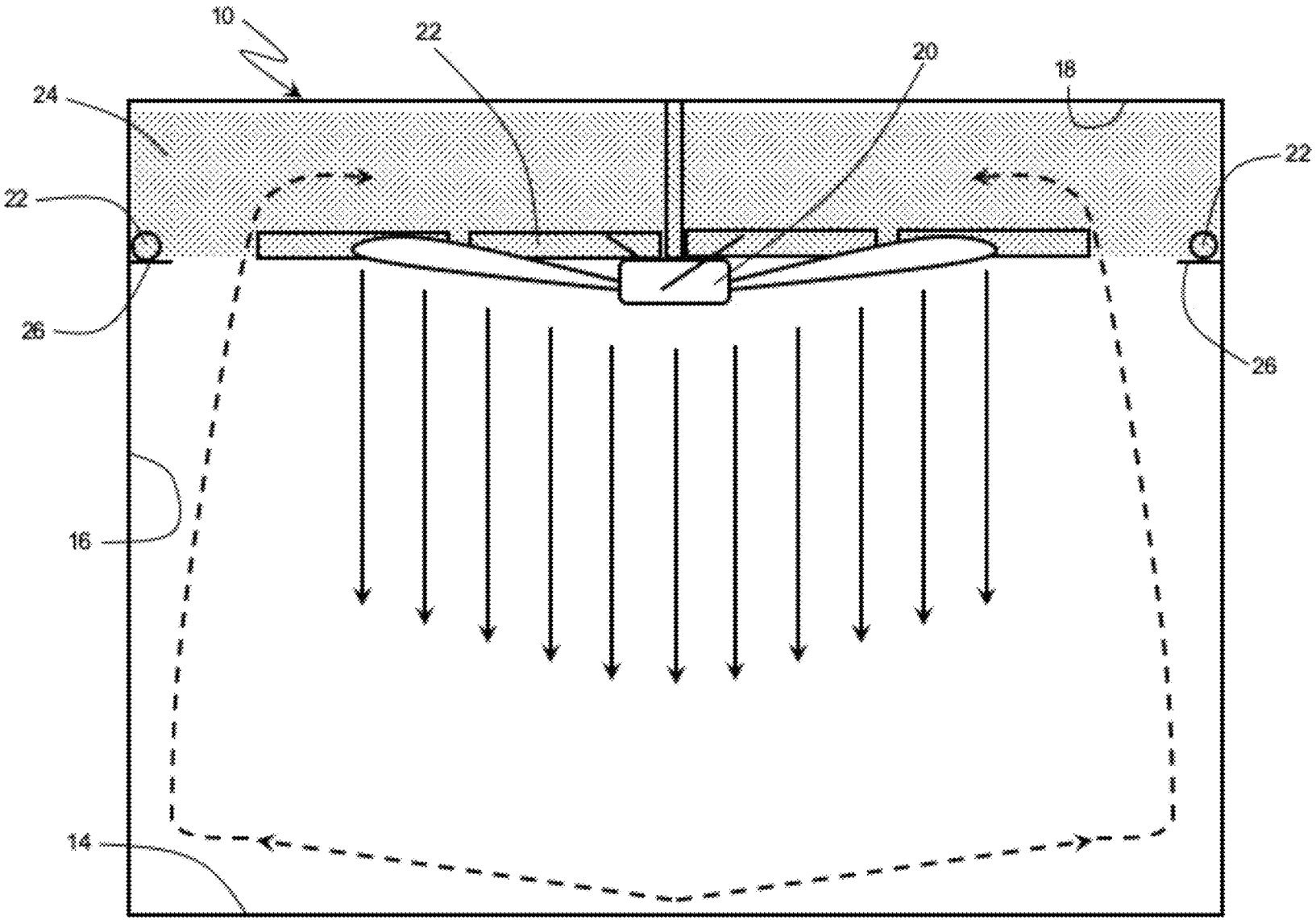
FIG. 2 is side view of a ventilation system according to an embodiment of the present invention.
Figure 3:
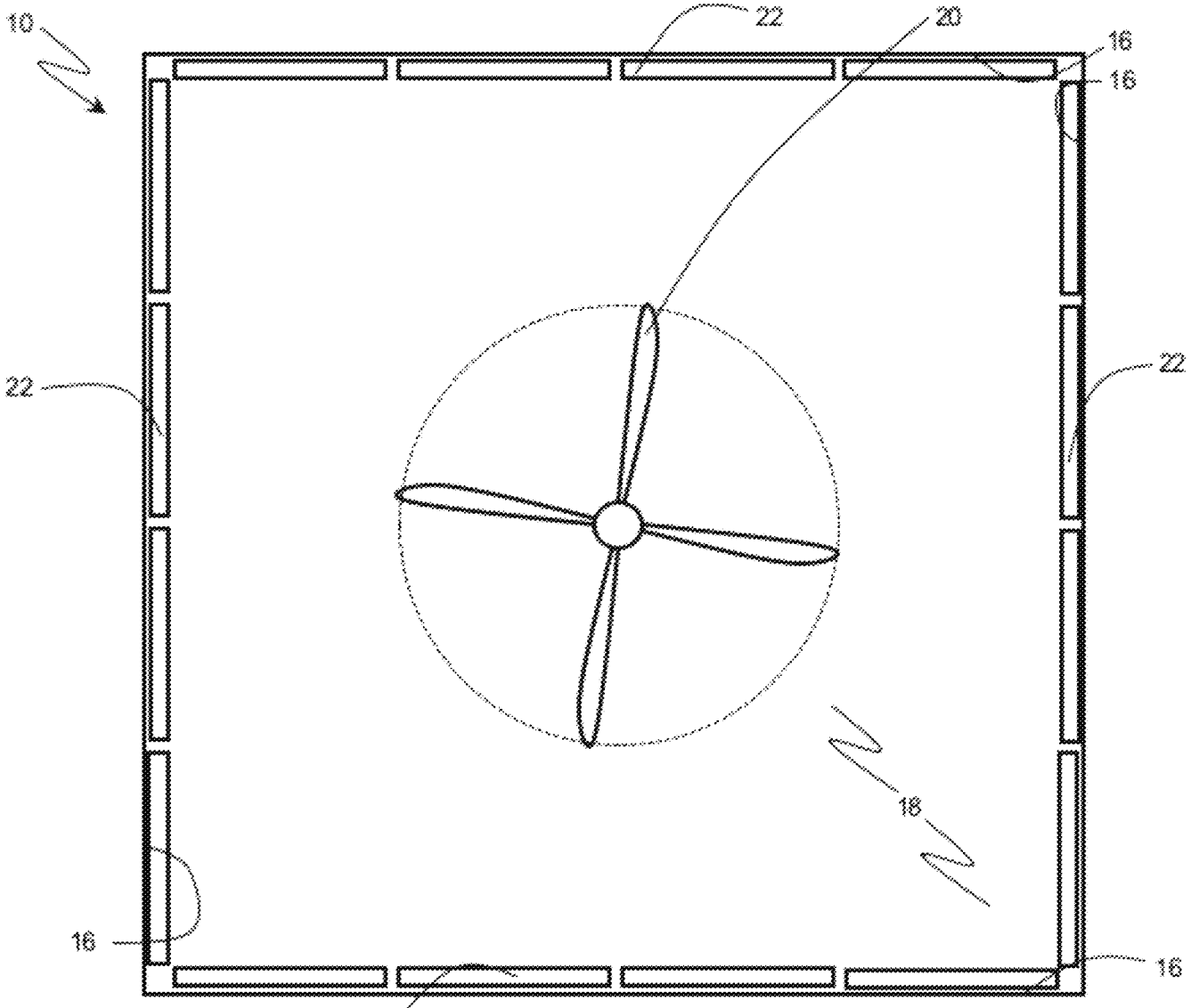
FIG. 3 is a plan view of a ceiling illustrating the ventilation system according to the embodiment of the present invention.
Figure 4:
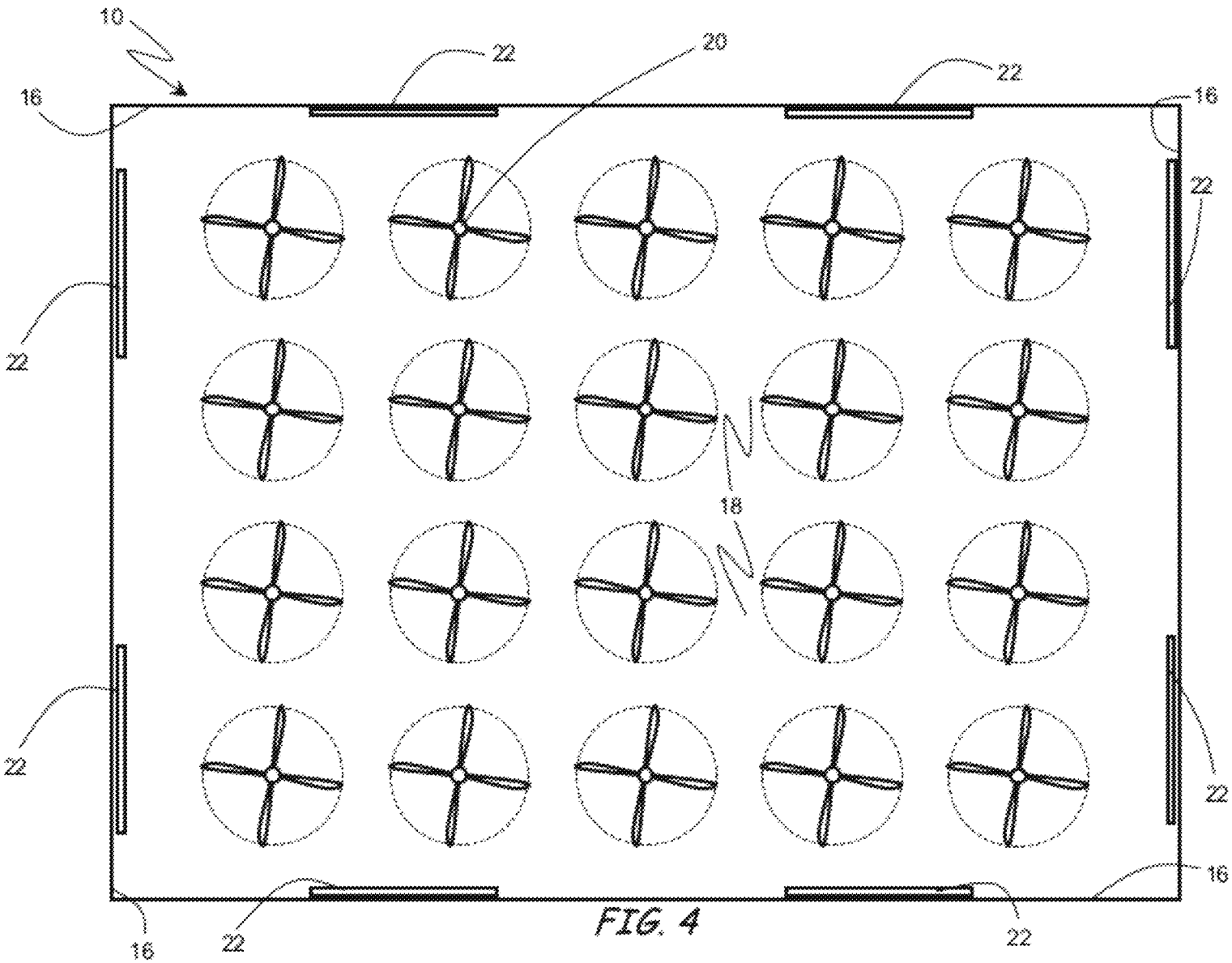
FIG. 4 is a plan view of the ceiling illustrating the ventilation system depicting a plurality of air flow generating devices and ultraviolet light sources in a first indoor facility according to the embodiment of the present invention.
Figure 5:
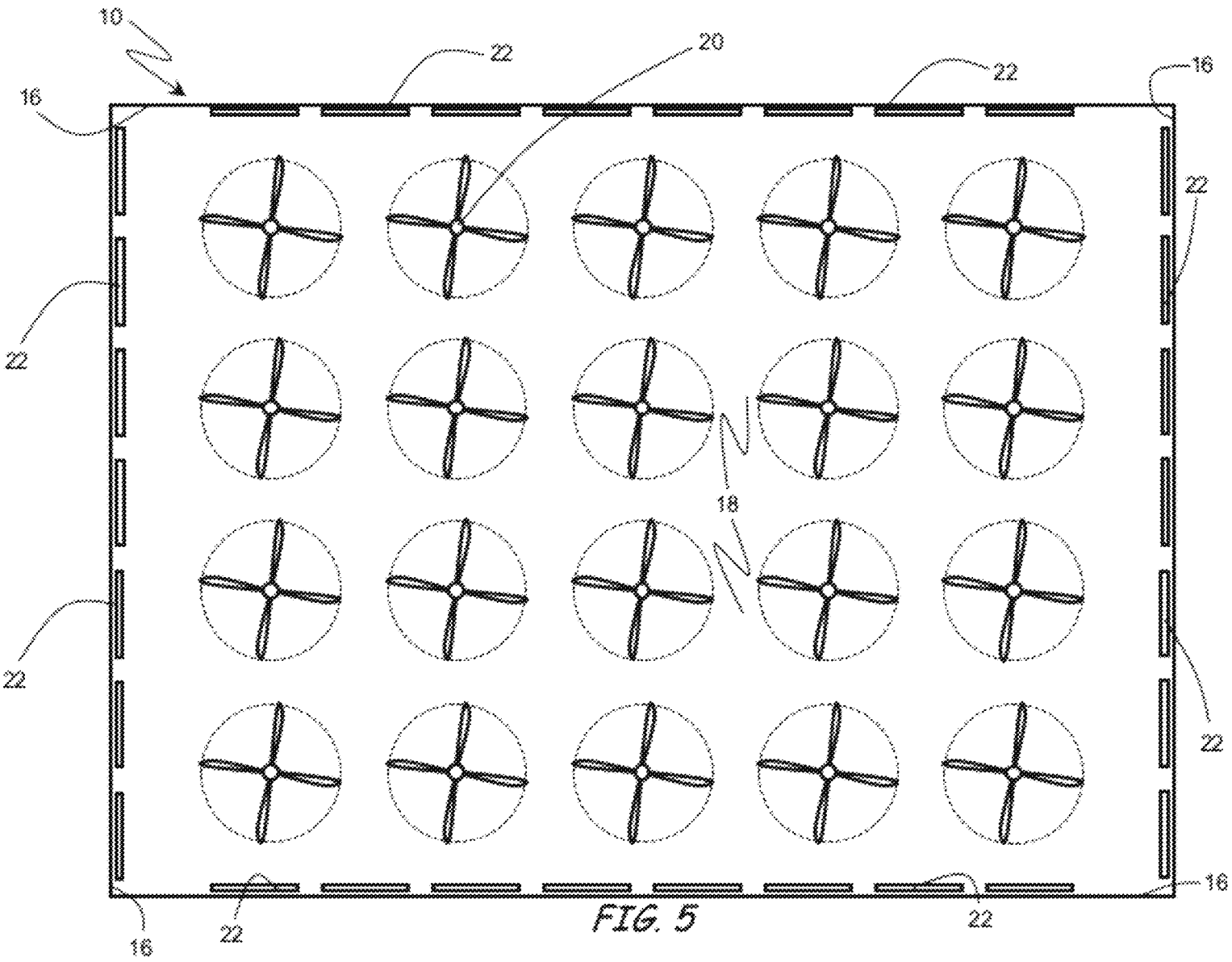
FIG. 5 is a plan view of the ceiling illustrating the ventilation system depicting a plurality of air flow generating devices and ultraviolet light sources in a second indoor facility, larger than the first indoor facility, according to the embodiment of the present invention.
Figure 6:
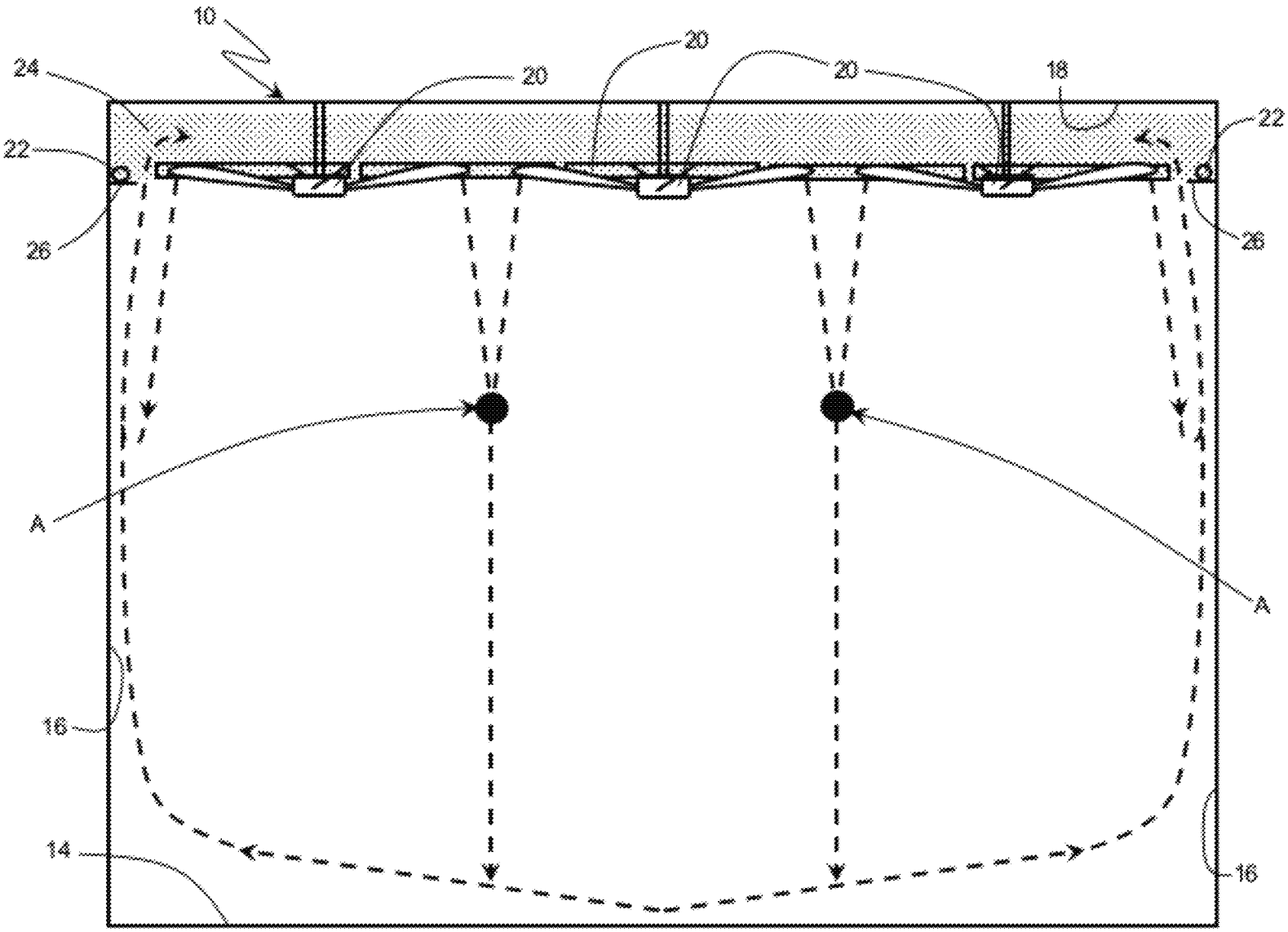
FIG. 6 is side view of a ventilation system depicting the intersection of the downward airflow from a plurality of air flow generating devices and upward airflow at the walls according to the embodiment of the present invention.
Figure 7:
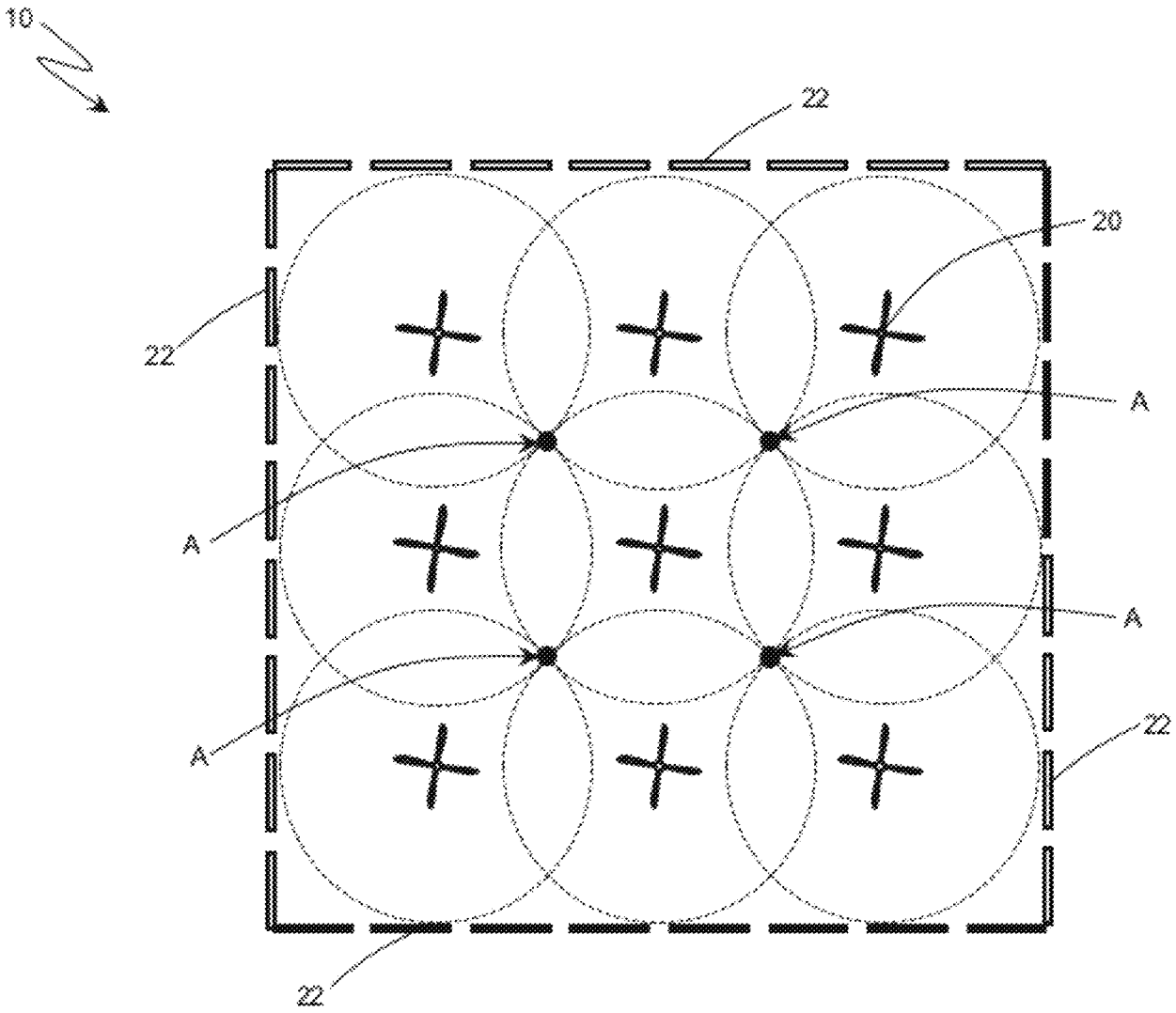
FIG. 7 is a plan view of a ceiling illustrating the ventilation system depicting the intersection of the downward airflow from a plurality of air flow generating devices according to the embodiment of the present invention.

FIGS. 2 and 6 illustrate ultraviolet C lamps 22 positioned at or near ceiling 18. Lamps 22 are provided with an ultraviolet C light shield 26 to protect humans and animals from the harmful effects of ultraviolet C radiation. A plurality of lamps 22 create an ultraviolet C radiation field 24 that cloud 12 of infectious viral particles will pass through prior to being recirculated back through fans 20 and into the room.

As stated above, a plurality of air flow generating devices 20 may be positioned on or at the ceiling such that a constant generally vertical air flow is directed downward to the floor. FIGS. 2-7 illustrate ventilation system 10 having a plurality of ceiling fans 20 that work to move all air flow in a particular room downward to the flow. The embodiment of the present invention illustrated in FIGS. 2-7 will be described with a ceiling fan as air flow generating device 20, but is important to note that any type of fan, blower or other type of air generating device may be used to produce the downward air flow. The positioning of ceiling fans 20 depicted in FIGS. 6 and 7 result in air flow generated by ceiling fans 20 being directed to floor 14 and outward to walls 16. The air flow from one fan will interact with the air flow from neighboring fans to move the air under the fans down to flow 14. The crossover points of air flow produced by each fan and its neighboring fan is shown as point A in the drawings. This arrangement of ceiling fans 20 may work well in a typical room such as an office or school room. Depending on the size of the room, ceiling fans 20 having different sized blades may be used for proper coverage to ensure all air flow from the fans covers the entire room but for near the walls where the return air flow to the ceiling will occur.

Ceiling fans 20 will drive air flow and any infectious clouds 12 downward to floor 14 and out to walls 16. As the air flow reaches walls 16, the air flow will be outside of the general force of ceiling fans 20 driving the air flow downward. Air flow and any infectious clouds 12 at walls 16 will be drawn upward to ceiling 18 by the air flow pull from the backside of fans 20. As the air flow and any infectious clouds 12 reach ceiling 18, the air flow and clouds 12 will enter ultraviolet C field 24 produced by ultraviolet C light lamps 22. While the air flow and infectious clouds 12 are within field 24, the ultraviolet radiation will kill the bacteria, viruses and pathogens contained in infectious cloud 12 as fully described above. After passing through field 24, air flow will be free of any infectious clouds 12 and will be driven downward by fans 20 back toward floor 14 to repeat the process.

Figure 8:
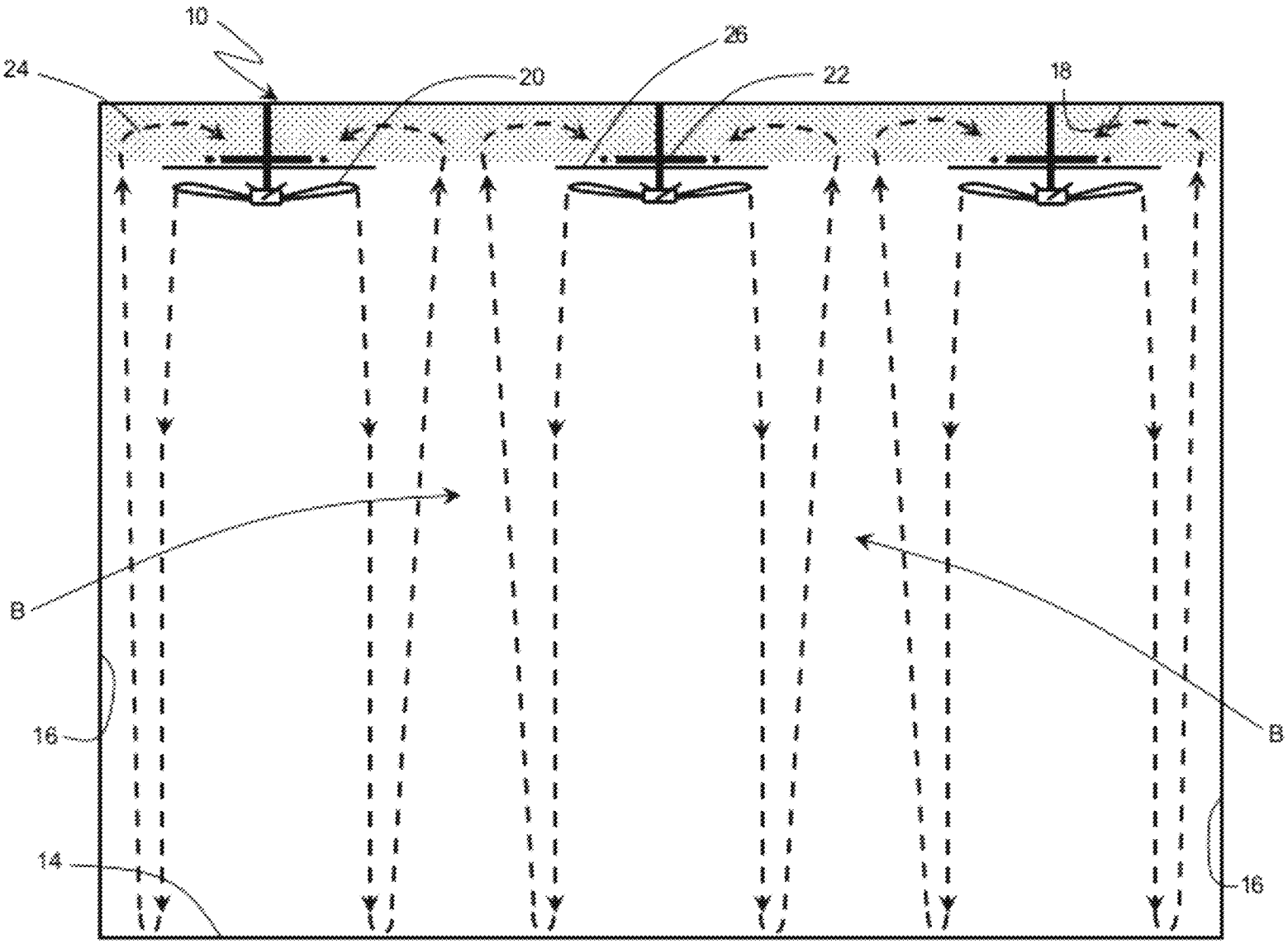
FIG. 8 is side view of the ventilation system depicting downward airflow from a plurality of air flow generating devices and upward airflow in between a plurality of air flow generating devices according to the embodiment of the present invention.
Figure 9:
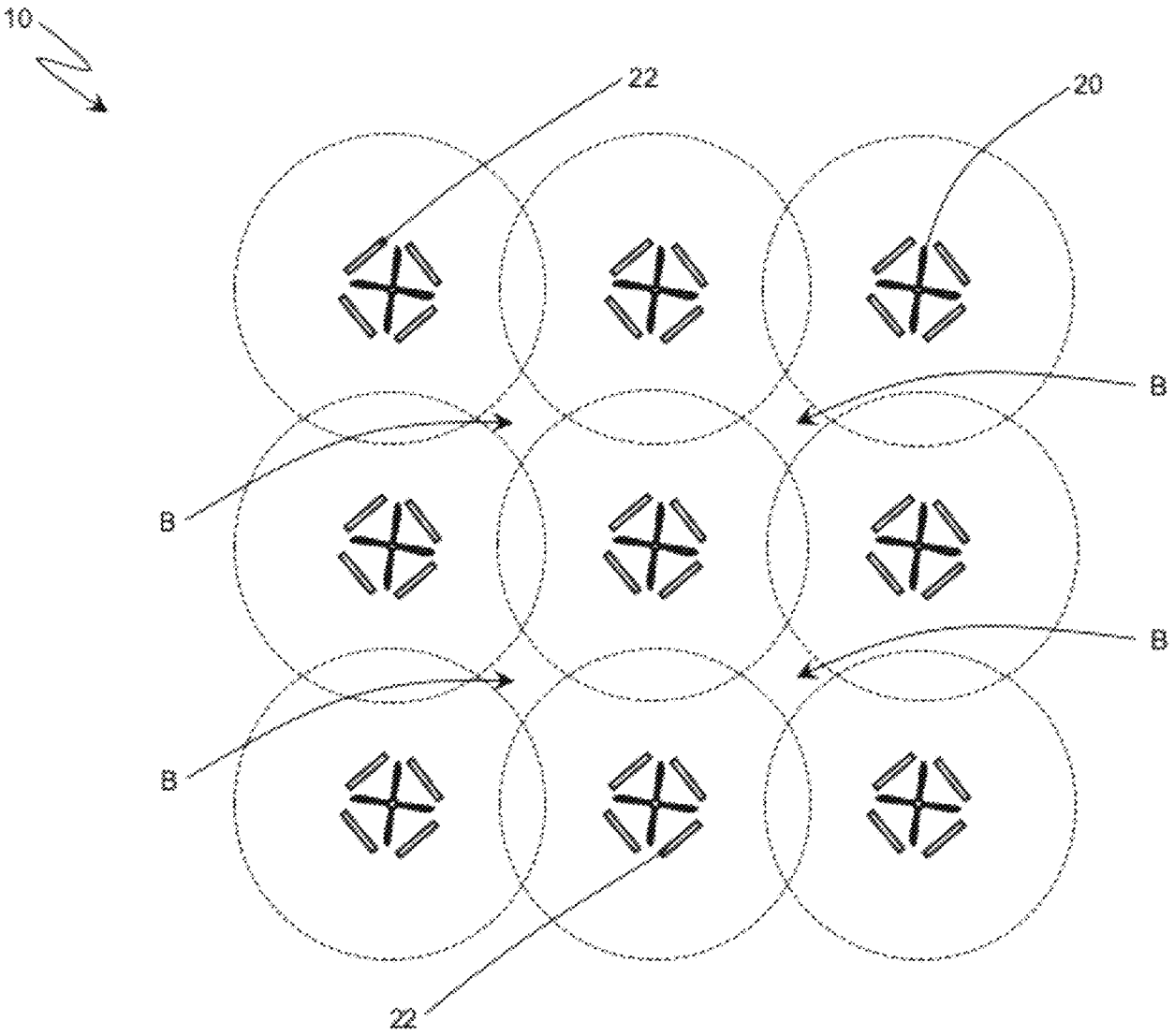
FIG. 9 is a plan view of a ceiling illustrating the ventilation system depicting downward airflow from a plurality of air flow generating devices and upward airflow in between a plurality of air flow generating devices according to the embodiment of the present invention.

The arrangement of air flow generating devices 20 depicted in FIGS. 8 and 9 may be configured for use in a larger indoor area say, for instance, in a manufacturing setting, indoor stadium, church building and the like according to another embodiment of the present invention. In this particular embodiment of the present invention illustrated in FIGS. 8-9 will be described with a ceiling fan as air flow generating device 20, but is important to note that any type of fan, blower or other type of air flow generating device may be used to produce the downward air flow. The floor of a manufacturing plant may be quite extensive and may not be economical to position ceiling fans to create enough air floor to force all air to the floor and out to the outer walls of the facility prior to returning to the ceiling. In this instance, ceiling fans 20 may be positioned relative to neighboring ceiling fans such that a strategic up-draft or intake zone is created at B. Ceiling fans 20 create a downward air flow as described above to move infectious cloud 12 out of the ingestion zone of the mouth, nose or eyes of an individual. Up-draft or intake zone B allows the air to be returned from floor 14 to ceiling 18 without having to travel to walls 16, which may be several feet from the fan. Including intake zone B enables cloud 12 to be moved upward to ceiling 18 and radiation zone 24. If intake zone B were not used, cloud 12 may linger at floor 14 or worse, find its way into the ingestion zone of the mouth, nose or eyes of an unsuspecting individual prior to entering the up-drafts at walls 16. Further, if the infected individual is in the downward air path of the fan and the second individual is in the upward air path of zone B, infectious cloud 12 may be carried upward by the up-draft in zone B prior to every reaching floor 14.

As the air flow and any infectious clouds 12 reach ceiling 18 either at walls 16 or intake zones B, the air flow and clouds 12 will enter ultraviolet C field 24 produced by ultraviolet C light lamps 22. While the air flow and infectious clouds 12 are within field 24, the ultraviolet radiation will kill the bacteria, viruses and pathogens contained in infectious cloud 12 as fully described above. After passing through field 24, air flow will be free of any infectious clouds 12 and will be driven downward by ceiling fans 20 back toward floor 14 to repeat the process.

FIGS. 8 and 9 also depict an alternative arrangement of ultraviolet C light lamps 22 according to another embodiment of the present invention. Because the plant floor of a manufacturing facility may be quite large and the ceiling well above the floor, it may be advantageous to position ultraviolet C light lamps 22 near ceiling fans 20 as shown in the drawing figures. An ultraviolet C radiation field 24 may extend across the ceiling area, but the lamps will be closest to the air returns at each of ceiling fans 20. This will help to ensure the most intense radiation for killing the viral particles of cloud 12 is closest to said particles. Shields 26 may still be added under the lamps to prevent harmful radiation from reaching humans and animals within the facility.

FIGS. 10-12B depict ventilation system 10 according to yet another embodiment of the present invention. In this particular embodiment, ventilation system 10 may be used in situations where individuals are working in close proximity to one another. Ventilation system 10 includes a plurality of nozzles 30 for precisely directing downward air flow to a specific area of a room. The downward air flow exiting nozzles 30 may be much higher than the downward air flow produced by a typical ceiling fan and can range in velocity from 40-200 inches/second to create an air curtain 32. The air flow will be produced by air flow generating devices 20 that may be positioned in duct 28. The smaller openings of nozzles 30 increases the downward air flow produced by air flow generating devices 20 due to the smaller opening the air travels through to create air curtain 32. In this particular embodiment of the present invention illustrated in FIGS. 10-12B may be described with a fan depicted in a duct as air flow generating device 20, but is important to note that any type of fan, blower or other type of air generating device may be used to produce the downward air flow. Fan may be also be a high-speed fan to generate sufficient air flow velocity to create air curtain 32.

As described above, air flow exiting nozzles 30 to create air curtain 32 result in a downward air flow generated by fans 20 being directed to floor 14 through nozzles 30 and outward to walls 16. This arrangement of fans 20 and nozzles 30 to create air curtains 32 may work well in a manufacturing or office scenario where social distancing norms cannot be maintained while work is ongoing. For example, workers in meat processing plants are in close proximity to one another, certainly less than social distancing norms, for communication purposes. A barrier, such as plexiglass, positioned between workers would hinder communication and would lower productivity. Air curtain 32 positioned between workers would allow for communication and the speed of the downward air flow would force any infectious cloud 12 directly to floor 14 prior to entering into the ingestion zone of the mouth, nose or eyes of any workers proximate the worker that produced infectious cloud 12.

Figure 10:
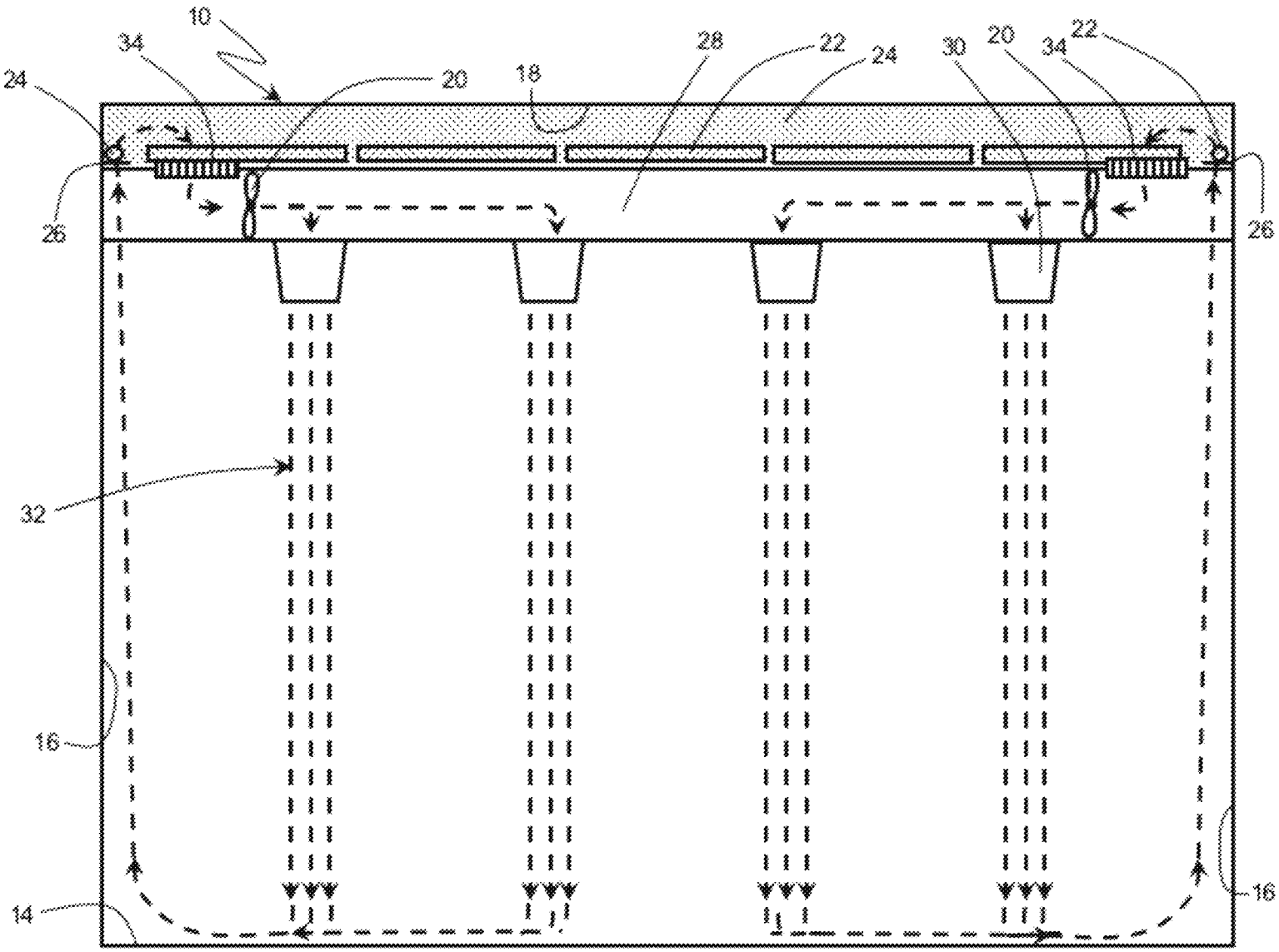
FIG. 10 is a side view of a ventilation system depicting air flow generating devices positioned within a duct to drive downward air flow through a plurality of nozzles to create a plurality of air curtains and upward air flow at the walls according to another embodiment of the present invention.
Figure 11:
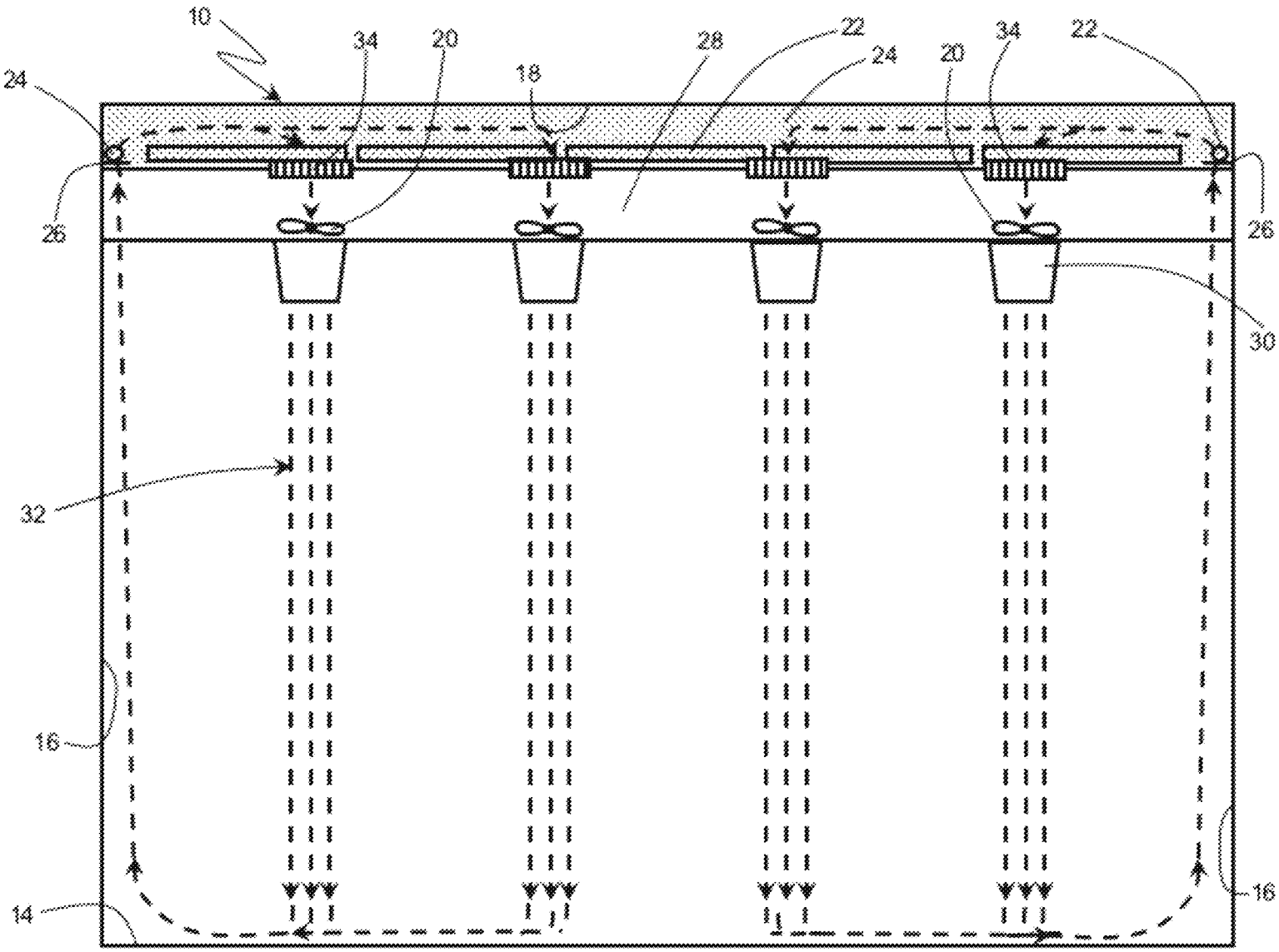
FIG. 11 is a side view of a ventilation system depicting air flow generating devices positioned within a duct at each nozzle to drive downward air flow through nozzles to create a plurality of air curtains and upward air flow at the walls according to another embodiment of the present invention.

Fans 20 and nozzles 30 will drive air flow and any infectious clouds 12 downward to floor 14 and out to walls 16. As the air flow reaches walls 16, the air flow will be outside of the general force of fans 20 and nozzles 30 driving the air flow downward. Air flow and any infectious clouds 12 at walls 16 will be drawn upward to ceiling 18 by the air flow pull from the backside of fans 20. As the air flow and any infectious clouds 12 reach ceiling 18, the air flow and clouds 12 will enter ultraviolet C field 24 produced by ultraviolet C light lamps 22. While the air flow and infectious clouds 12 are within field 24, the ultraviolet radiation will kill the bacteria, viruses and pathogens contained in infectious cloud 12 as fully described above. After passing through field 24, air flow will be free of any infectious clouds 12 and will enter duct 28 be driven downward back toward floor 14 by fans 20 and nozzles 30 to repeat the process. FIGS. 10 and 11 depict the positioning of ultraviolet C light lamps 22 outside of duct 28. However, it is important to note that ultraviolet C light lamps 22 may be positioned within duct 28 (see for example FIGS. 14A-C and 16) to kill any bacteria, viruses or pathogens contained in any infectious cloud 12.

Figure 12A:
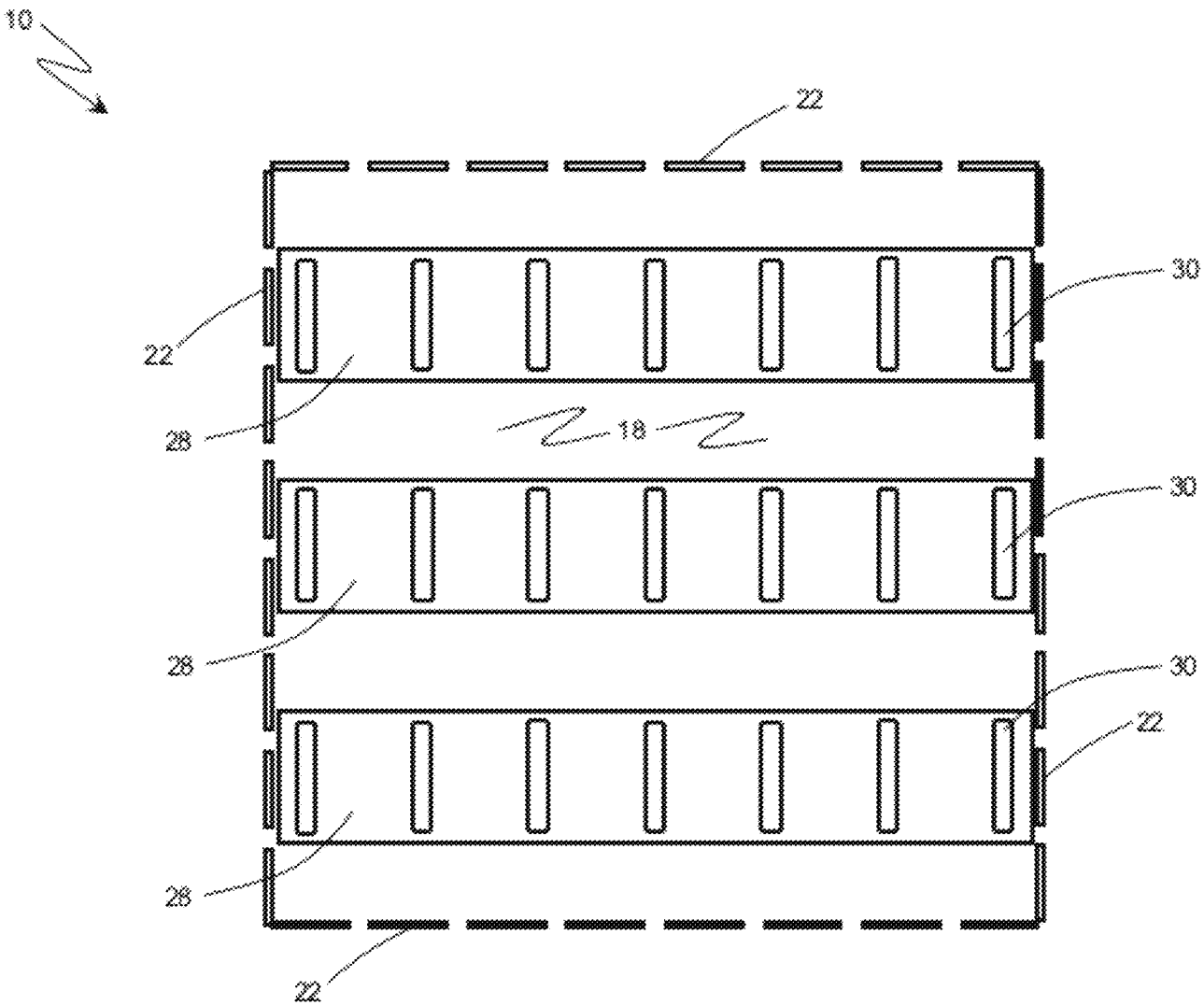
FIGS. 12A and 12B are plan views of the ceiling illustrating the ventilation system depicting a plurality of ducts, different sized and shaped nozzles and ultraviolet light sources in an indoor facility according to the embodiment of the present invention.
Figure 12B:
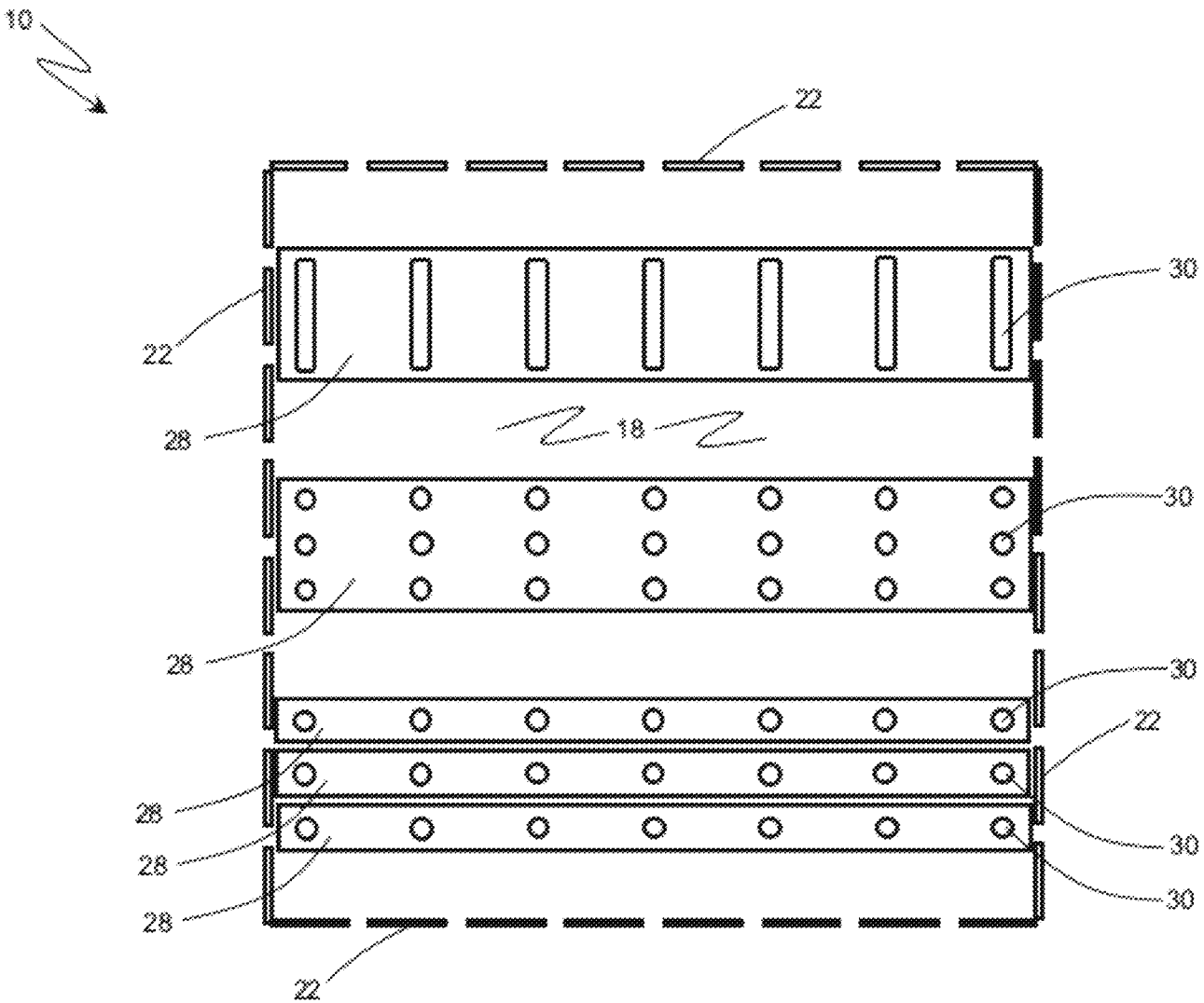

FIG. 12B depicts several arrangements of duct 28 and nozzles 30 from a floor view looking upward to ceiling 18. The upper configuration depicts a plurality of elongated nozzles 30 extending from a single duct 30. Air flow from these particular nozzles 30 will create a type of air curtain 32 that may resemble a blade and cover a substantial surface area. The middle configuration depicts a plurality of generally circular nozzles 30 extending from a single duct 28 for a more directed and faster downward air flow. The lower configuration depicts a plurality of generally circular nozzles 30 extending from a plurality of ducts 28. This configuration may provide for even a more directed air flow and an even faster downward air flow. This configuration will allow for further flexibility in controlling air flow by allow an entire duct 28 to be turned off. Further, nozzles 30 may be closed off to even further provide flexibility in directing air flow into areas were needed. For example, work may not be ongoing in a specific area and my not warrant the use of nozzles 30 to direct air flow at a particular time. It is also important to note that the size of nozzles 30 may be adjusted to regulate the velocity of the air flow of air curtains 32 exiting nozzles 30. Further, the positioning of nozzles 30 may be adjusted to enable nozzles 30 to produce air curtains 32 in a specific direction at a targeted location.

Figure 13:
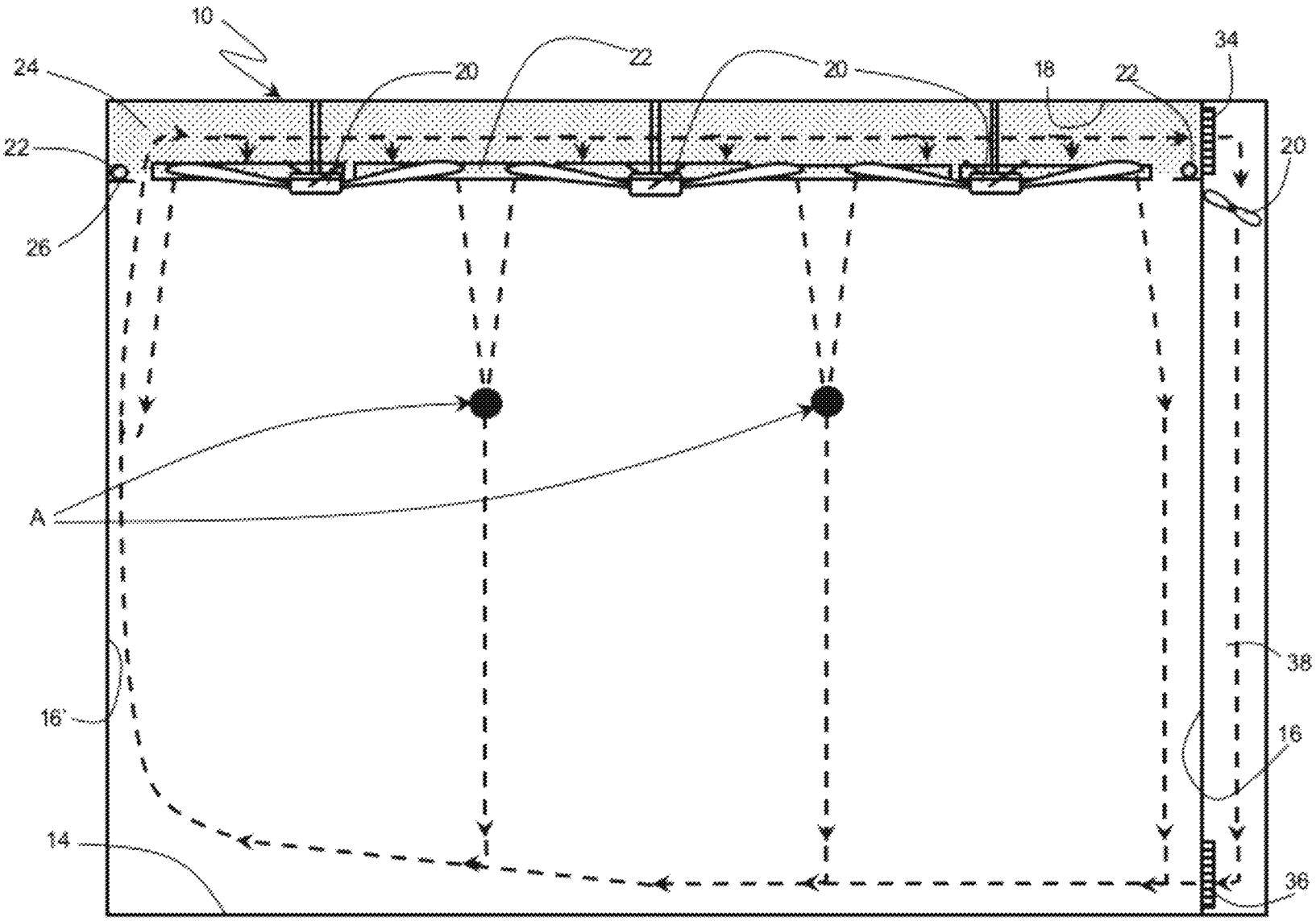
FIG. 13 is a side view of a ventilation system including a duct housing a air flow generating device, an intake vent and an exhaust vent according to yet another embodiment of the present invention.

FIG. 13 illustrates still another embodiment of the present invention. Ventilation system 10 may include duct 38 that extend the length and height of wall 16. Duct 38 and wall 16 may include an air intake grate 34 such as a register and an air exhaust grate 36 such as a register. Duct 38 may extend from ceiling 18 to floor 14 with air intake grate 34 positioned proximate ceiling 18 to allow irradiated air flow from ultraviolet C field 24 to enter duct 38. Air flow will be pulled into duct 38 by fan 20 and air flow will travel downward through duct 38 to exhaust grate 36 and enter the room. As described above, ceiling fans 20 working within the room will be forcing air flow along with any infectious clouds downward to floor 14. Air flow exiting exhaust grate 36 will force the air and any infectious clouds 12 at floor 14 across the room to the opposite wall 16'.

As the air flow reaches the opposite wall 16', the air flow will be outside of the general force of ceiling fans 20 driving the air flow downward. Air flow and any infectious clouds 12 at opposite wall 16' will be drawn upward to ceiling 18 by the air flow pull from the backside of ceiling fans 20. As the air flow and any infectious clouds 12 reach ceiling 18, the air flow and clouds 12 will enter ultraviolet C field 24 produced by ultraviolet C light lamps 22. While the air flow and infectious clouds 12 are within field 24, the ultraviolet radiation will kill the bacteria, viruses and pathogens contained in infectious cloud 12 as fully described above. After passing through field 24, air flow will be free of any infectious clouds 12 and will be driven downward by ceiling fans 20 back toward floor 14 and pulled into duct 38 by fan 20 at ceiling 18 to repeat the process.

Figure 14A:
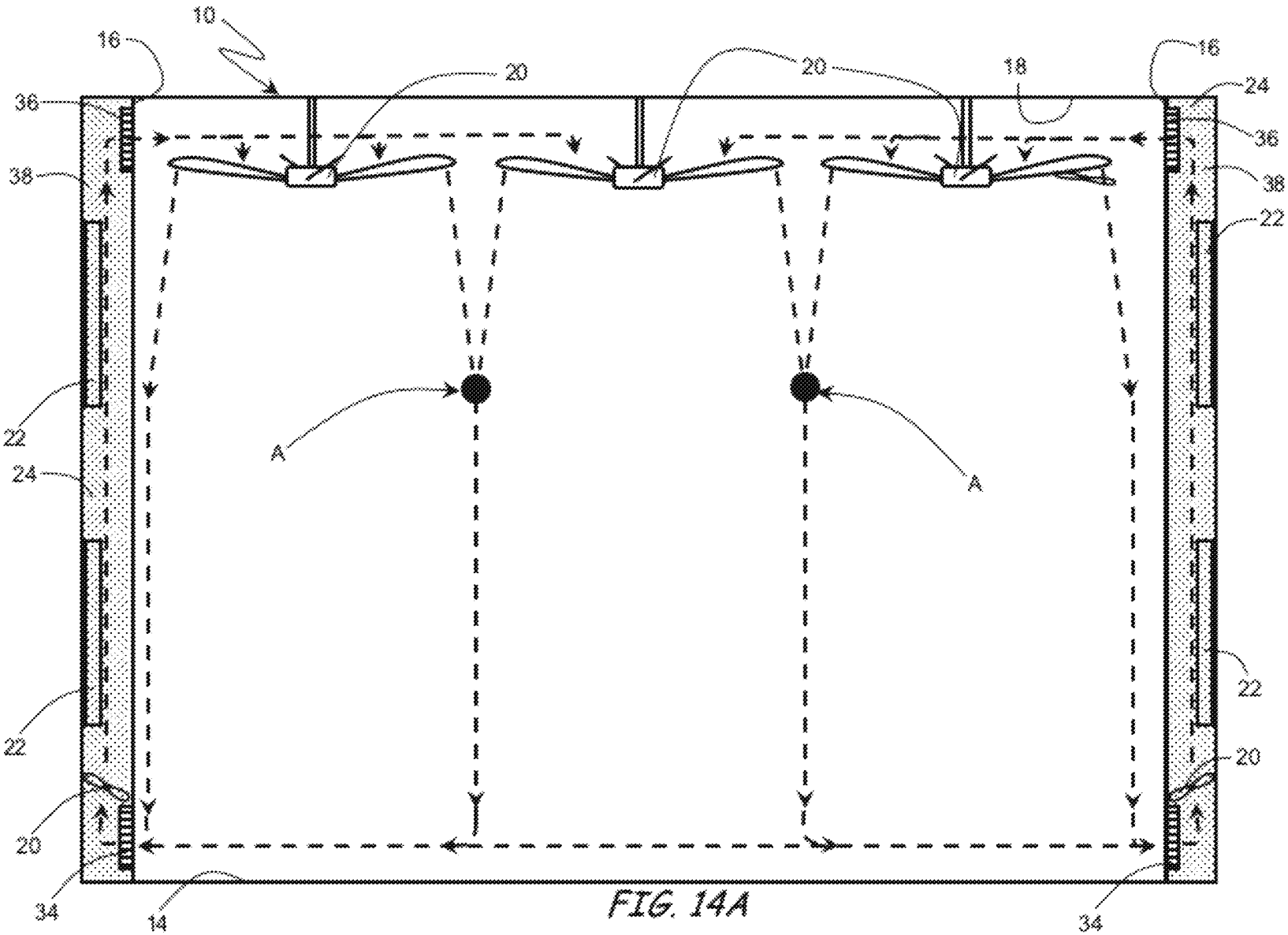
FIGS. 14A-14B are side views of a ventilation system including a plurality of duct housings, each including an air flow generating device, an intake vent, an exhaust vent and a plurality of ultraviolet light sources according to still another embodiment of the present invention.
Figure 14B:
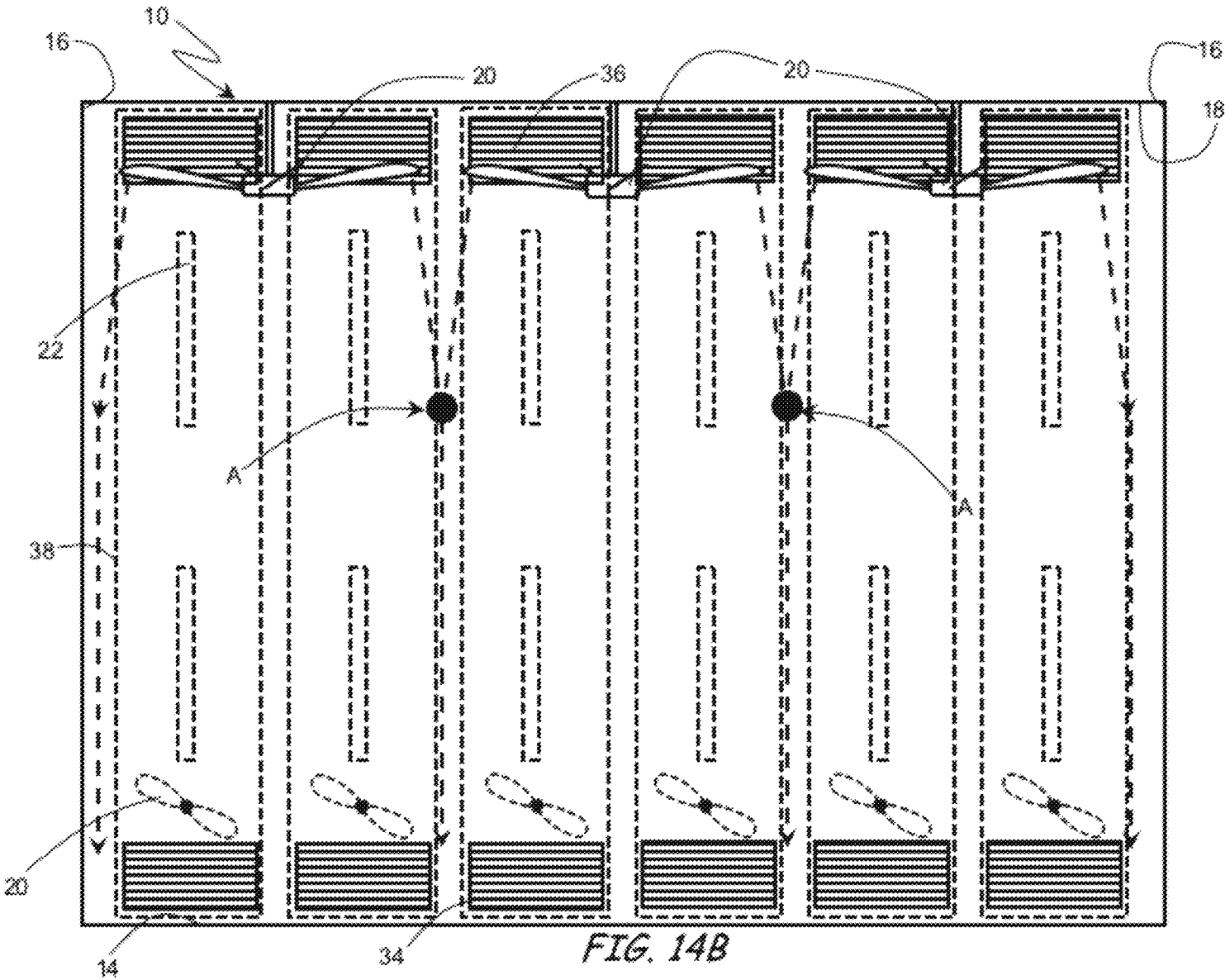
Figure 14C:
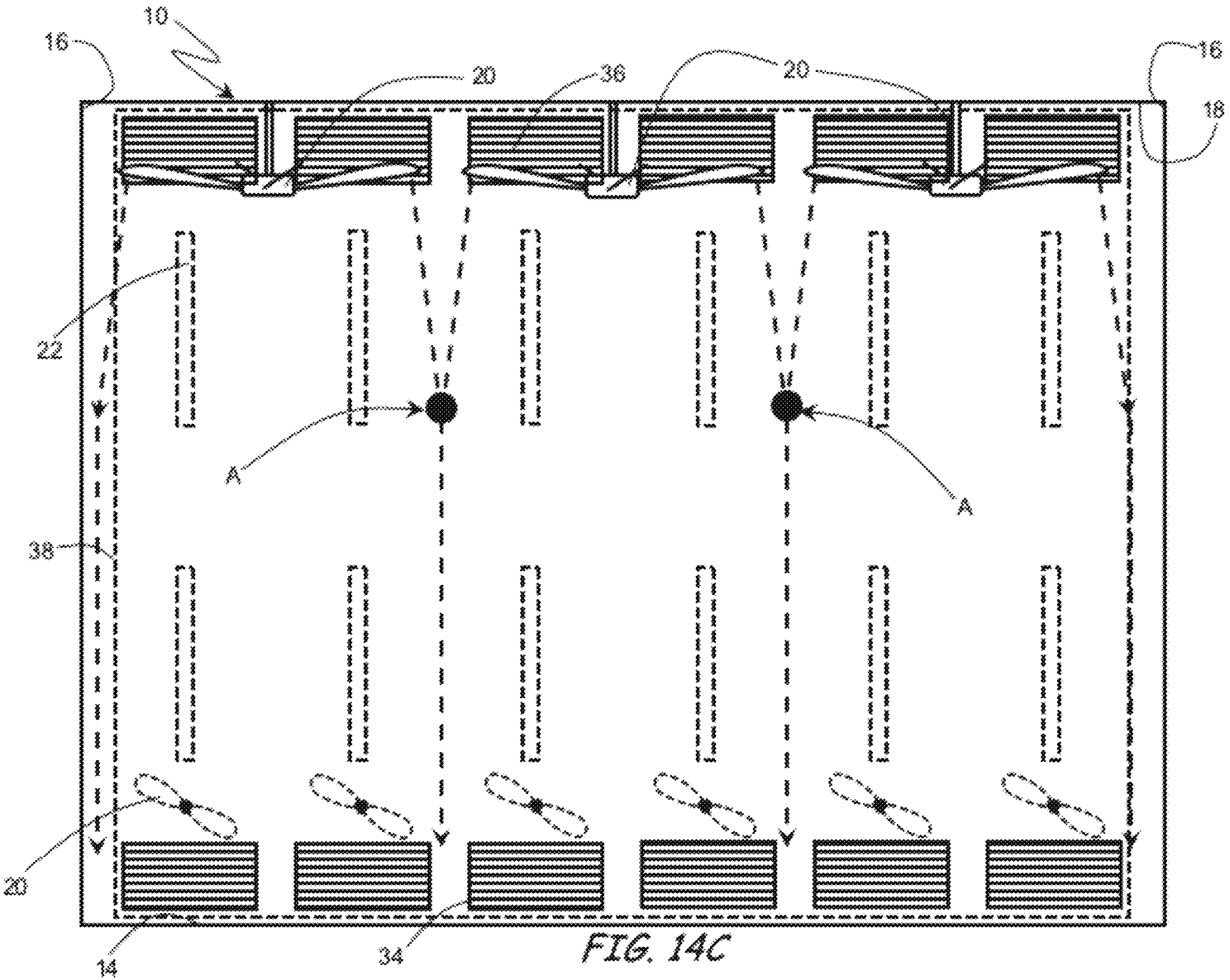
FIG. 14C is a side view of a ventilation system including a duct housing, the duct housing including a plurality of air flow generating devices, intake vents, exhaust vents and ultraviolet light sources according to still another embodiment of the present invention.

FIGS. 14A-14C illustrate yet another embodiment of the present invention. In this particular embodiment of the present invention, ventilation system 10 includes ducts 38 that may be added at walls 16 and extend the length and height of wall 16. Ducts 38 include intake grate 34, exhaust grate 36 and fan 20. Ducts also include a plurality of ultraviolet C light lamps 22 to create an ultraviolet C filed 24 within ducts 38. Ducts 38 may extend from ceiling 18 to floor 14 with intake grate 34 proximate ceiling 18 and exhaust grate proximate floor 14. As described above, ceiling fans 20 working within the room will be forcing air flow along with any infectious clouds downward to floor 14. Rather than the air flow and any infectious clouds 12 returning to ceiling 18 along walls 16, fans 20 within ducts 38 will pull air and clouds 12 at the floor level into duct 38 through intake grate 34. Air flow and infectious clouds 12 will travel up ducts 38 to ceiling 18 and exit ducts at exhaust grate 36.

As the air flow and any infectious clouds 12 enter duct 38 through intake grate 34, the air flow and clouds 12 will enter ultraviolet C field 24 produced by ultraviolet C light lamps 22. While the air flow and infectious clouds 12 are within field 24, the ultraviolet radiation will kill the bacteria, viruses and pathogens contained in infectious cloud 12 as fully described above. After passing through field 24, air flow will be free of any infectious clouds 12 and will be introduced back into the room at ceiling 18 through exhaust grate 36 to be driven downward by ceiling fans 20 back toward floor 14 and into duct 38 through intake grate 34 to repeat the process.

FIG. 14B illustrates a number of ducts 38 each including fan 20, intake grate 34, exhaust grate 36 and ultraviolet C light lamps 22 configurations spaced throughout a room. This will allow for individual ducts 38 to be shut down if required for service or they may not be needed for air flow in a particular area of the room. FIG. 14C illustrates a single duct 38 including a plurality of fans 20, intake grates 34, exhaust grates 36 and ultraviolet C light lamps 22 configuration for wall 16 of a room. Duct 38 configured in this manner may provide a more economical means to deploy ventilation system 10 while still maintaining and irradiating infectious cloud 12 air flow.

Figure 15:
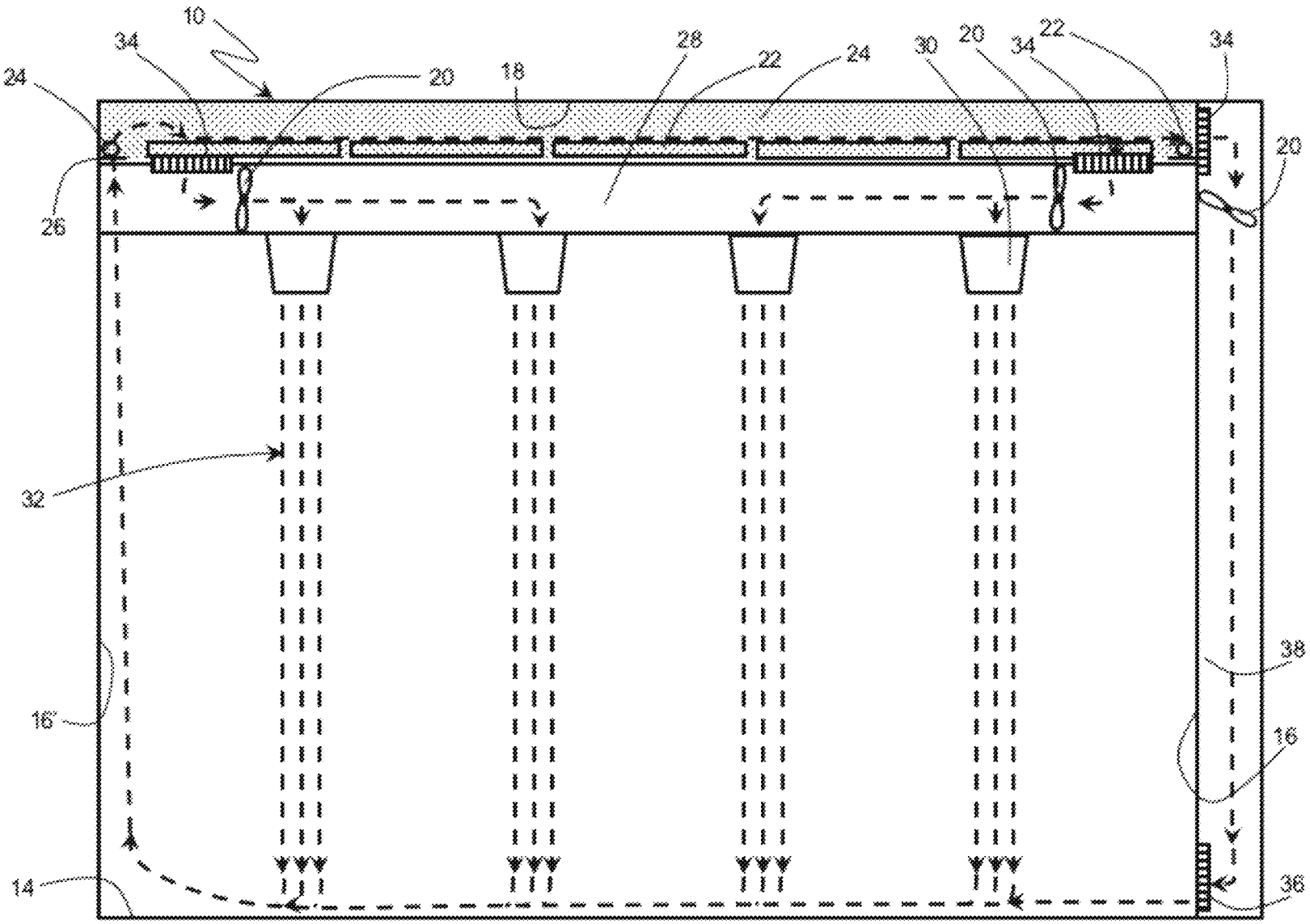
FIG. 15 is a side view of a ventilation system including a plurality of duct housings each including an air flow generating device, an intake vent and an exhaust vent according to yet another embodiment of the present invention.

FIG. 15 illustrates still another embodiment of the present invention. Ventilation system 10 may include duct 38 that extend the length and height of wall 16 as described above. Duct 38 and wall 16 may include an air intake grate 34 such as a register and an air exhaust grate 36 such as a register. Duct 38 may extend from ceiling 18 to floor 14 with air intake grate 34 positioned proximate ceiling 18 to allow irradiated air flow from ultraviolet C field 24 to enter duct 38. Air flow will be pulled into duct 38 by fan 20 and air flow will travel downward through duct 38 to exhaust grate 36 and enter the room. As described above, fans 20 and nozzles 30 create air curtains 32 working within the room will force air flow, along with any infectious clouds 12, downward to floor 14. Air flow exiting exhaust grate 36 will force the air and any infectious clouds 12 at floor 14 across the room to the opposite wall 16'.

As the air flow reaches the opposite wall 16', the air flow will be outside of the general force of nozzles 30 and air curtains 32 driving the air flow downward. Air flow and any infectious clouds 12 at opposite wall 16' will be drawn upward to ceiling 18 by the air flow pull from the backside of fans 20. As the air flow and any infectious clouds 12 reach ceiling 18, the air flow and clouds 12 will enter ultraviolet C field 24 produced by ultraviolet C light lamps 22. While the air flow and infectious clouds 12 are within field 24, the ultraviolet radiation will kill the bacteria, viruses and pathogens contained in infectious cloud 12 as fully described above. After passing through field 24, air flow will be free of any infectious clouds 12 and will be driven downward by fans 20, nozzles 30 and air curtain 32 back toward floor 14 and into duct 38 through intake grate 34 to repeat the process.

Figure 16:
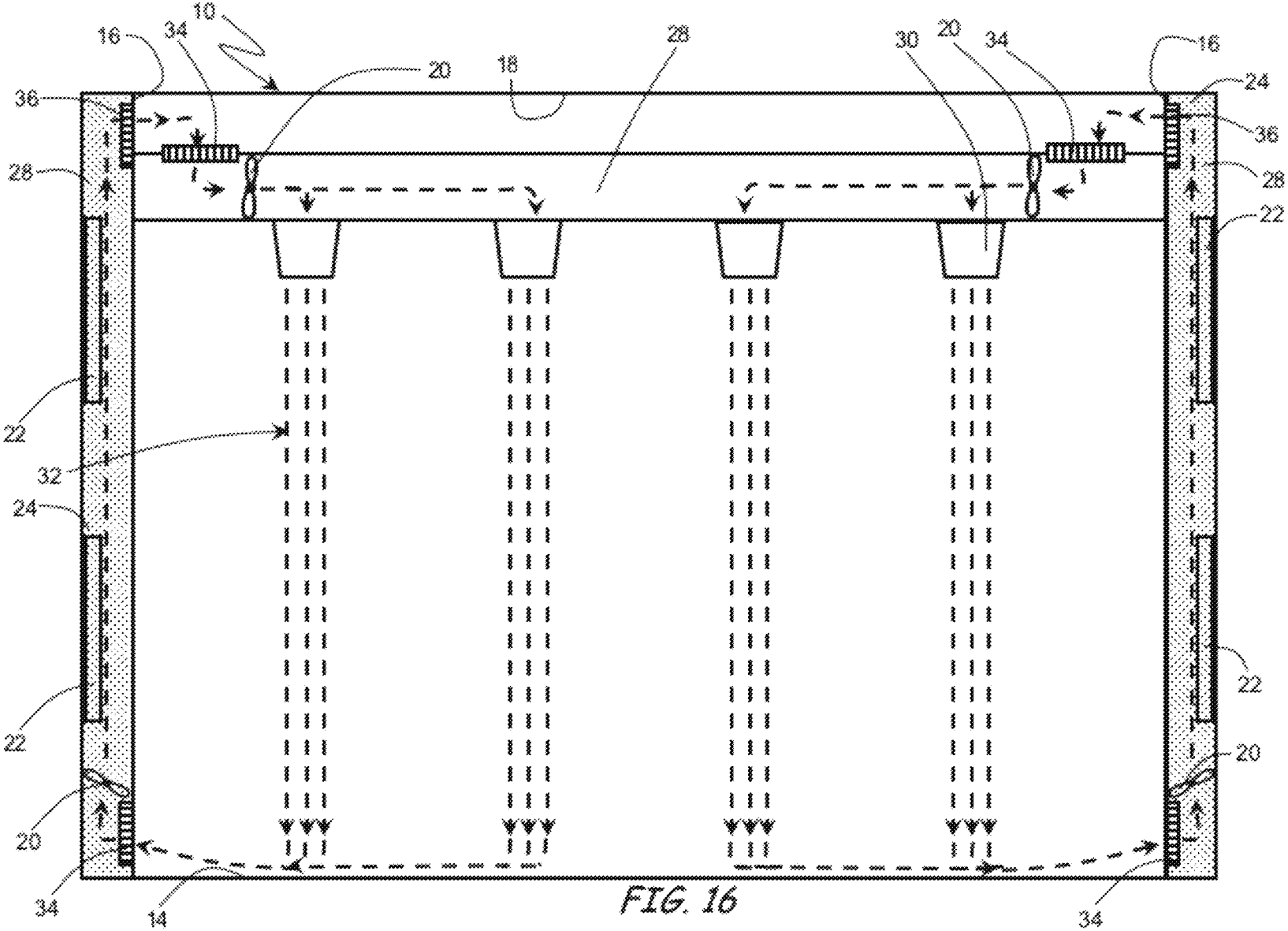
FIG. 16 is a side view of a ventilation system including a plurality of duct housings, each including an air flow generating device, an intake vent, an exhaust vent and a plurality of ultraviolet light sources according to still another embodiment of the present invention.

FIG. 16 illustrates still another embodiment of the present invention. In this particular embodiment of the present invention, ventilation system 10 includes ducts 38 that may be added at walls 16 and extend the length and height of wall 16. Ducts 38 include intake grate 34, exhaust grate 36 and fan 20. Ducts also include a plurality of ultraviolet C light lamps 22 to create an ultraviolet C filed 24 within ducts 38. Ducts 38 may extend from ceiling 18 to floor 14 with intake grate 34 proximate ceiling 18 and exhaust grate proximate floor 14. As described above, fans 20, nozzles 30 and air curtain 32 working within the room will be forcing air flow along with any infectious clouds downward to floor 14. Rather than the air flow and any infectious clouds 12 returning to ceiling 18 along walls 16, fans 20 within ducts 38 will pull air and clouds 12 at the floor level into duct 38 through intake grate 34. Air flow and infectious clouds 12 will travel up ducts 38 to ceiling 18 and exit ducts at exhaust grate 36.

As the air flow and any infectious clouds 12 enter duct 38 through intake grate 34, the air flow and clouds 12 will enter ultraviolet C field 24 produced by ultraviolet C light lamps 22. While the air flow and infectious clouds 12 are within field 24, the ultraviolet radiation will kill the bacteria, viruses and pathogens contained in infectious cloud 12 as fully described above. After passing through field 24, air flow will be free of any infectious clouds 12 and will be introduced back into the room at ceiling 18 through exhaust grate 36 and drawn into duct 28 at intake grate 34 to be driven downward by fans 20, nozzles 30 and air curtain 32 back toward floor 14 and into duct 38 through intake grate 34 to repeat the process.

Figure 17A:
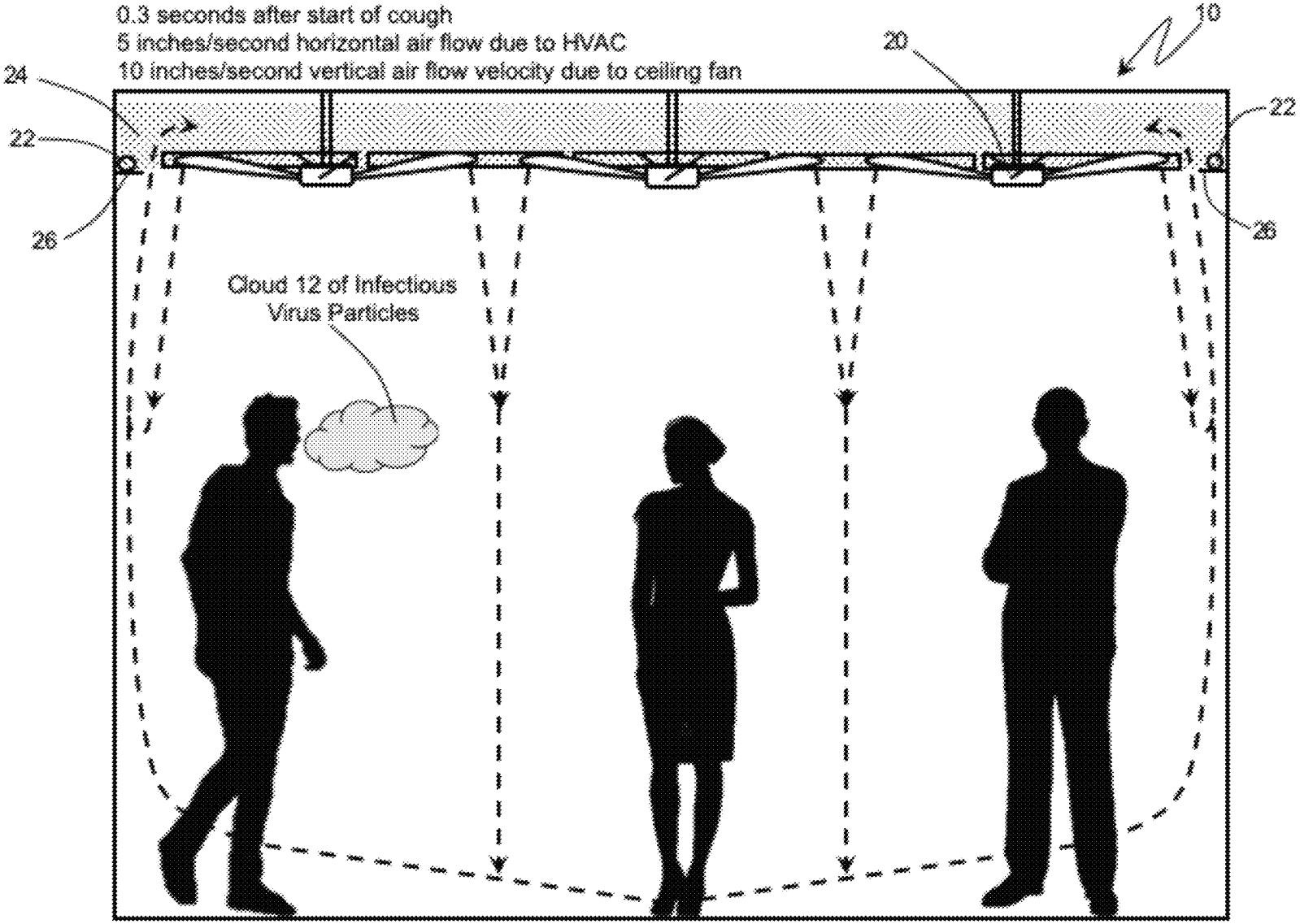
FIGS. 17A-17E are side views illustrating how a cloud of infectious viral particles may be expelled from an infected individual and driven out of the ingestion zone of the mouth, nose and eyes of a second individual proximate the infected individual by the ventilation system according to an embodiment of the present invention.
Figure 17B:
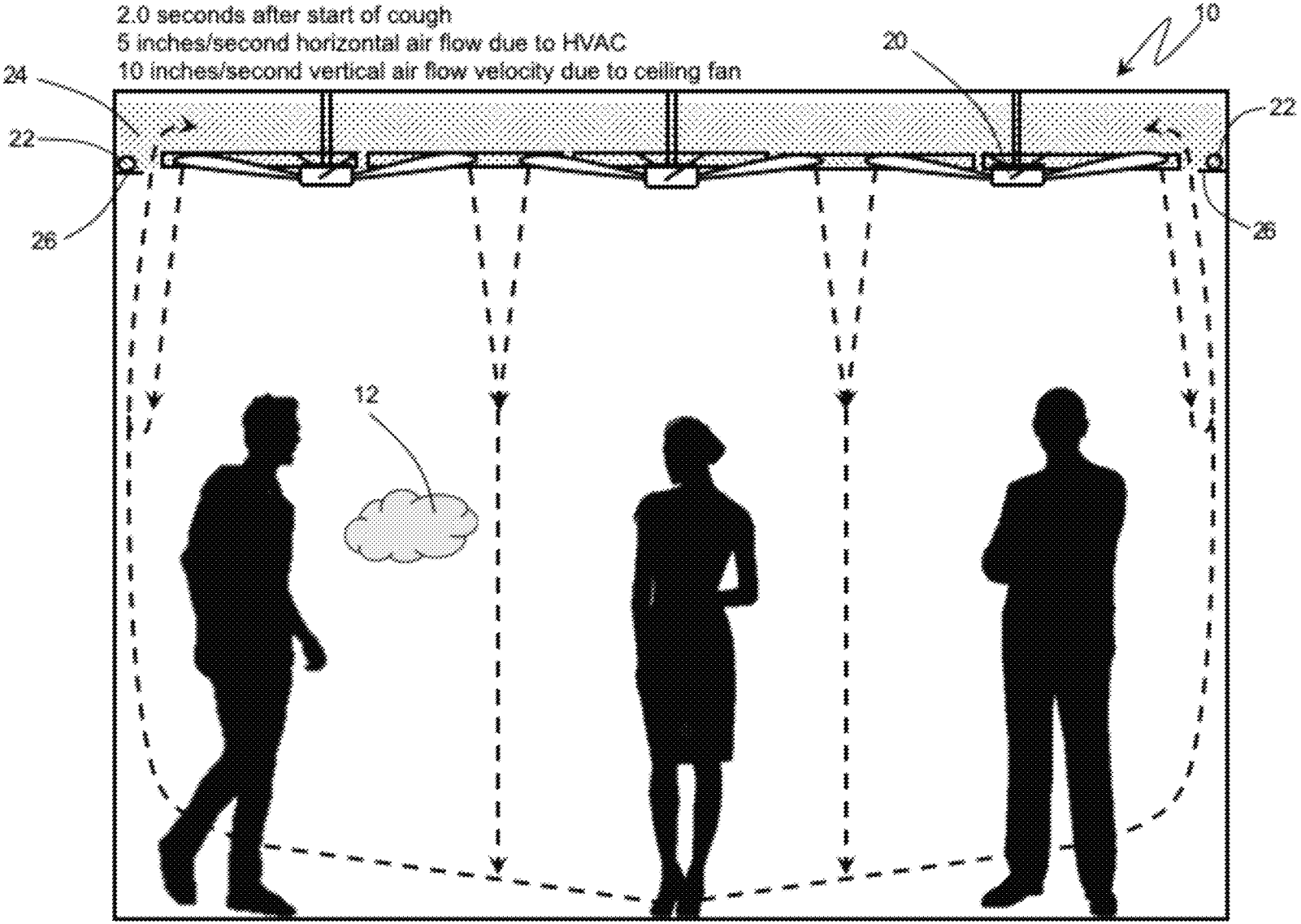
Figure 17C:
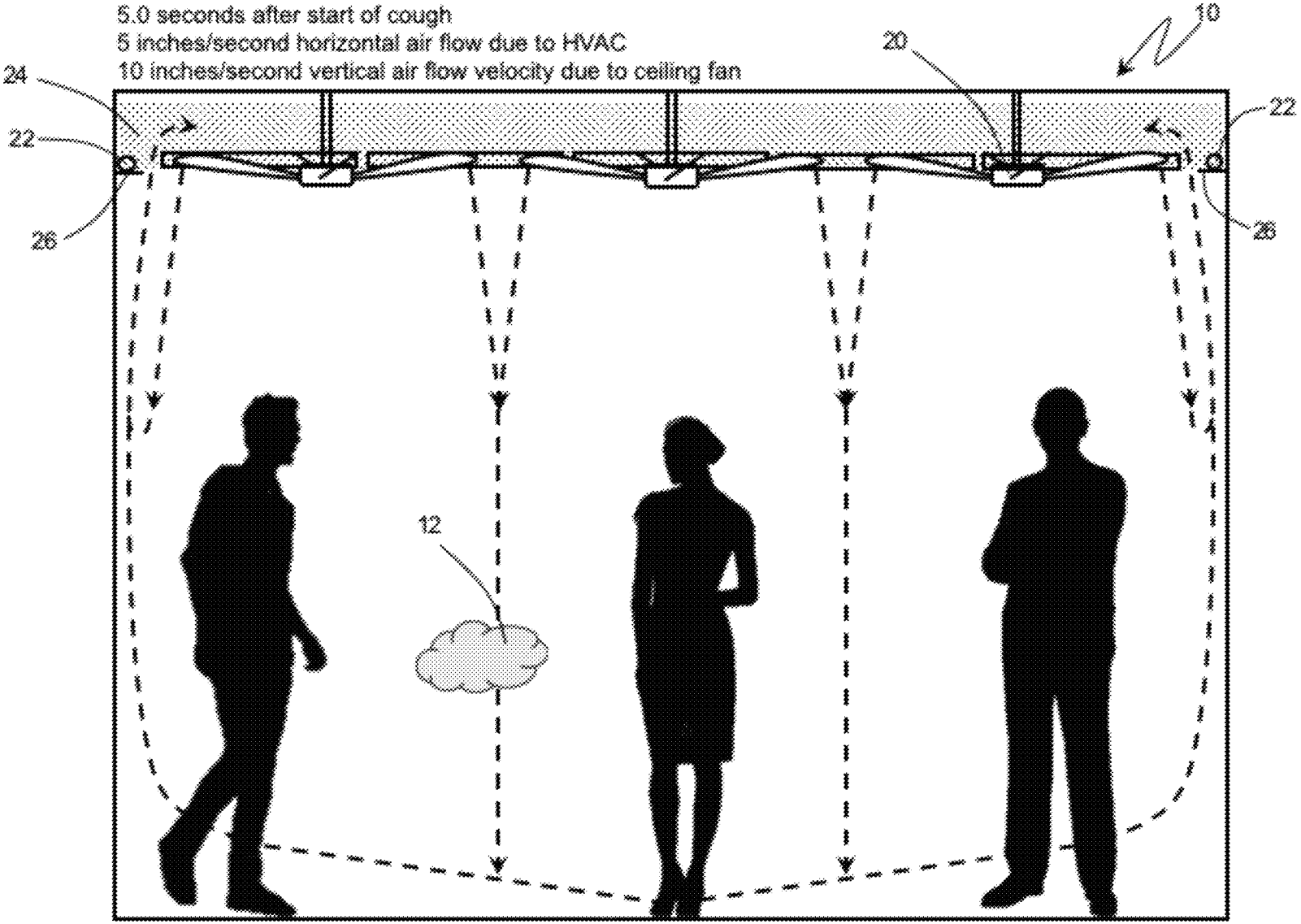
Figure 17D:
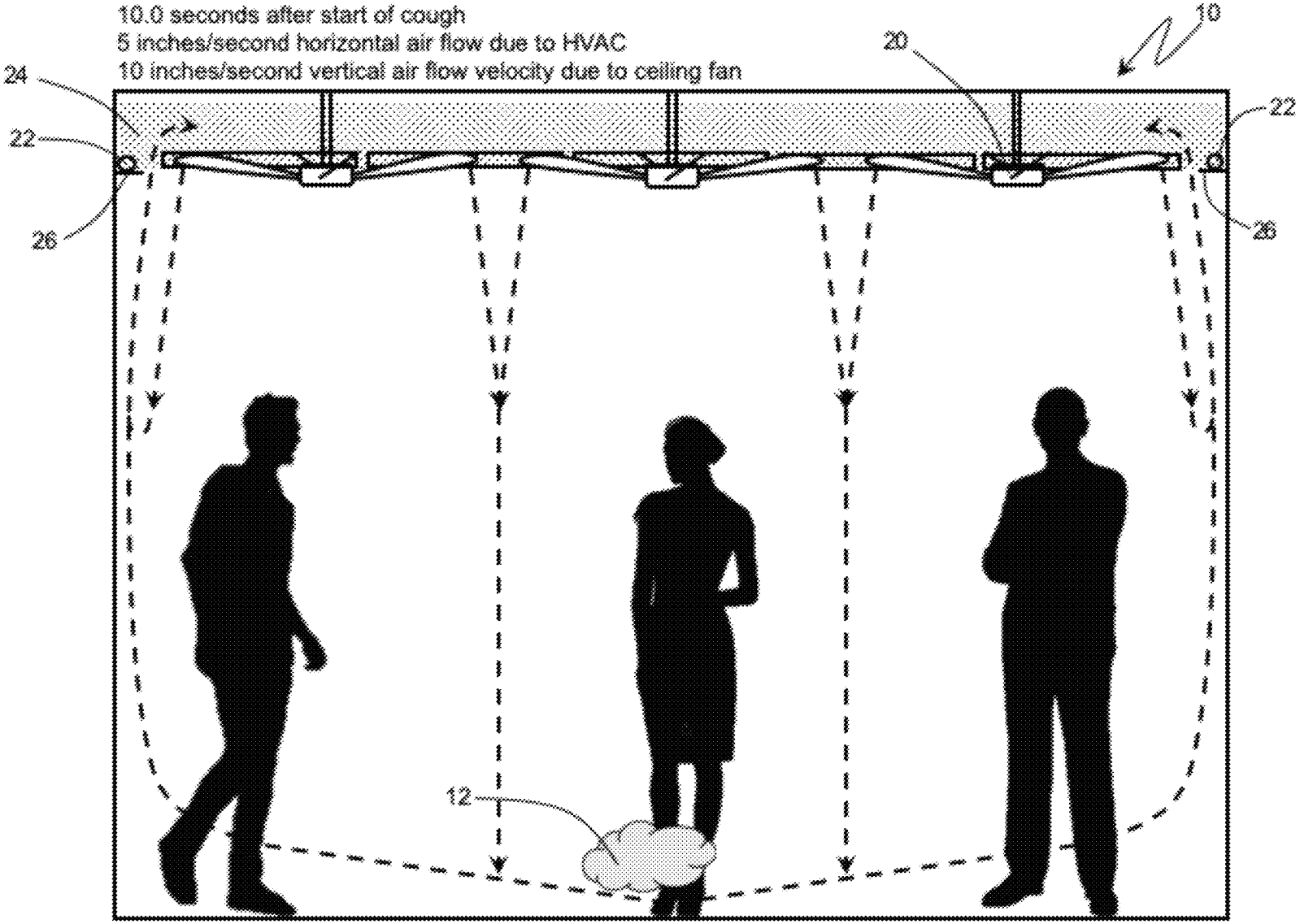
Figure 17E:
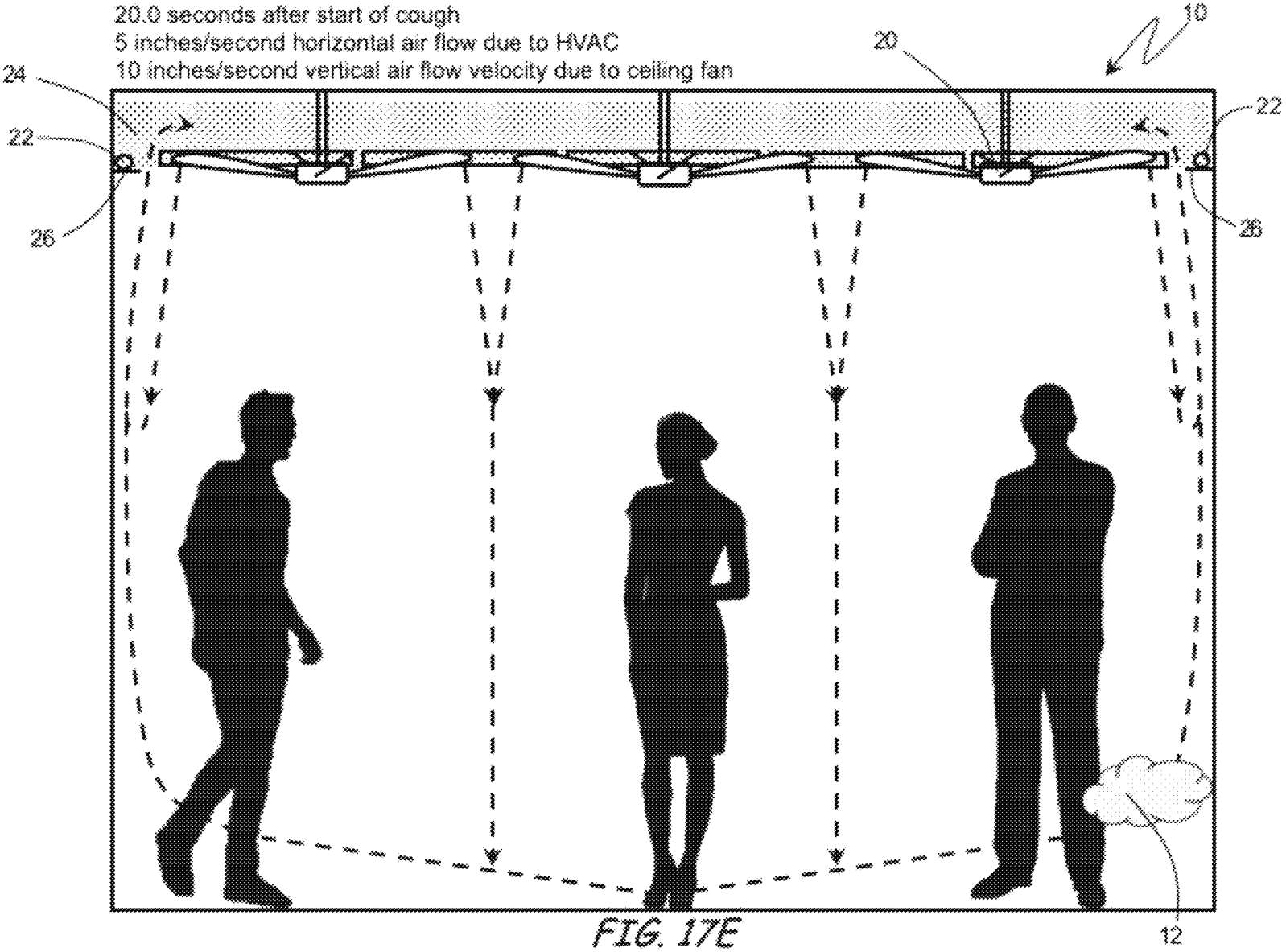

FIGS. 17A-17E illustrate how cloud 12 of infectious viral particles or droplets produced by an individual with a cough will travel from an infected individual throughout the room under ventilation system 10. FIG. 17A shows cloud 12 0.3 seconds after the cough has been initiated. FIG. 17B illustrates how cloud 12 of infectious viral particles or droplets has traveled in the room utilizing ventilation system 10. Two seconds after the cough was initiated, cloud 12 has been forced to the right by the HVAC system and downward by ceiling fans 20 out of the ingestion zone of the mouth, nose and eyes of the individual closest to the infected individual. FIG. 17C illustrates how cloud 12 of infectious viral particles or droplets has traveled five seconds after the cough was initiated. Cloud 12 has been forced further to the right by the HVAC system and further downward by ceiling fans 20 out of the ingestion zone of the mouth, nose and eyes of the individual closest to the infected individual. FIG. 17D illustrates how cloud 12 of infectious viral particles or droplets has traveled ten seconds after the cough was initiated. Cloud 12 has been forced still further to the right by the HVAC system and still further downward by ceiling fans 20 to the floor level. FIG. 17D illustrates how cloud 12 of infectious viral particles or droplets has traveled twenty seconds after the cough was initiated. Cloud 12 has been forced still further to the right by the HVAC system and cloud 12 has now started to ascend up wall 16 to ceiling 18 and ultraviolet C field 24 for eradication of the infectious material while still remaining out of out of the ingestion zone of the mouth, nose and eyes of the individuals closest to the infected individual.

Figure 18A:
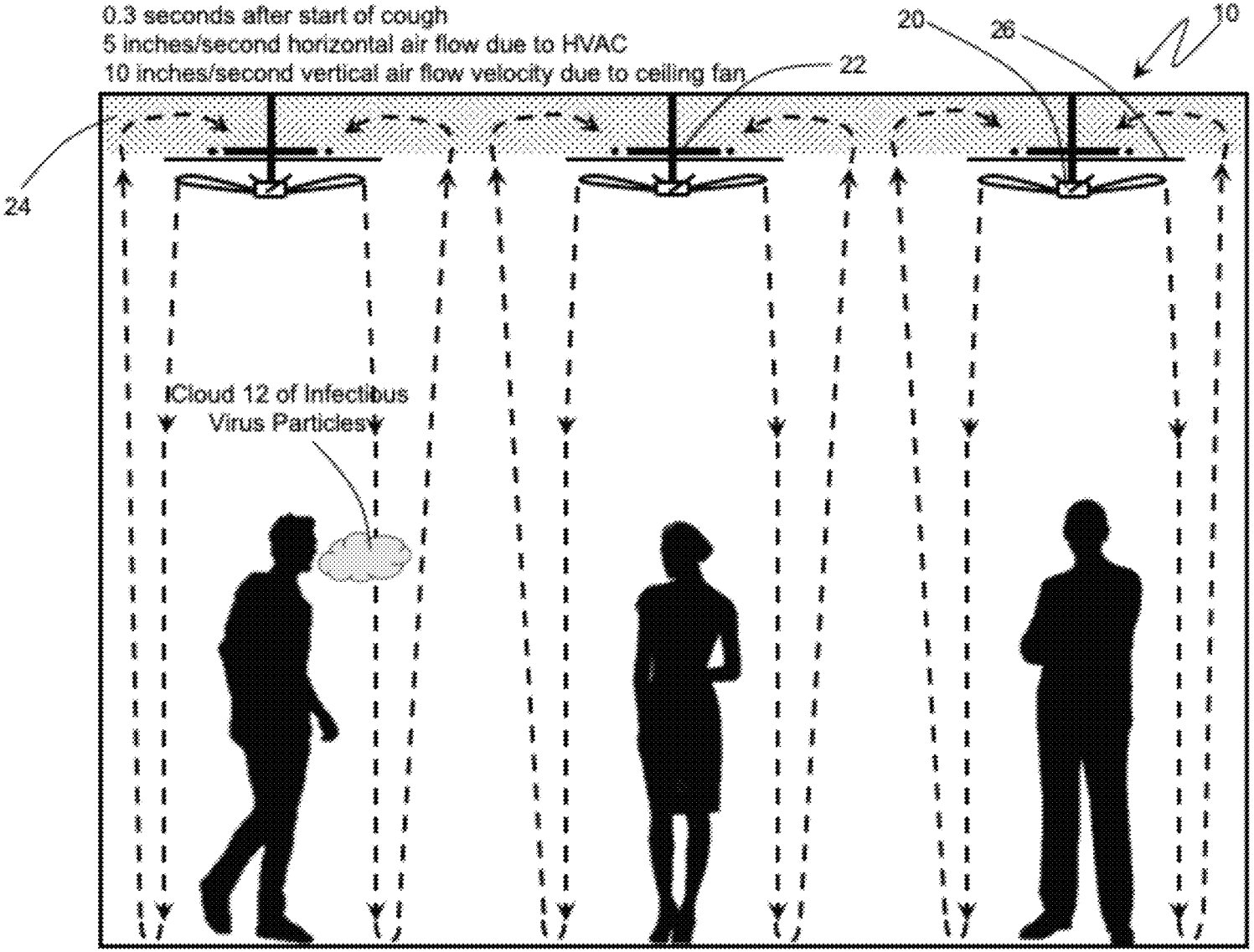
FIGS. 18A-18D are side views illustrating how a cloud of infectious viral particles may be expelled from an infected individual and driven out of the ingestion zone of the mouth, nose and eyes of a second individual proximate the infected individual by the ventilation system according to an embodiment of the present invention.
Figure 18B:
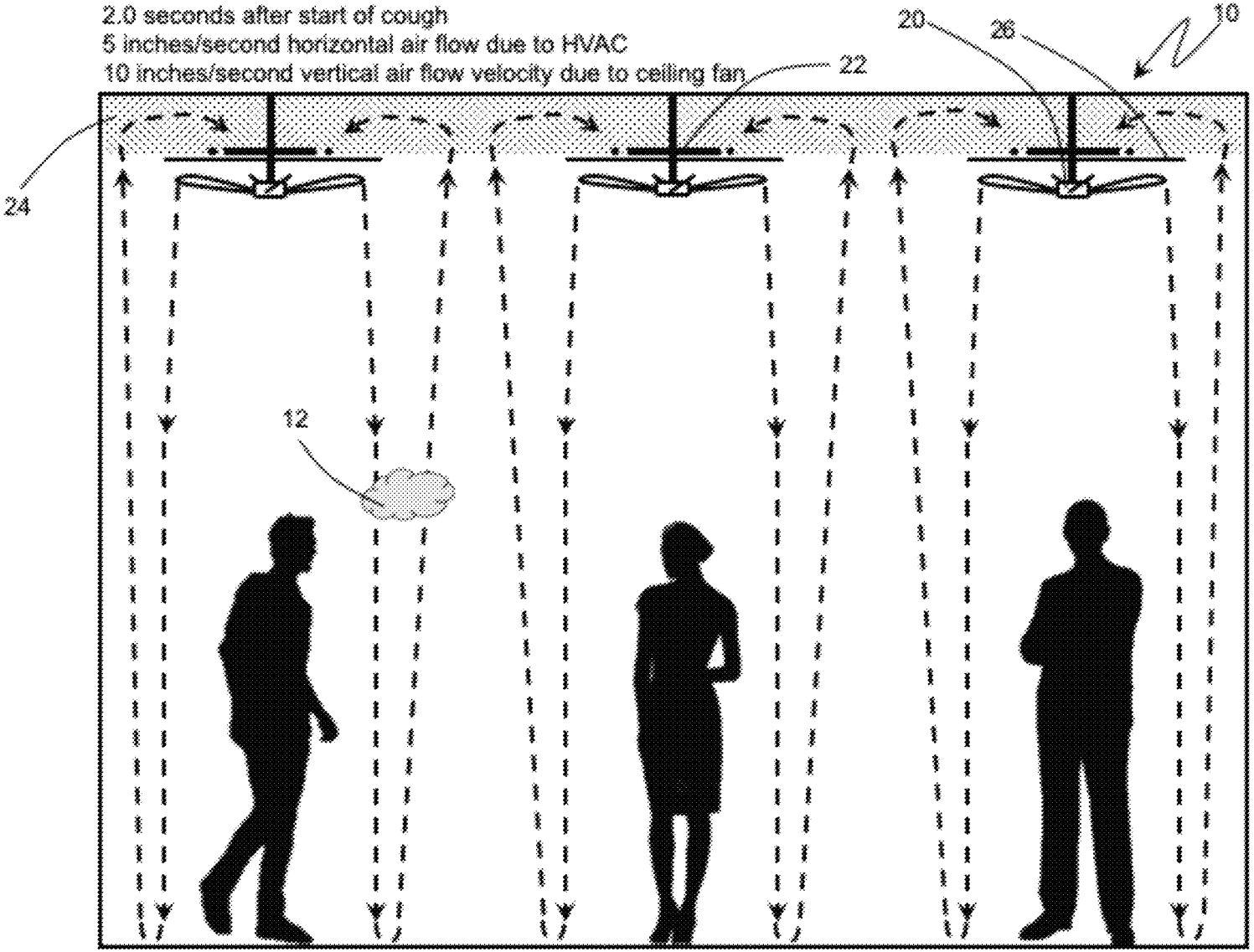
Figure 18C:
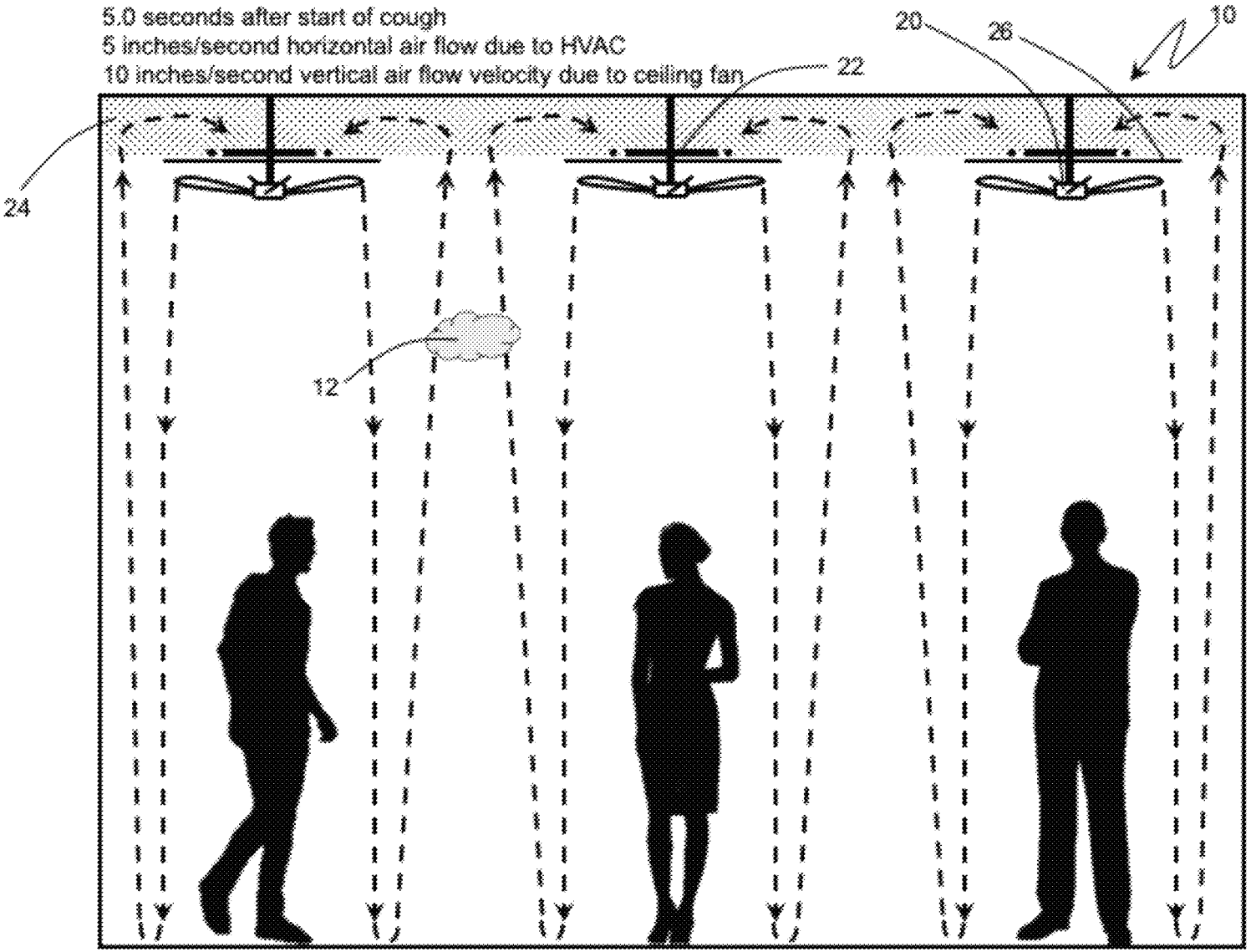
Figure 18D:
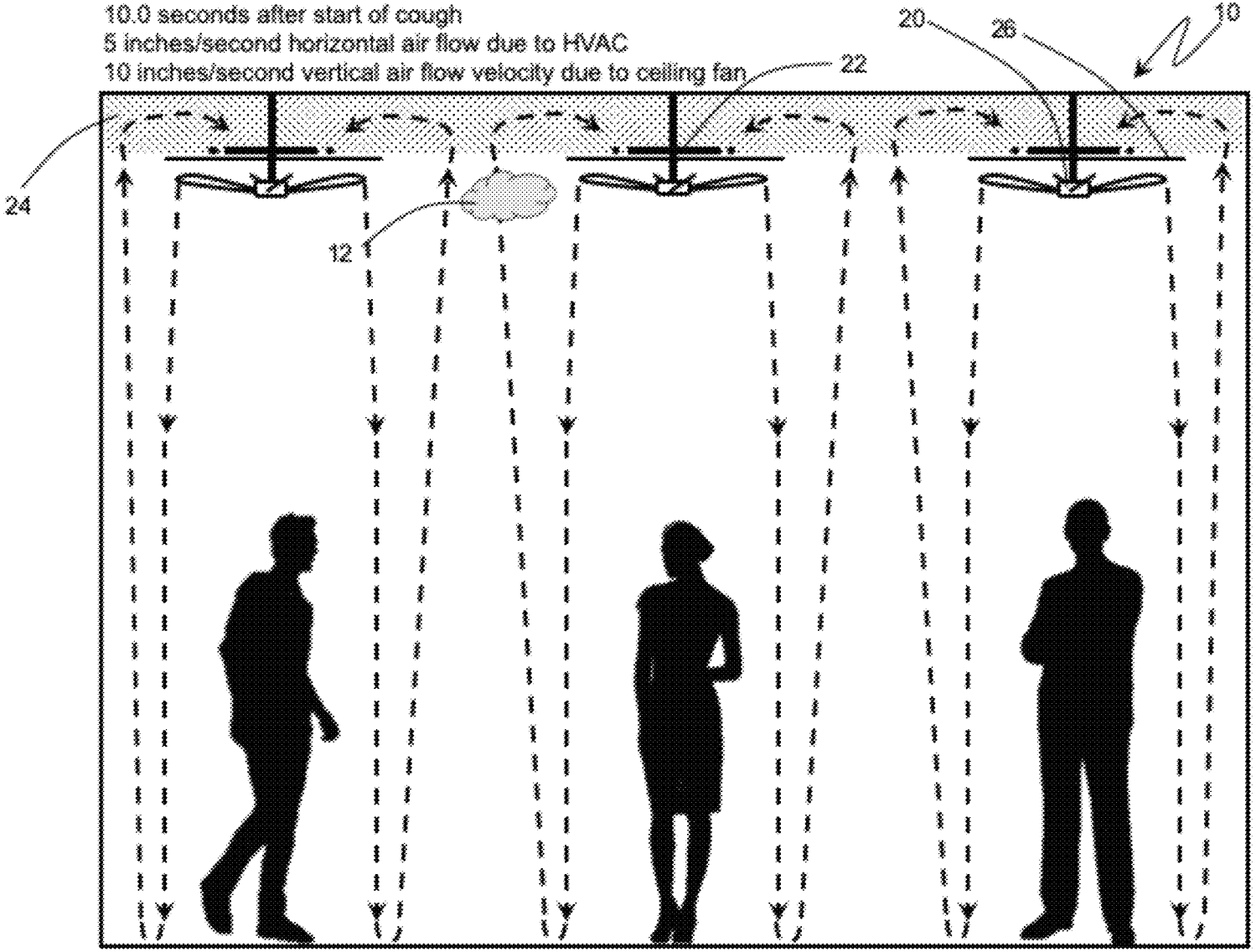

FIGS. 18A-18D illustrate how cloud 12 of infectious viral particles or droplets produced by an individual with a cough will travel from an infected individual throughout the room under another embodiment the present invention, ventilation system 10. FIG. 18A shows cloud 12 0.3 seconds after the cough has been initiated. FIG. 18B illustrates how cloud 12 of infectious viral particles or droplets has traveled in the room utilizing ventilation system 10. Two seconds after the cough was initiated, cloud 12 has been forced to the right by the HVAC system and upward by ceiling fans 20 out of the ingestion zone of the mouth, nose and eyes of the individual closest to the infected individual. FIG. 18C illustrates how cloud 12 of infectious viral particles or droplets has traveled five seconds after the cough was initiated. Cloud 12 has been forced further to the right by the HVAC system and further upward by ceiling fans 20 out of the ingestion zone of the mouth, nose and eyes of the individual closest to the infected individual. FIG. 18D illustrates how cloud 12 of infectious viral particles or droplets has traveled ten seconds after the cough was initiated. Cloud 12 has been forced still further to the right by the HVAC system and is approaching ceiling 18 and ultraviolet C field 24 for eradication of the infectious material while still remaining out of out of the ingestion zone of the mouth, nose and eyes of the individuals closest to the infected individual.

Figure 19A:
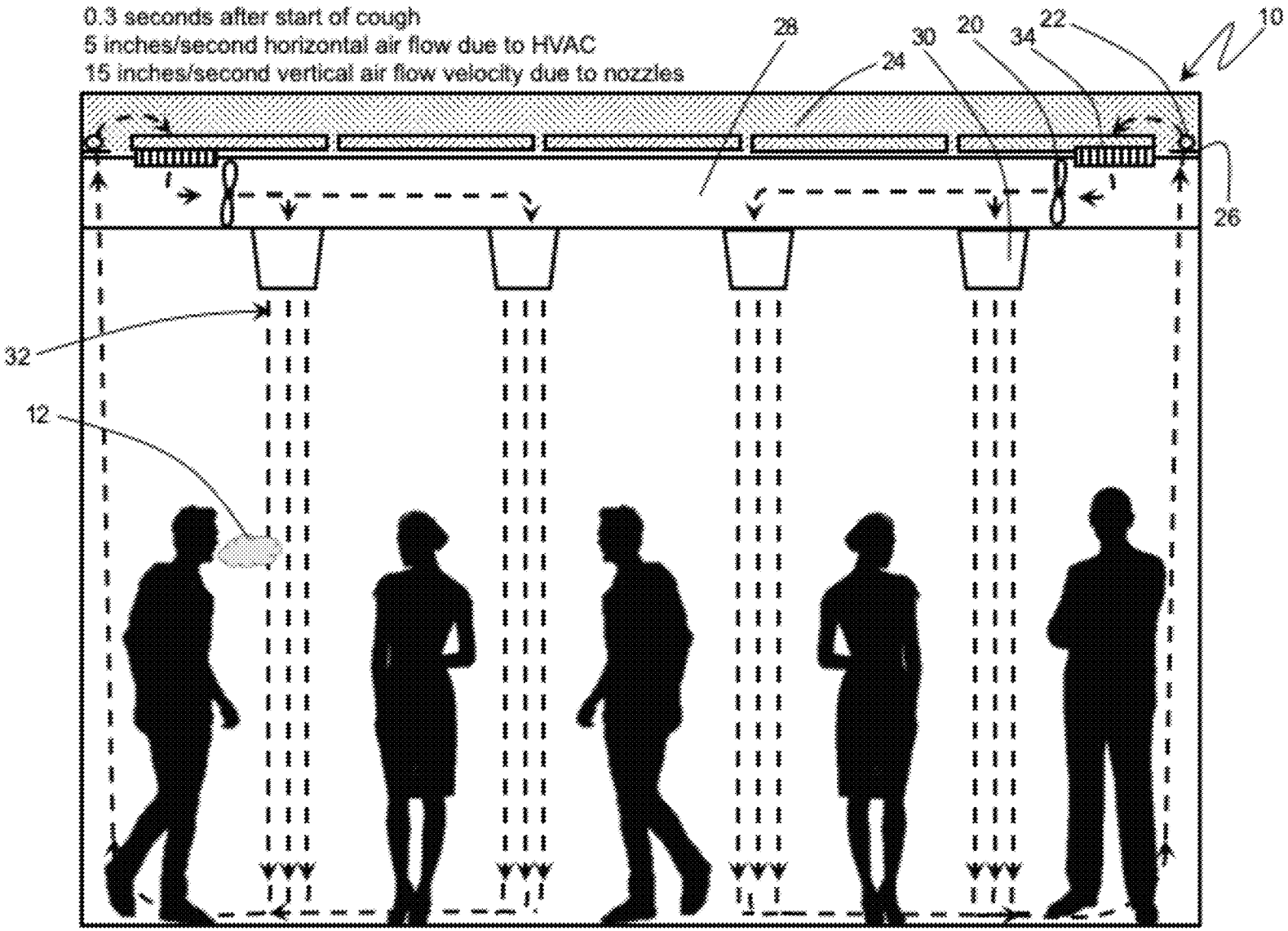
FIGS. 19A-19F are side views illustrating how a cloud of infectious viral particles may be expelled from an infected individual and driven out of the ingestion zone of the mouth, nose and eyes of individuals proximate the infected individual by the ventilation system according to another embodiment of the present invention.
Figure 19B:
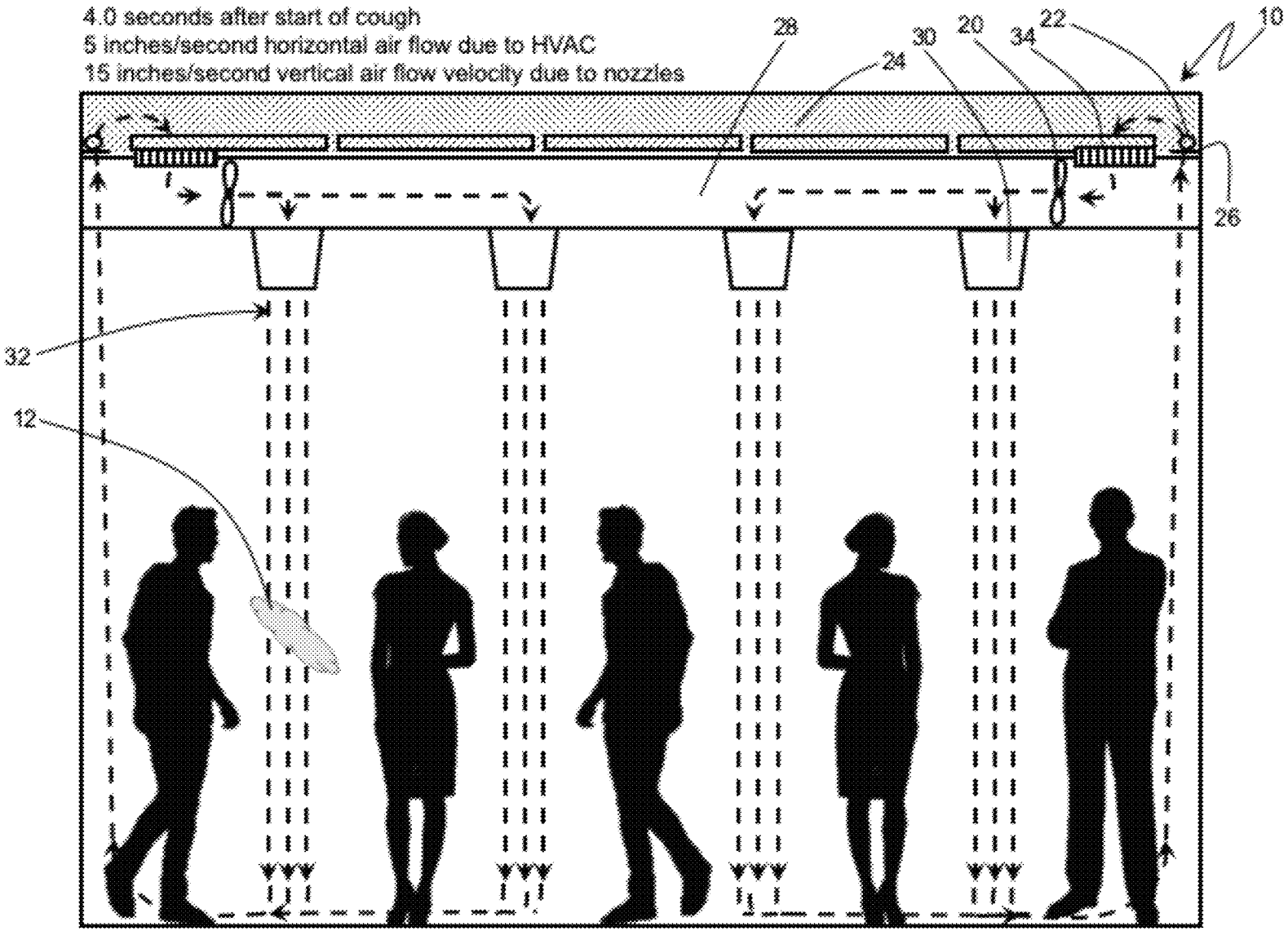
Figure 19C:
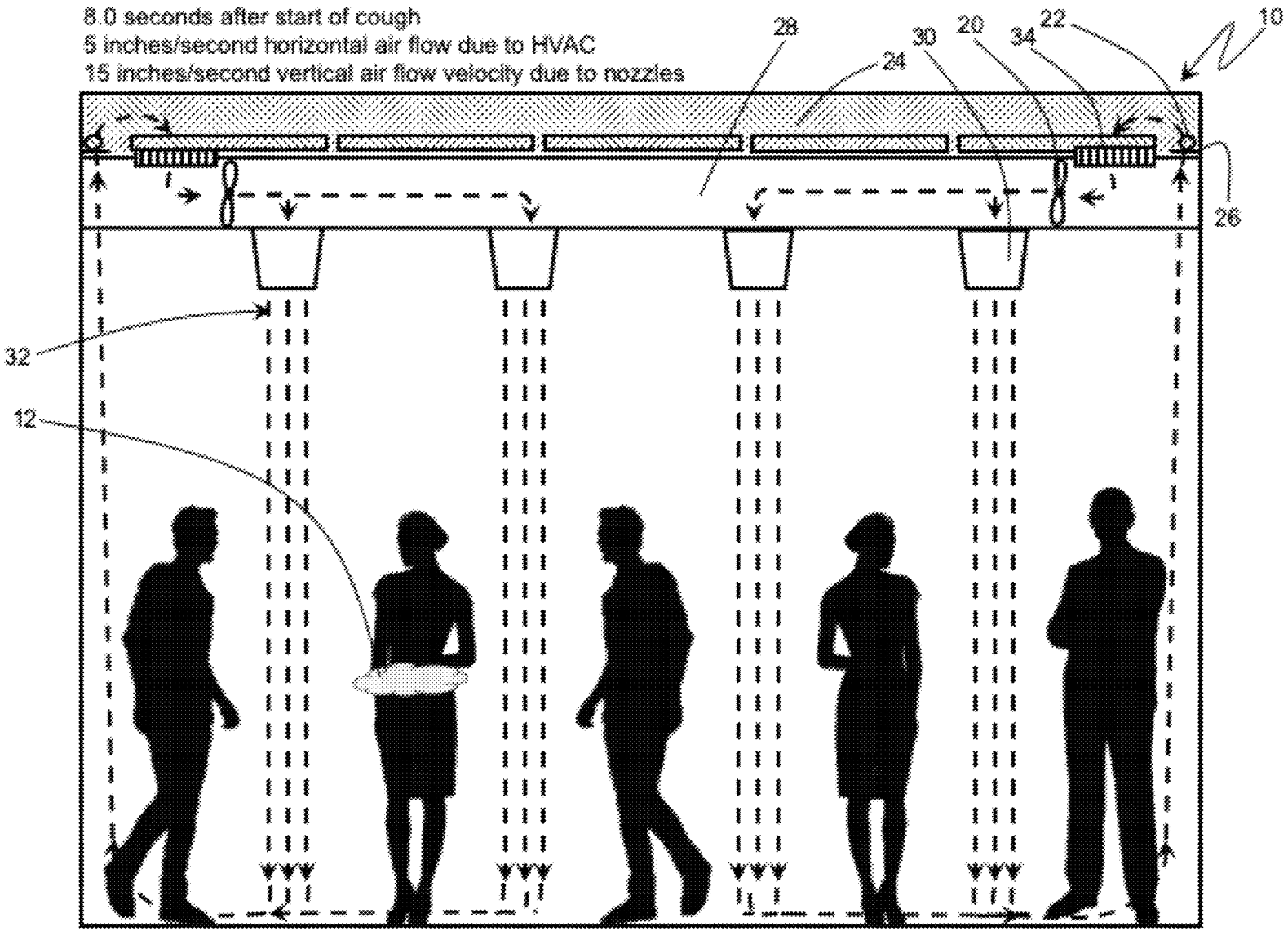
Figure 19D:
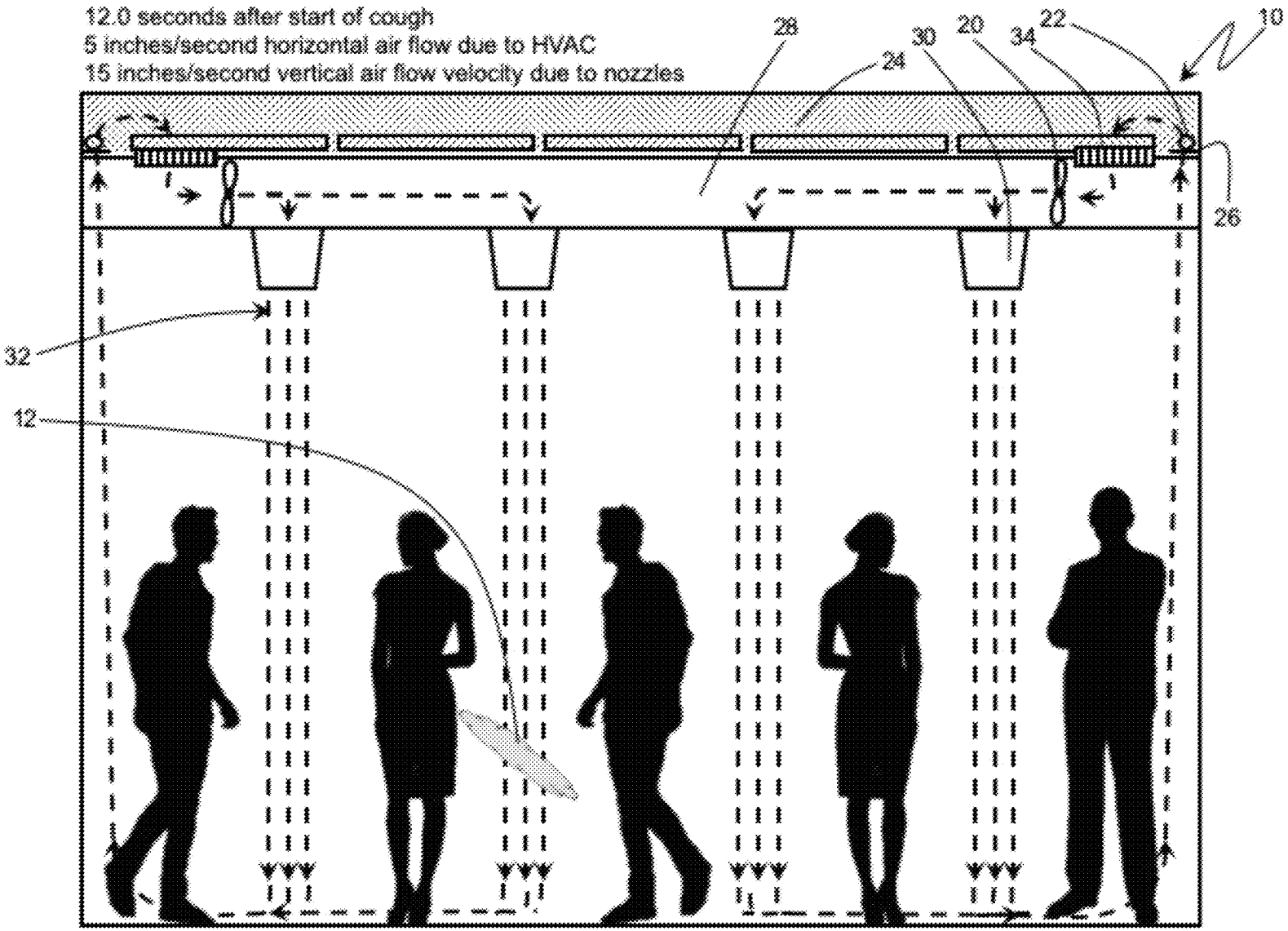
Figure 19E:
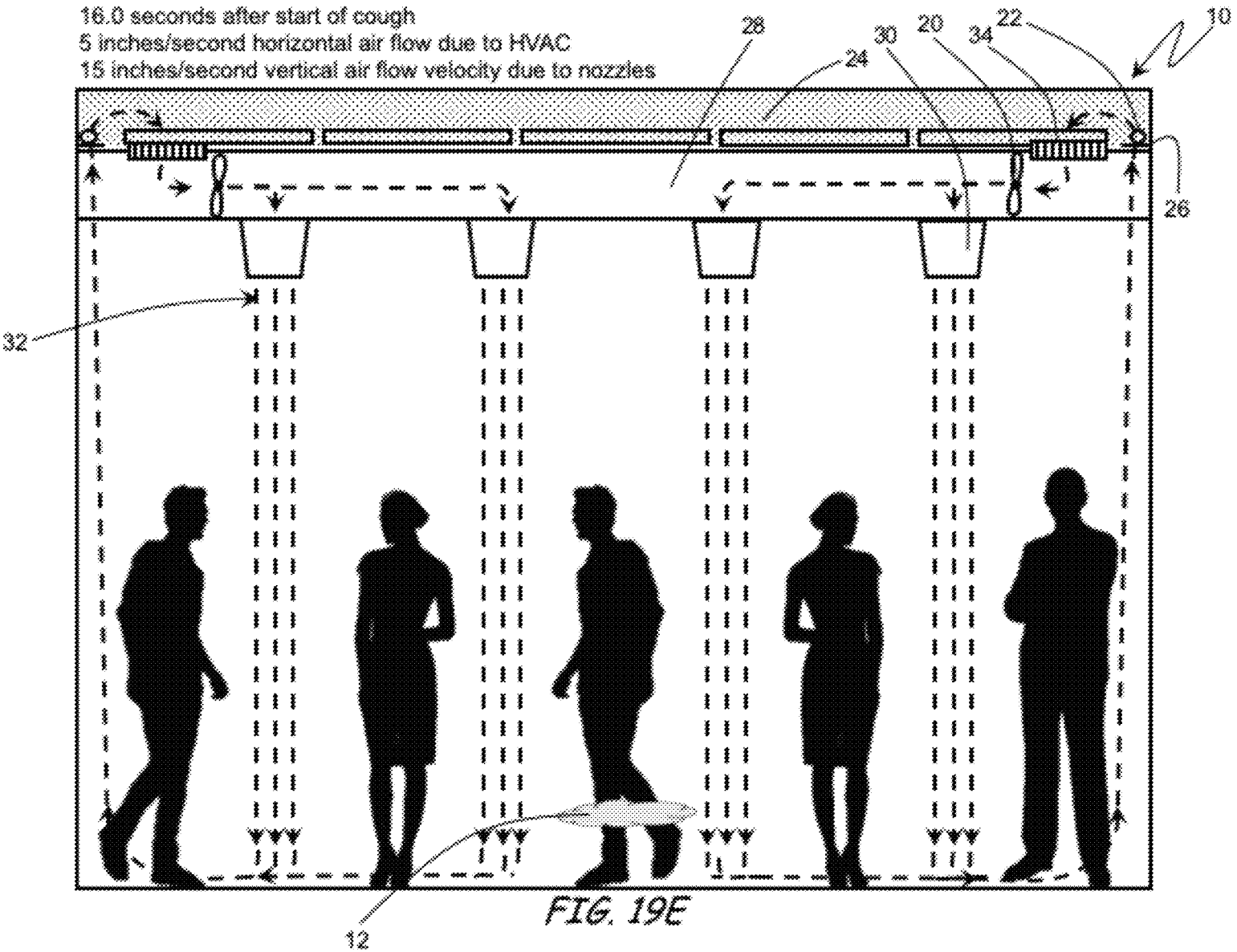
Figure 19F:
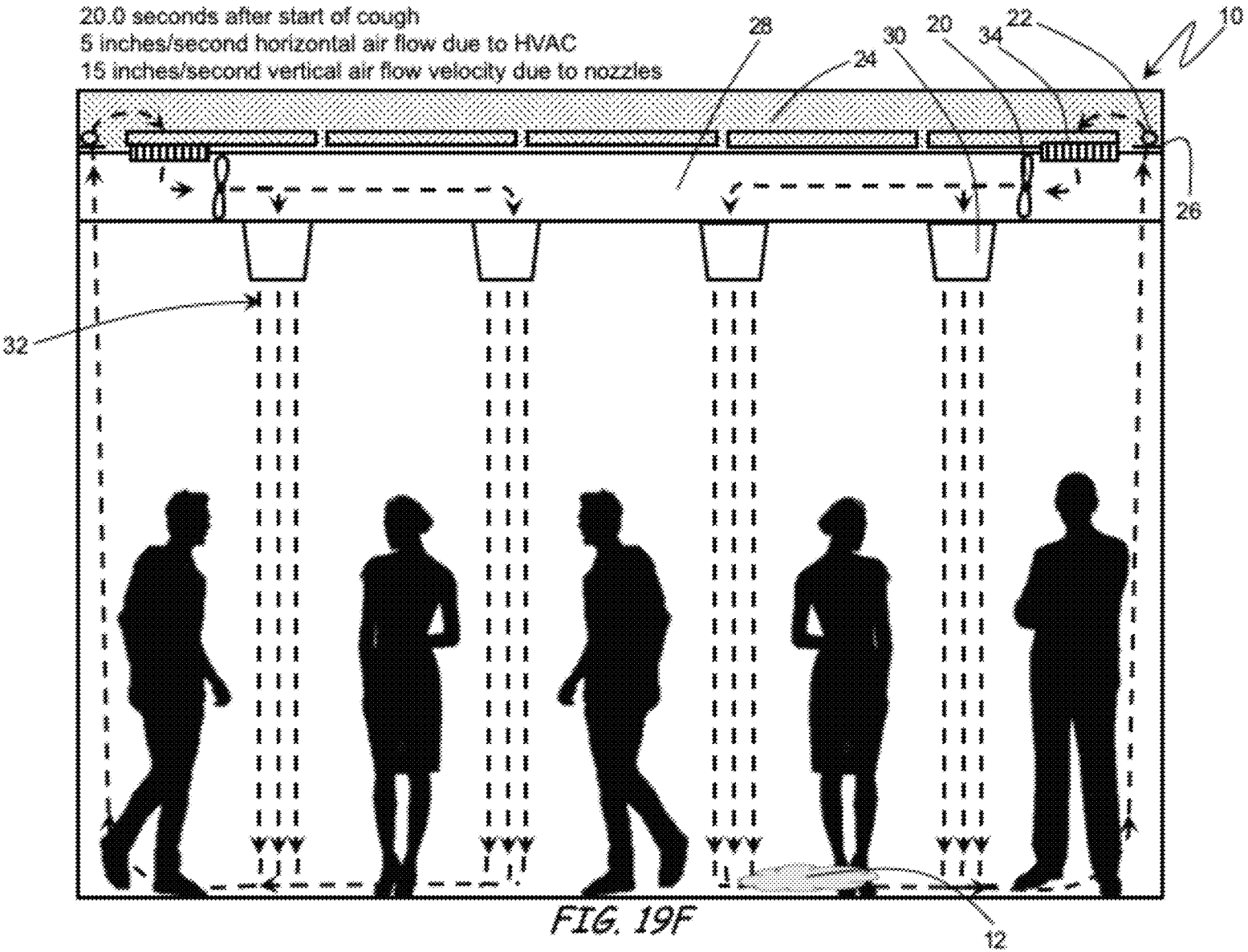
Figure 20A:
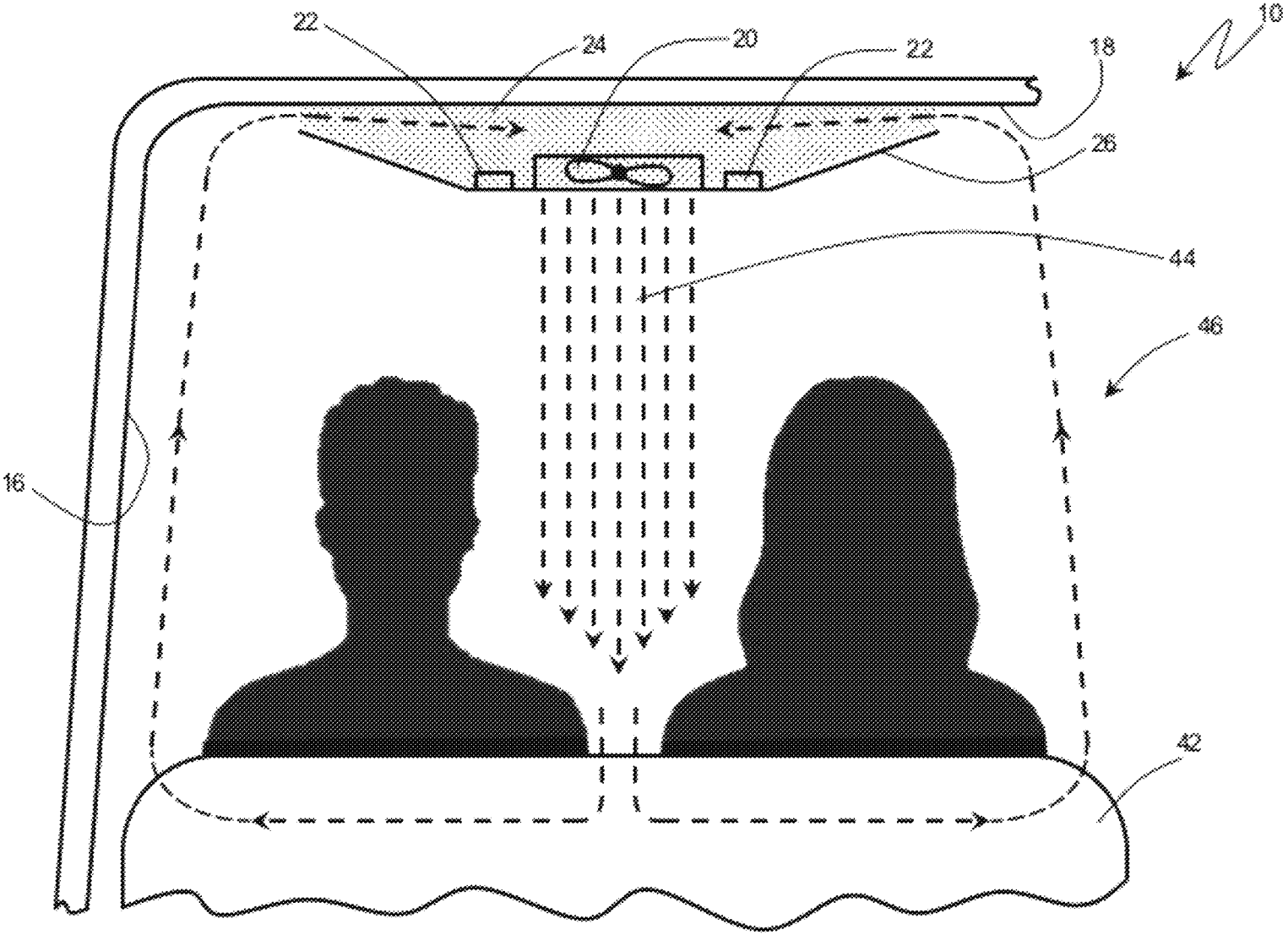
FIGS. 20A-20F are front views of two individuals situated in a vehicle used to transport passengers illustrating a ceiling mounted ventilation system according to still another embodiment of the present invention.
Figure 20B:
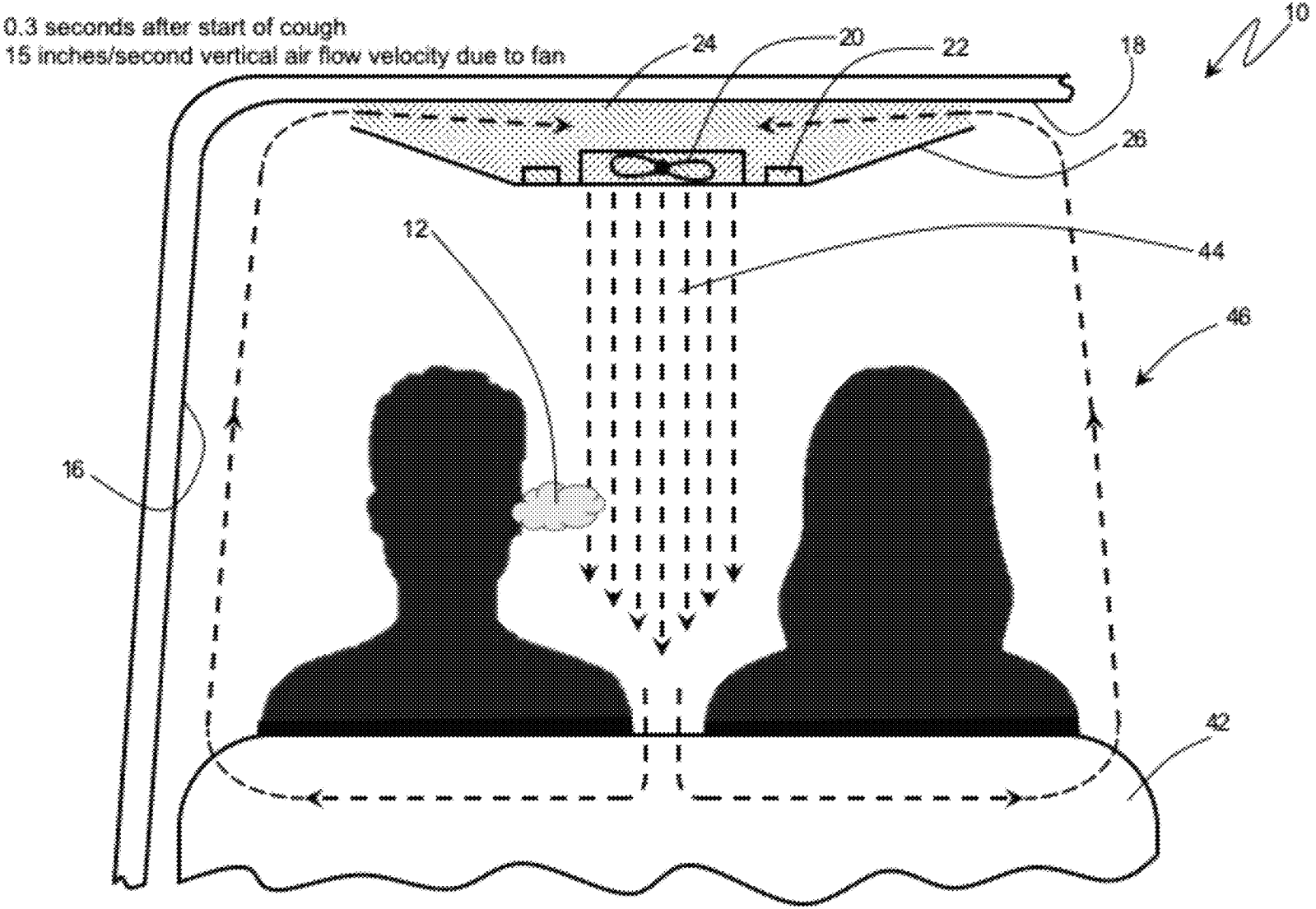
Figure 20C:
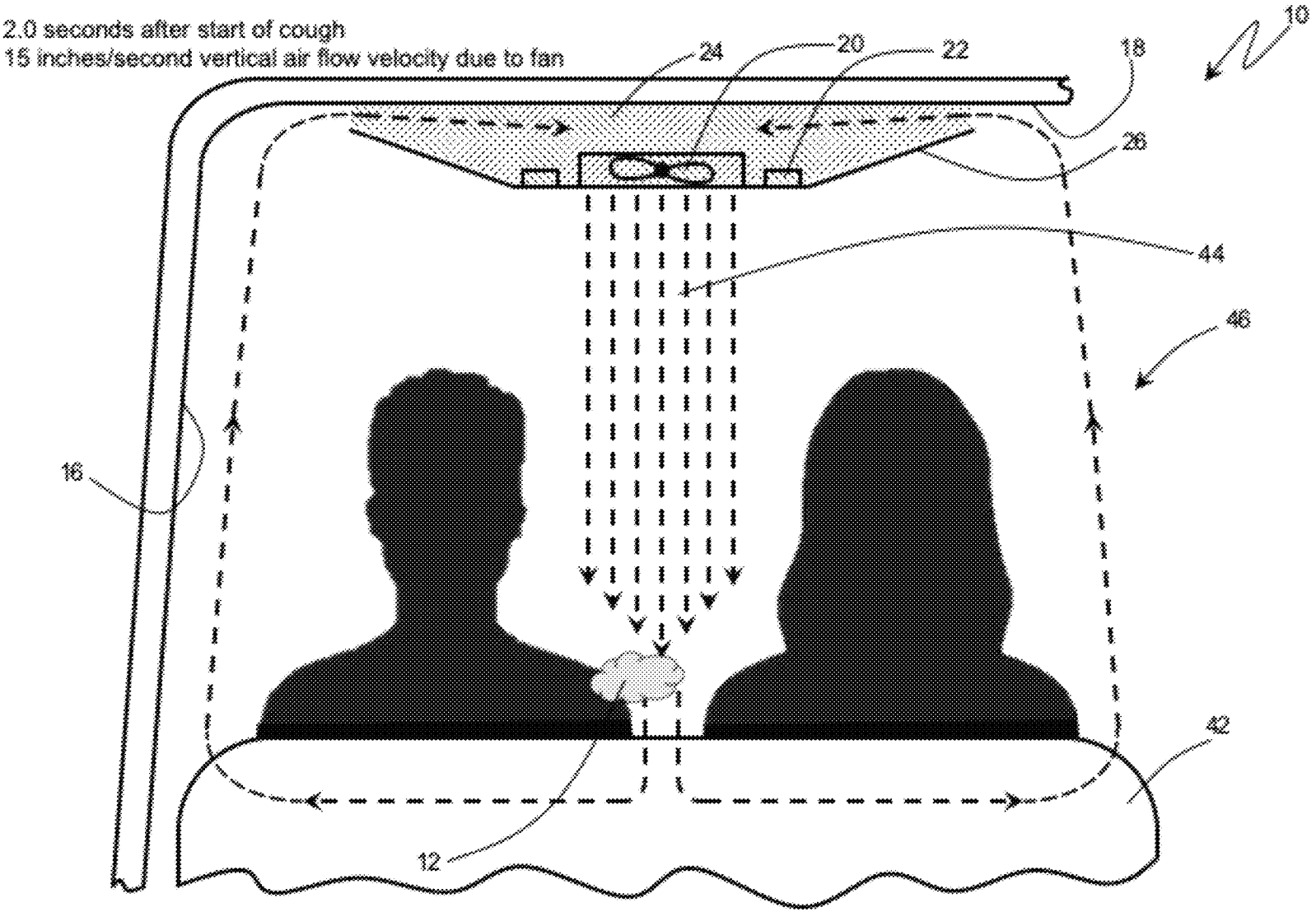
Figure 20D:
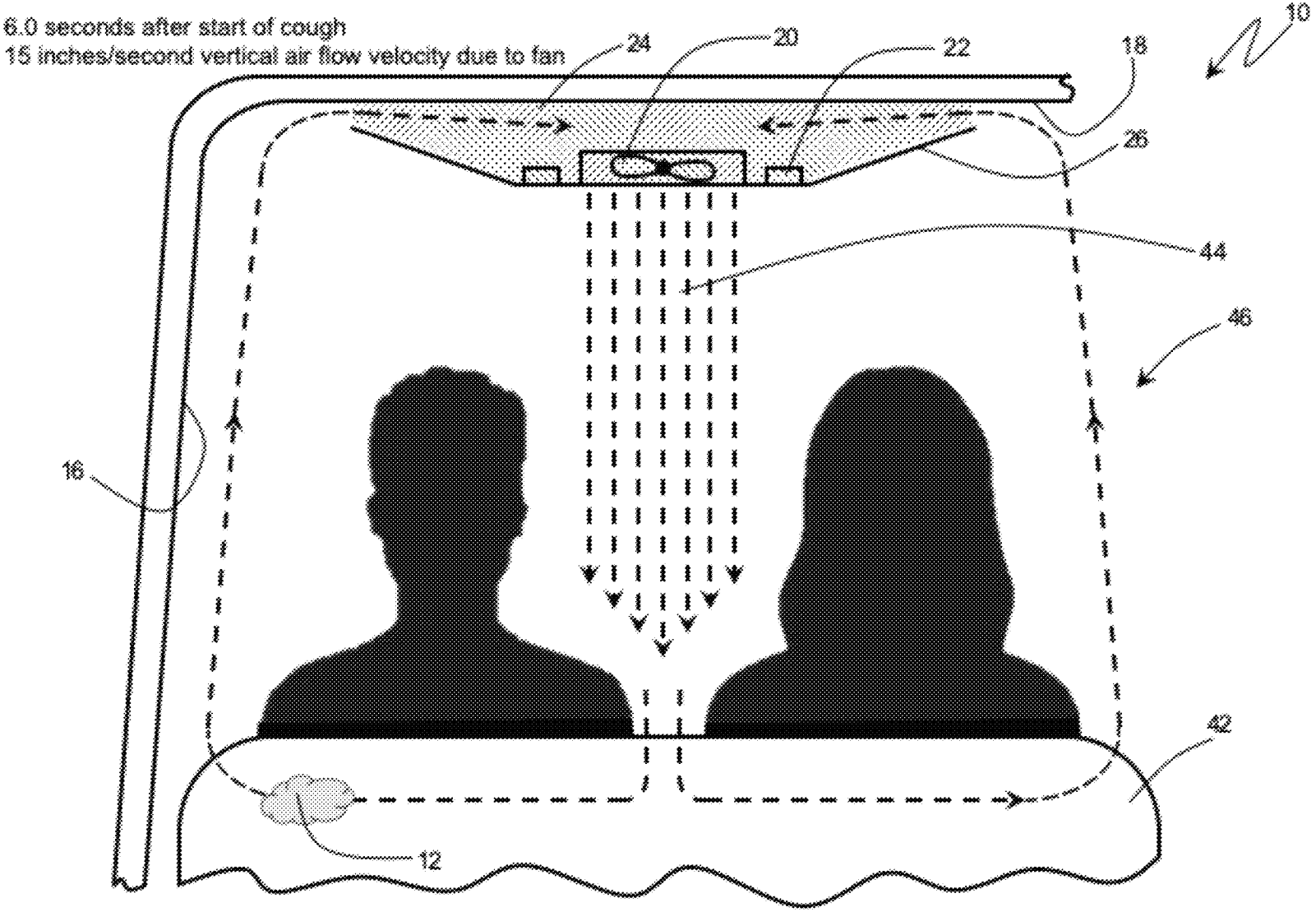
Figure 20E:
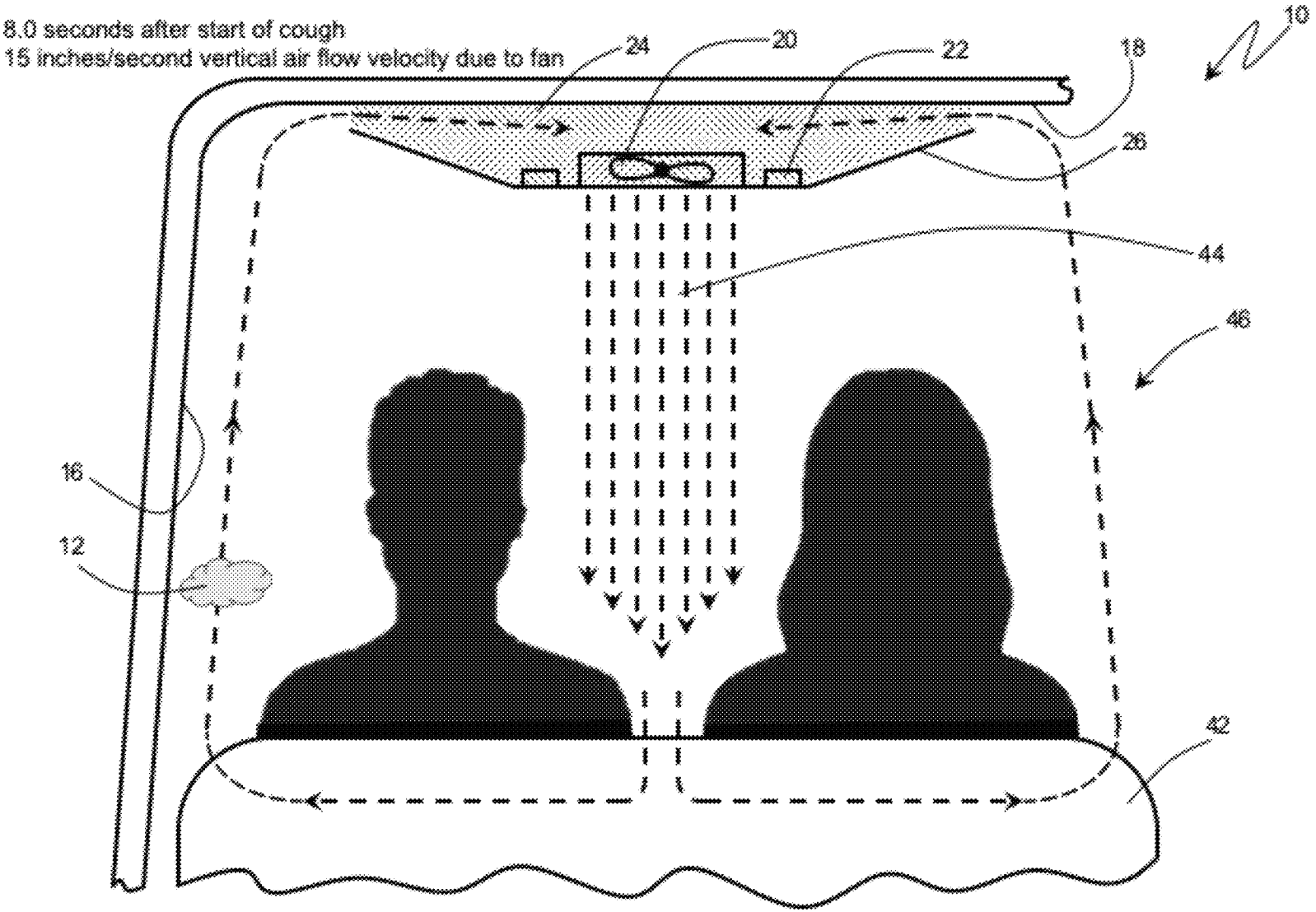
Figure 20F:
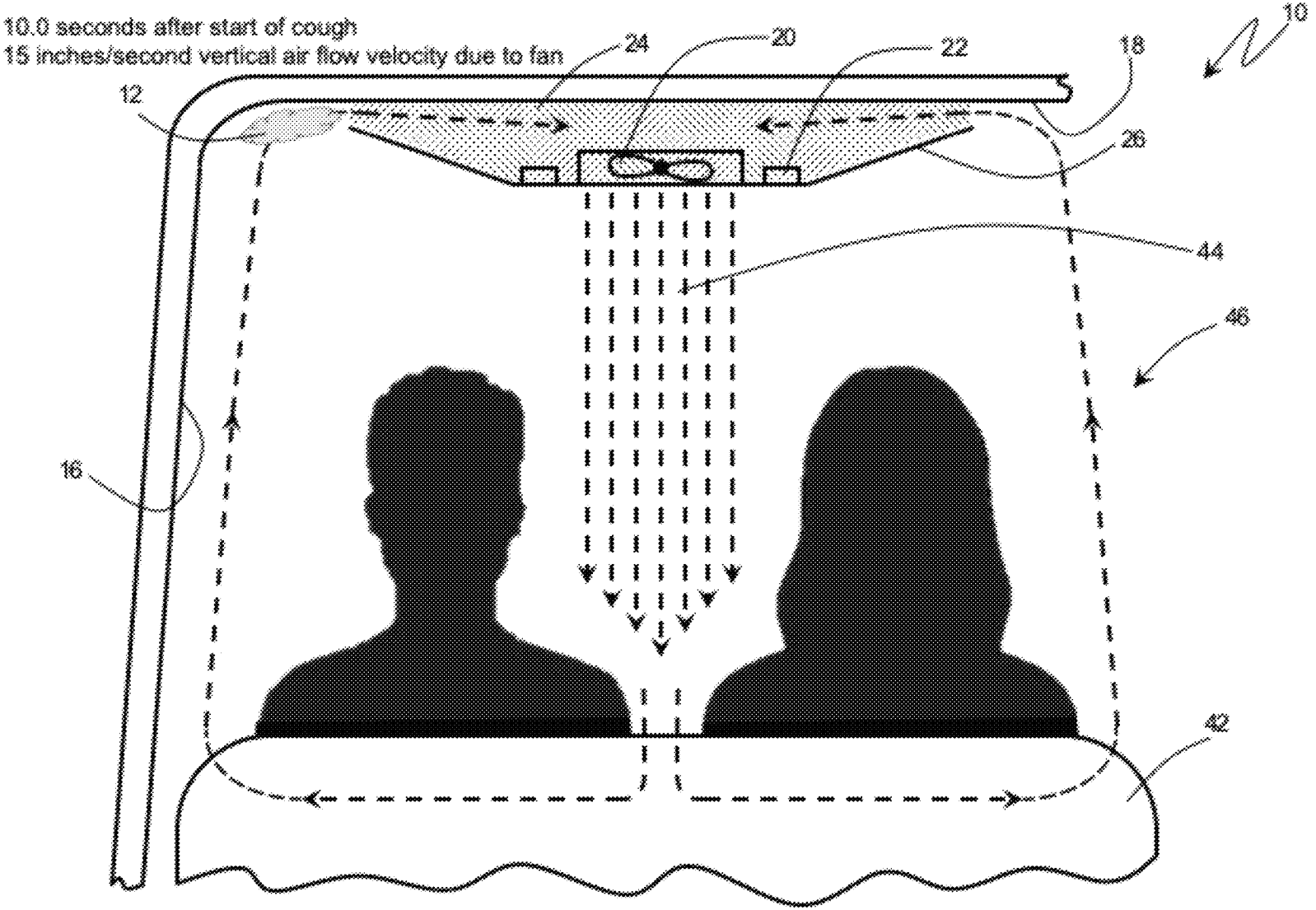

FIGS. 19A-19F illustrate how cloud 12 of infectious viral particles or droplets produced by an individual with a cough will travel from an infected individual throughout the room under yet another embodiment of the present invention, ventilation system 10. FIG. 19A shows cloud 12 0.3 seconds after the cough has been initiated. FIG. 19B illustrates how cloud 12 of infectious viral particles or droplets has traveled in the room utilizing ventilation system 10. Four seconds after the cough was initiated, cloud 12 has been forced to the right by the HVAC system and downward by air curtain 32 out of the ingestion zone of the mouth, nose and eyes of the individual closest to the infected individual. FIG. 19C illustrates how cloud 12 of infectious viral particles or droplets has traveled eight seconds after the cough was initiated. Cloud 12 has been forced further to the right by the HVAC system and further downward by air curtain 32 out of the ingestion zone of the mouth, nose and eyes of the individual closest to the infected individual. FIG. 19D illustrates how cloud 12 of infectious viral particles or droplets has traveled twelve seconds after the cough was initiated. Cloud 12 has been forced still further to the right by the HVAC system and still further drastically downward by a second air curtain 32 approaching floor 14 level. FIG. 19E illustrates how cloud 12 of infectious viral particles or droplets has traveled sixteen seconds after the cough was initiated. Cloud 12 has been forced still further to the right by the HVAC system and still further downward by a second air curtain 32 approaching floor 14 level. FIG. 19F illustrates how cloud 12 of infectious viral particles or droplets has traveled twenty seconds after the cough was initiated. Cloud 12 has been forced still further to the right by the HVAC system and cloud 12 is now at floor 14 level as it approaches wall 16. As stated above an illustrated in FIGS. 17A-17E, cloud 12 will reach wall 16 and ascend up wall 16 to ceiling 18 and ultraviolet C field 24 for eradication of the infectious material while still remaining out of out of the ingestion zone of the mouth, nose and eyes of the individuals closest to the infected individual.

FIGS. 17A-17E, 18A-18D and 19A-19F are all in stark contrast to FIGS. 1A-1F (where there is a potential to infect a number of individuals using a typical HVAC system). FIGS. 17A-17E, 18A-18D and 19A-19F all illustrate the use of ventilation system 10, in the various embodiments described above, to drive a cloud of infectious bacterial or viral material out of the ingestion zone of the mouth, nose and eyes of unsuspecting individuals and the means to eradicated the air flow in a room, building, manufacturing plant floor and the like of the cloud of infectious bacterial or viral material through the use of ultraviolet C radiation.

It is also important to note that ventilation system 10 may use fans of varying sizes speeds and spacing while still accomplishing the main objective of driving cloud 12 of infectious bacterial or viral material out of the ingestion zone of the mouth, nose and eyes of unsuspecting individuals to avoid infection. Along with the use of ultraviolet C light lamps to kill and eradicate the bacterial microbes, viral microbes and any other pathogens, a disinfectant fog may be added to ventilation system 10 to further provide means to disinfect a large area and aid in the killing of any bacteria, viruses and any other pathogens. The disinfectant fog may be added to and disbursed by ventilation system 10 after working hours when the rooms, building and manufacturing plants are empty and free of workers to provide further means of disinfecting the workspaces. The wide distribution of air flow generating devices 20 of ventilation system 10 will help to ensure the disinfectant covers the entire workspace.

In yet another embodiment of the present invention illustrated in FIGS. 20A-20F, ventilation system 10 may be adapted for use in vehicles used to transport people such as the passenger cars of trains, subway cars, buses, airplanes and other vehicles used for hire and moving a number of unrelated individuals in close proximity to one another. Air flow generating device 20 of ventilation system 10 is situated proximate ceiling 18 as described above. In this particular embodiment of the present invention, air flow generating device 20 may be an ultra-quiet fan or blower system designed for generating a high downward air flow with minimal noise so as to not disturb or inconvenience passengers during operation and travel. Ultraviolet C light lamps 22 are also situated proximate ceiling 18 and near air flow generating device 20. When activated, ultraviolet C light lamps 22 create ultraviolet C field 24 as described above in previous embodiments. Shield 26 may also be included with ventilation system 10 to protect individuals from ultraviolet C radiation.

Passengers will be much closer to ventilation system 10 and much closer to one another then in the environments described above in other embodiments. Typical social distancing norms may not be maintained. The passenger environment may resemble the environment depicted in FIGS. 10 and 11, where individuals work in close proximity to one another. To accommodate the passengers in close proximity to one another, air flow generating device 20 may provide sufficient downward air flow to create an air curtain 44 to separate passengers. As described above, air flow generating device 20 will drive air flow and any infectious clouds downward toward the floor of the vehicle and out to walls 16 of the vehicle. If there is another set of seats across the aisle, for example in a plane, bus or train, air flow may be driven outward to an aisle 46. As the air flow reaches walls 16 and aisle 46, the air flow will be outside of the general force of air flow generating device 20 driving the air flow downward. Air flow and any infectious clouds 12 at walls 16 and aisle 46 will be drawn upward to ceiling 18 by the air flow pull from the backside of air flow generating device 20. As the air flow and any infectious clouds reach ceiling 18, the air flow and clouds will enter ultraviolet C field 24 produced by ultraviolet C light lamps 22. While the air flow and infectious clouds are within field 24, the ultraviolet radiation will kill the bacteria, viruses and pathogens contained in infectious cloud as fully described above. After passing through field 24, air flow will be free of any infectious clouds and will be driven downward back toward the floor by air flow generating device 20 to repeat the process. Ventilation system 10 may be of sufficient size so as to fit at the ceiling or overhead each seat or pair of seats to ensure adequate coverage with in the vehicle to remove and kill bacteria, viruses and pathogens from the air in passenger vehicles to help ensure passengers may be transported to their destinations with a reduced fear of contracting an infection.

The present invention has been particularly shown and described with reference to the foregoing embodiments, which are merely illustrative of the best modes presently known for carrying out the invention. It should be understood by those skilled in the art that various alternatives to the embodiments of the invention described herein may be employed in practicing the invention without departing from the spirit and scope of the invention as defined in the following claims. It is intended that the following claims define the scope of the invention and that the method within the scope of these claims and their equivalents be covered thereby. This description of the invention should be understood to include all novel and non-obvious combination of elements described herein, and claims may be presented in this or a later application to any novel non-obvious combination of these elements. Moreover, the foregoing embodiments are illustrative, and no single feature or element is essential to all possible combinations that may be claimed in this or a later application.

What is claimed is:

1. A ventilation system comprising:

at least one air flow generating device, said at least one air flow generating device having a calibrated speed to produce a downward air flow capable of forcing a cloud of infectious bacterial, viral or pathogen particles or droplets out of an ingestion zone of a mouth, a nose and eyes of an individual;

at least one ultraviolet C light lamp positioned proximate at least one wall of an area in a pathway of an infected air flow, the infected air flow containing said cloud of infectious bacterial, viral or pathogen particles or droplets;

an ultraviolet C radiation field created by said at least one ultraviolet C light lamp, said ultraviolet C radiation field extending throughout the area from said at least one wall near a ceiling of the area, and the infected air flow containing said cloud of infectious bacterial, viral or pathogen particles or droplets passing through said ultraviolet C radiation field;

wherein said at least one air flow generating device is positioned to enable an upward air flow return to said at least one air flow generating device to force the infected air flow and said cloud of infectious bacterial, viral or pathogen particles or droplets out of the area and through said ultraviolet C radiation field to eradicate the infectious bacteria, virus and pathogens from the infected air flow; and wherein a fresh air flow free of infectious bacteria, viruses and pathogens is reintroduced back into the area by the downward air flow of said at least one air flow generating device.

2. The ventilation system as recited in claim 1, wherein said at least one air flow generating device is positioned proximate said ceiling.

3. The ventilation system as recited in claim 2, wherein said ventilation system includes a plurality of said air flow generating devices, said plurality of air flow generating devices positioned to enable the upward air flow return at said at least one wall.

4. The ventilation system as recited in claim 2, wherein said ventilation system includes a plurality of said air flow generating devices, said plurality of air flow generating devices positioned to enable the upward air flow return between adjacent said air flow generating devices and at said at least one wall.

5. The ventilation system as recited in claim 1, wherein said at least one air flow generating device is a ceiling fan to generate the downward air flow.

6. The ventilation system as recited in claim 1, wherein said at least one air flow generating device is a blower motor to generate the downward air flow.

7. The ventilation system as recited in claim 1, wherein said ventilation system includes a plurality of said ultraviolet C light lamps to increase the intensity of said ultraviolet C radiation field and enlarge said ultraviolet C radiation field.

8. The ventilation system as recited in claim 1, wherein said ventilation system includes at least one nozzle, said at least one nozzle positioned proximate said at least one air flow generating device and wherein the downward air flow produced by said at least one air flow generating device is directed through said at least one nozzle to create an air curtain, a size, a shape and the positioning of said at least one nozzle capable of being adjusted to regulate the velocity and direction of the downward air flow of said air curtain.

9. The ventilation system as recited in claim 8, wherein said ventilation system includes at least one duct, said at least one duct sized to include:

said at least one air generating device;

at least one intake grate;

at least one exhaust grate; and wherein said at least one air generating device is calibrated to draw a portion of the infected air flow into said at least one duct at said at least one intake grate and force the fresh air flow within said at least one duct out of said at least one duct at said at least one exhaust intake grate to direct the fresh air flow within the area.

10. The ventilation system as recited in claim 9, wherein said duct further includes said at least one ultraviolet C light lamp, said at least one ultraviolet C light lamp positioned in said duct to create said ultraviolet C radiation field within said duct to eradicate the infectious bacteria, virus and pathogens from the infected air flow within said duct.

11. The ventilation system as recited in claim 1, wherein said ventilation system includes at least one duct, said at least one duct sized to include:

said at least one air generating device;

at least one intake grate;

at least one exhaust grate; and wherein said at least one air generating device is calibrated to draw a portion of the infected air flow into said at least one duct at said at least one intake grate and force the fresh air flow within said at least one duct out of said at least one duct at said at least one exhaust intake grate to direct the fresh air flow within the area.

12. The ventilation system as recited in claim 11, wherein said at least one duct further includes said at least one ultraviolet C light lamp, said at least one ultraviolet C light lamp positioned in said at least one duct to create said ultraviolet C radiation field within said at least one duct to eradicate the infectious bacteria, virus and pathogens from the infected air flow within said at least one duct.

13. A method for operating a ventilation system to eliminate infectious bacteria, viruses and other pathogens from air of an area comprising the steps of:

providing said ventilation system that includes:

at least one air flow generating device, said at least one air flow generating device positioned proximate a ceiling of the area;

at least one ultraviolet C light lamp, said at least one ultraviolet C light lamp positioned proximate at least one wall of the area in a pathway of an infected air flow returning to said at least one air flow generating device, the infected air flow containing a cloud of infectious bacterial, viral or pathogen particles or droplets; and an ultraviolet C radiation field created by said at least one ultraviolet C light lamp said ultraviolet C radiation field extending throughout the area from said at least one wall near said ceiling of the area;

rotating said at least one air flow generating device at a calibrated speed to produce a downward air flow within the area;

generating the downward air flow at the calibrated speed to drive said cloud of infectious bacterial, viral or pathogen particles or droplets out of an ingestion zone of the mouth, nose and eyes of an individual;

generating an upward air flow to return the infected air flow to said ceiling to force said cloud of infectious bacterial, viral or pathogen particles or droplets out of the area and through said ultraviolet C radiation field to eradicate the bacteria, virus and pathogens from the infected air flow;

reintroducing a fresh air flow free of infectious bacteria, viruses and pathogens back into the area through said at least one air flow generating device.

14. The method for the operation of a ventilation system as recited in claim 13, wherein said at least one air flow generating device is a ceiling fan to generate the downward air flow.

15. The method for the operation of a ventilation system as recited in claim 14, wherein said ventilation system includes:

a plurality of said air flow generating devices; and positioning said plurality of air flow generating devices to enable the upward air flow return at said at least one wall.

16. The method for the operation of a ventilation system as recited in claim 14, wherein said ventilation system includes:

a plurality of said air flow generating devices; and positioning said plurality of air flow generating devices to enable the upward air flow return between adjacent said air flow generating devices and at said at least one wall.

17. The method for the operation of a ventilation system as recited in claim 13, wherein said at least one air flow generating device is a blower motor to generate the downward air flow.

18. The method for the operation of a ventilation system as recited in claim 13, wherein said ventilation system includes a plurality of said ultraviolet C light lamps to increase the intensity of said ultraviolet C radiation field and enlarge said ultraviolet C radiation field.

19. The method for the operation of a ventilation system as recited in claim 13, wherein said ventilation system includes;

at least one nozzle;

positioning said at least one nozzle proximate said at least one air flow generating device;

directing the downward air flow produced by said at least one air flow generating device through said at least one nozzle to create an air curtain; and adjusting a size, a shape and the positioning of said at least one nozzle to regulate a velocity and direction of the downward air flow of said air curtain.

20. The method for the operation of a ventilation system as recited in claim 19, wherein said ventilation system includes at least one duct, said at least one duct sized to include:

said at least one air generating device;

at least one intake grate;

at least one exhaust grate; and calibrating said at least one air generating device to draw a portion of the infected air flow into said at least one duct at said at least one intake grate; and forcing the fresh air flow within said at least one duct out of said at least one duct at said at least one exhaust intake grate to direct the fresh air flow within the area.

21. The method for the operation of a ventilation system as recited in claim 20, wherein said at least one duct includes;

said at least one ultraviolet C light lamp, positioning said at least one ultraviolet C light lamp in said at least one duct to create said ultraviolet C radiation field within said at least one duct to eradicate the infectious bacteria, virus and pathogens from the infected air flow within said at least one duct.

22. The method for the operation of a ventilation system as recited in claim 13, wherein said ventilation system includes at least one duct, said at least one duct sized to include:

said at least one air generating device;

at least one intake grate;

at least one exhaust grate;

calibrating said at least one air generating device to draw a portion of the infected air flow into said at least one duct at said at least one intake grate; and forcing the fresh air flow within said at least one duct out of said at least one duct at said at least one exhaust intake grate to direct the fresh air flow within the area.

23. The method for the operation of a ventilation system as recited in claim 22, wherein said at least one duct includes;

said at least one ultraviolet C light lamp, positioning said at least one ultraviolet C light lamp in said at least one duct to create said ultraviolet C radiation field within said at least one duct to eradicate the infectious bacteria, virus and pathogens from the infected air flow within said at least one duct.

* * * * *